US006058003A

United States Patent [19]

Hirano et al.

[11] Patent Number: 6,058,003

[45] **Date of Patent: *May 2, 2000**

[54] ELECTROSTATIC CHARGER AND DISCHARGER

[75] Inventors: Masayuki Hirano; Tomomi Katoh; Masami Kadonaga; Akio Kojima, all of Hamamatsu, Japan

[73] Assignee: Hamamatsu Photonics K.K., Hamamatsu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/796,181

[22] Filed: Feb. 7, 1997

[30] Foreign Application Priority Data

| | | | |
|---|---|---|---|
| Feb. 8, 1996 | [JP] | Japan | 8-022689 |
| Feb. 8, 1996 | [JP] | Japan | 8-022690 |
| Feb. 8, 1996 | [JP] | Japan | 8-022691 |
| Mar. 29, 1996 | [JP] | Japan | 8-076875 |
| Mar. 29, 1996 | [JP] | Japan | 8-076876 |

[51] Int. Cl.[7] ..... H05F 1/00

[52] U.S. Cl. ..... 361/225; 361/214

[58] Field of Search ..... 361/212–214, 361/220, 225, 229, 230, 235; 399/168, 169, 50, 128; 250/492.1

[56] References Cited

U.S. PATENT DOCUMENTS

| | | | |
|---|---|---|---|
| 5,604,571 | 2/1997 | Kato et al. | 399/162 |
| 5,666,603 | 9/1997 | Kato et al. | 361/213 |

FOREIGN PATENT DOCUMENTS

| | | |
|---|---|---|
| 62-38491 | 2/1987 | Japan . |
| 63-149669 | 6/1988 | Japan . |
| 1-274186 | 11/1989 | Japan . |
| 2-256084 | 10/1990 | Japan . |
| 6-175469 | 6/1994 | Japan . |
| 7-161485 | 6/1995 | Japan . |
| 8-262844 | 10/1996 | Japan . |
| 8-262845 | 10/1996 | Japan . |

*Primary Examiner*—Fritz Fleming
*Attorney, Agent, or Firm*—Pillsbury Madison & Sutro

[57] ABSTRACT

This invention relates to an electrostatic charger and discharger which can realize ozone-less, non-contact charging that can prevent the member to be charged or the member to be charge-removed from deteriorating upon irradiation of an electromagnetic wave. Each of the charger and discharger has an electric field forming system with a specific structure for efficiently forming an electric field that causes ions produced by an electromagnetic wave to become attached to the major surface of the member to be charged or the member to be charge-removed in a space.

34 Claims, 35 Drawing Sheets

| a [mm] | b [mm] | CHARGE POTENTIAL [V] |
|---|---|---|
| -10 | -10 | -300 |
| -5 | 0 | -440 |
| 0 | 0 | -480 |
| 5 | 0 | -530 |
| 10 | 0 | -580 |
| 15 | 0 | -580 |
| 20 | 0 | -580 |
| 0 | -5 | -460 |
| 0 | 10 | -540 |
| 0 | 15 | -540 |
| 0 | 20 | -540 |
| 10 | 10 | -630 |

| ELECTRODE WIDTH L | CHARGE POTENTIAL |
|---|---|
| 0mm | −450V |
| 5mm | −490V |
| 10mm | −590V |
| 15mm | −650V |
| 20mm | −652V |

| PHOTOCONDUCTOR MOVING VELOCITY | CHARGE POTENTIAL |
|---|---|
| 4mm/s | −650V |
| 8mm/s | −540V |
| 10mm/s | −535V |
| 20mm/s | −450V |
| 40mm/s | −430V |

| PHOTOCONDUCTOR MOVING VELOCITY | CHARGE POTENTIAL |
|---|---|
| 4mm/s | -660V |
| 8mm/s | -640V |
| 10mm/s | -630V |
| 20mm/s | -620V |
| 40mm/s | -603V |

Fig. 48

| THICKNESS OF VINYL CHLORIDE SHIELD PLATE (mm) | RADIATION INTENSITY (mSv/h) |
|---|---|
| 0 | 150 |
| 0.1 | 72 |
| 0.5 | 25 |
| 1 | UNMEASURABLE |
| 4 | UNMEASURABLE |
| 8 | UNMEASURABLE |

Fig. 49

| THICKNESS OF ACRYLIC SHIELD PLATE (mm) | RADIATION INTENSITY (mSv/h) |
|---|---|
| 0 | 150 |
| 0.5 | 115 |
| 1 | 85 |
| 2 | 32 |
| 4 | 5 |
| 8 | UNMEASURABLE |

ELECTROSTATIC CHARGER AND DISCHARGER

BACKGROUND OF THE INVENTION

1. Field of the Invention

The present invention relates to an electrostatic charger and an electrostatic discharger, which can be respectively applied to a charging unit and a charge removing unit in an image forming apparatus such as a copying machine, a facsimile apparatus, a printer, or the like, which uses an electrophotography technique.

2. Related Background Art

An image forming process in a copying machine, a facsimile apparatus, a printer, or the like, which uses an electrophotography technique, includes a charging process for electrostatically charging the major surface (the surface to be charged) of a photoreceptor or photoconductor as a member to be charged. Conventionally, the charging process is attained by a corona charger, which can attain this process in a non-contact manner and has excellent charging stability. However, since this system produces a large amount of ozone, a contact charging system has been examined recently. For example, a contact charging method (a roller charging system using a conductive roller; an AC voltage is superposed on a DC voltage, and the obtained voltage is applied to the conductive roller) disclosed in Japanese Patent Laid-Open No. 63-149669, a brush charging apparatus (a brush charging system using a conductive brush; a low-resistance intermediate conductive member is arranged between the conductive brush and the core metal, and the surface of the member to be charged is uniformly charged while removing environmental dependence of charging) disclosed in Japanese Patent Laid-Open No. 6-175469, and the like, have been put into practical applications.

Furthermore, the above-mentioned image forming process in a copying machine, a facsimile apparatus, a printer, or the like, which uses the electrophotography technique, also includes a charge removing process for removing charges from a photoconductor, a recording paper sheet, and the like. As a charge removing method for a photoconductor, techniques for removing a charge using short-wavelength light are disclosed in, e.g., Japanese Patent Laid-Open Nos. 62-38491, 1-274186, and 2-256084. These charge removing methods relate to charge removal for an organic photoconductor (OPC). With these methods, by irradiating short-wavelength light from a charge removal lamp onto a photoconductor to remove a charge therefrom, a charge trapped deep inside a photoconductive layer can be released without deteriorating the charging performance of the photoconductor.

As a charge removing method and apparatus for a charged object, although they do not relate to charge removal of a photoconductor, for example, Japanese Patent Laid-Open No. 7-161485 discloses a technique for removing the charge on the charged object by irradiating ultraviolet rays from an ultraviolet ray irradiation device onto the charged object to ionize a gas in the atmosphere in which the charged object is placed or to release excessive ions staying inside the charged object.

SUMMARY OF THE INVENTION

The present inventors have found the following objectives as a result of examination of the above-mentioned prior arts.

More specifically, in the conventional contact charging system, since a specific portion (charging portion) of the charging apparatus is in contact with the photoconductor, the specific portion is readily contaminated with toner or the like, and as a consequence, charging performance deteriorates to cause, e.g., nonuniform charging. For this reason, ozone-less (free from production of any ozone) non-contact charging is considered ideal as a charging means.

In the conventional methods of removing a charge from the photoconductor, a charge removal lamp that emits light having a wavelength of about several hundred nm is popularly used. However, since the charge removal lamp utilizes the photoconductive characteristics of the photoconductor, it can only be used in charge removal for the photoconductor. In addition, the polarity of the charge that can be removed is determined by that of the photoconductor. In this fashion, a charge of the opposite polarity, which has become attached to the surface to be charged of the photoconductor as a result of, e.g., discharging, can only be removed by another means.

On the other hand, charge removal of a recording paper sheet is performed to separate the recording paper sheet from the photoconductor, and a corona charger is mainly used for that purpose. Also, in charge removal for the photoconductor before transfer or cleaning, a corona charger is used. In this manner, in the image forming process in the electrophotography technique, a plurality of corona chargers must be prepared to attain charge removal. However, such corona charger produces a large volume of ozone.

In view of these problems, an object of the present invention is to provide a non-contact electrostatic charger and discharger, which do not produce any ozone. In particular, the electrostatic charger according to the present invention can efficiently form an electric field for causing ions produced by electromagnetic waves to become attached to the surface of the photoconductor as the member to be charged in a space, and the electrostatic discharger according to the present invention can remove charges of both polarities attached to the surface of the member to be charge-removed without contacting the member to be charge-removed such as the photoconductor irrespective of the polarity of the photoconductor.

Also, both the electrostatic charger and discharger according to the present invention can be applied to an image forming apparatus, which performs uniform initial charging on the major surface (the surface to be charged) of the photoconductor as the member to be charged, locally removes an initial charge to form an electrostatic charge pattern (electrostatic latent image) modulated in accordance with an image signal, develops the electrostatic charge pattern with toner, and transfers the developed pattern onto a recording paper sheet or an intermediate transfer body to obtain an image. Such image forming apparatus includes a copying machine, a facsimile apparatus, a printer, and the like, which use the electrophotography technique.

More specifically, the electrostatic charger according to the present invention comprises an electromagnetic wave irradiation device having an electromagnetic wave output end face for emitting an electromagnetic wave of a predetermined wavelength, and an electric field forming system for producing an electric field with a predetermined strength in a space between the member to be charged, which is movable in a predetermined direction, and the electromagnetic wave irradiation device.

In particular, the electric field forming system comprises at least a first electrode device provided to face the major surface (the surface to be charged) of the member to be charged, and an intermediate electrode device which is provided between the member to be charged and the first electrode device, and is separated by a predetermined distance from the first electrode device. With this arrangement, a charging electric field can be easily and effectively produced.

Furthermore, the electric field forming system includes a second electrode device (rear surface electrode or counter electrode) provided at a position facing the electromagnetic wave irradiation device to sandwich the member to be charged therebetween. Note that the intermediate electrode device includes at least an electrode pair for producing a predetermined potential difference between the electromagnetic wave irradiation device side and the member-to-be-charged side thereof. The intermediate electrode device includes at least one of a metal mesh having a predetermined aperture ratio, and a conductive plate having a plurality of through holes extending from the electromagnetic wave irradiation device toward the member to be charged.

When the intermediate electrode device includes the conductive plate, the material of the conductive plate is preferably selected from the group consisting of beryllium (Be), magnesium (Mg), calcium (Ca), strontium (Sr), barium (Ba), aluminum (Al), carbon, a carbon film, and their compounds or alloys.

In addition, the intermediate electrode device includes an insulator film, the surface of which is coated with a metal film.

Furthermore, the intermediate electrode device has a surface, which faces the electromagnetic wave irradiation device and has an area larger than that of the electromagnetic wave output end face of the electromagnetic wave irradiation device, so as to improve charging reliability and efficiency with respect to the member to be charged. In particular, in the arrangement, the intermediate electrode device preferably has a portion extending along at least one of the moving direction (downstream side) of the member to be charged and the direction (upstream side) opposite to the moving direction with reference to a region facing the electromagnetic wave output end face of the electromagnetic wave irradiation device. When the major surface of the member to be charged is not flat (see FIG. 5), the intermediate electrode device preferably has a shape having a surface which faces the electromagnetic wave irradiation device and has a predetermined curvature, so that the surface is substantially parallel to the major surface of the member to be charged.

Note that the first electrode device includes the electromagnetic wave irradiation device itself. Furthermore, the first electrode device includes an electrode, which is attached to the electromagnetic wave irradiation device, and is electrically isolated from this device.

When the electric field forming system in the electrostatic charger according to the present invention comprises at least a first electrode device which is set to face the major surface (the surface to be charged) of a movable member to be charged so as to charge the major surface of the member to be charged at a predetermined potential Vs, and a second electrode device (rear surface electrode or counter electrode) which is set at a position facing the first electrode device (or the electromagnetic wave irradiation device itself) to sandwich the member to be charged therebetween, if h represents the distance between the first electrode device and the member to be charged, the electric field forming system produces a potential difference lower than the insulating breakdown voltage of air in the gap width h in a space between the first and second electrode devices.

More specifically, the electric field forming system applies, to the second electrode device, a voltage which has a polarity opposite to that of the charge potential Vs and is larger than the absolute value of the charge potential Vs, and also applies 0 V to the major surface of the member to be charged (first aspect); applies, to the second electrode device, a predetermined voltage having a characteristic opposite to that of the charge potential, and also applies 0 V to the major surface of the member to be charged (second aspect); or applies 0 V to the second electrode device, and also applies, to the first electrode device, a voltage which has the same polarity as that of the charge potential Vs and is larger than the absolute value of the charge potential Vs (third aspect).

When the first electrode device is an electrode which is attached to the electromagnetic wave irradiation device and is electrically isolated from this device, the first electrode device has an appropriate width L along the moving direction of the member to be charged. In consideration of the charging efficiency with respect to the member to be charged, the first electrode device is preferably set so that the distance between the first electrode device and the member to be charged becomes narrow along the moving direction of the member to be charged, or preferably has a shape having a surface of a predetermined curvature, so that the distance between the first electrode device and the member to be charged becomes narrow along the moving direction of the member to be charged.

Furthermore, in the electrostatic charger according to the present invention, the electromagnetic wave output end face of the electromagnetic wave irradiation device may be tilted by a predetermined angle with respect to the major surface (the surface to be charged) of the member to be charged. In this arrangement, the charger comprises an electromagnetic wave shield member which is set to face the electromagnetic wave output end face of the electromagnetic wave irradiation device.

Note that the electromagnetic wave shield member may comprises either an insulating material or a conductor. In particular, when the electromagnetic wave shield member comprises a conductor, it can also serve as a portion of the electrode devices included in the electric field forming system. Since such electromagnetic wave shield member must be kept electrically isolated from the member to be charged, an insulating member is attached to the end portion, on the member to be charged side, of the electromagnetic wave shield member.

The charger having the electromagnetic wave shield member mentioned above satisfies the following condition:

$$H>2\times L\cdot\tan(\theta/2)+D$$

where θ is the irradiation angle of an electromagnetic wave output from the electromagnetic wave irradiation device, L is the distance between the electromagnetic wave irradiation device and the electromagnetic wave shield member, H is the height, in a direction perpendicular to the major surface of the member to be charged, of the electromagnetic wave shield member, and D is the aperture width, in the direction perpendicular to the major surface of the member to be charged, of the electromagnetic wave output end face in the electromagnetic wave irradiation device.

On the other hand, the electrostatic discharger according to the present invention comprises at least an electromagnetic wave irradiation device having an electromagnetic wave output end face which emits an electromagnetic wave of a predetermined wavelength, and is tilted by a predetermined angle with respect to the major surface of a movable member to be charge-removed, so as to remove a charge from the major surface, on which an electrostatic latent image is formed, of the member to be charge-removed.

The discharger further comprises an electric field forming system for producing an electric field of a predetermined strength in at least a portion of an electromagnetic wave irradiated region where the electromagnetic wave from the electromagnetic wave irradiation device reaches. The electric field forming system has an electrode device, which is arranged at a position facing the member to be charge-removed to sandwich, therebetween, the electromagnetic wave irradiated region where the electromagnetic wave from the electromagnetic wave irradiation device reaches, and applies, to the electrode device, a voltage having a polarity opposite to the charging polarity of the member to be charge-removed.

In addition, as in the above-mentioned charger, the discharger may comprise an electromagnetic wave shield member provided in the space between the electromagnetic wave irradiation device and the member to be charge-removed. The setting position of the electromagnetic wave shield member may be a position facing the member to be charge-removed and/or a position facing the electromagnetic wave irradiation device.

Note that the discharger may further comprise a driving system for moving the region where the electromagnetic wave from the electromagnetic wave irradiation device reaches along the moving direction of the member to be charge-removed, thereby charge removal efficiency with respect to the member to be charge-removed would be improved.

BRIEF DESCRIPTION OF THE DRAWINGS

FIG. 48 is a table showing the measurement results of the intensity (mSv/h) of radiation which passes through an electromagnetic wave shield member when the plate thickness (mm) is changed in the experimental arrangement (the 15th embodiment) shown in FIG. 44, which uses a vinyl chloride plate as the electromagnetic wave shield member;

FIG. 49 is a table showing the measurement results of the intensity (mSv/h) of radiation which passes through the electromagnetic wave shield member when the plate thickness (mm) is changed in the experimental arrangement (the 15th embodiment) shown in FIG. 44, which uses an acrylic plate as the electromagnetic wave shield member;

DETAILED DESCRIPTION OF THE PREFERRED EMBODIMENTS

The principle of a non-contact charging process by an electrostatic charger according to the present invention will be described below.

When an electromagnetic wave is irradiated into air, the air in the irradiated region is ionized to produce anions and cations. Hence, when an electromagnetic wave irradiation device irradiates an electromagnetic wave to a space above the surface (the surface to be charged) of a photoconductor as the member to be charged (to produce both anions and cations), and a desired electric field is also applied to the space, only ions of a desired polarity can be made to attach to the surface of the photoconductor. With this principle, the photoconductor can be charged in a non-contact manner. As an electromagnetic wave that can be used in the electrostatic charger according to the present invention, ultraviolet rays, soft X-rays, X-rays, y-rays, or the like may be used. In consideration of the ionization efficiency and safety, soft X-rays or X-rays are preferable.

The basic arrangement of the electrostatic charger according to the present invention will be described below with reference to FIGS. 1 and 2.

Figure 1:
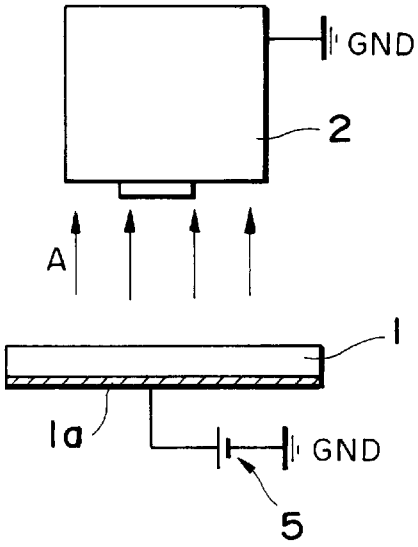
FIG. 1 is a schematic view showing the basic arrangement (case 1) of an electrostatic charger according to the present invention.

As shown in FIG. 1, the electrostatic charger according to the present invention comprises, as its basic arrangement (case 1), an electromagnetic wave irradiation device 2, an electrode 1*a* (to be referred to as a rear surface electrode or a counter electrode hereinafter) formed on the rear surface of a photoconductor 1 as the member to be charged, and a DC voltage power supply 5. As the photoconductor 1, an organic photoconductor (OPC) was used. The rear surface electrode (counter electrode) 1*a* of the photoconductor 1 is applied with a positive voltage from the DC voltage power supply 5 (included in an electric field forming system), and the electromagnetic wave irradiation device 2 is connected to ground. Therefore, the electromagnetic wave irradiation device 2 is included in a first electrode device, the rear surface electrode 1*a* is included in a second electrode device, and an electric field is produced by the electric field forming system including these electrode devices in a direction indicated by an arrow A in FIG. 1 between the photoconductor 1 and the electromagnetic wave irradiation device 2. Note that the distance between the electromagnetic wave irradiation device 2 and the photoconductor 1 is 5 (mm).

In this basic arrangement, the present inventors confirmed that the photoconductor 1 was charged to a potential (charge potential) of about −500 (V) when the electric field forming system applied a voltage of 3 (kV) to the rear surface electrode 1*a* of the photoconductor 1 (production of a charging electric field), and the electromagnetic wave irradiation device 2 irradiated soft X-rays having a wavelength of about $10^{-10}$ to $10^{-9}$ (m) while moving the photoconductor 1 at a linear velocity of 40 (mm/s). Note that no smell of ozone was felt during the charging process. Furthermore, as a result of cascade-developing the charged photoconductor 1, no charging nonuniformity was confirmed at all.

When a selenium (Se) photoconductor was used as the photoconductor 1, the power supply 5 was connected in a direction opposite to that shown in FIG. 1 to apply a voltage of −3 (kV) to the rear surface electrode 1*a* of the photoconductor 1, and soft X-rays were irradiated similarly, the photoconductor 1 was uniformly charged (the charge potential was about 500 (V)).

When charging was performed using X-rays having a shorter wavelength than that of the soft X-rays in place of the soft X-rays, uniform charging could be attained although the charge potential lowered slightly.

Figure 2:
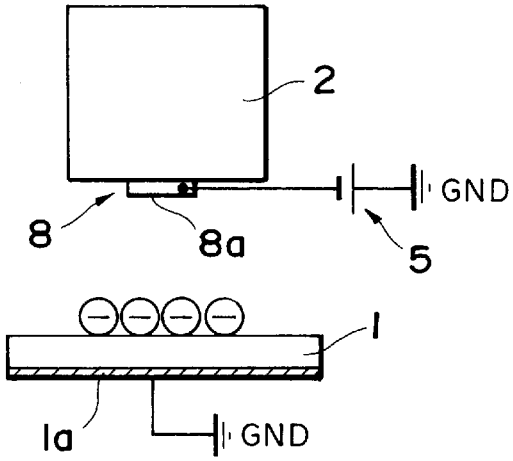
FIG. 2 is a schematic view showing the basic arrangement (case 2) of an electrostatic charger according to the present invention.

Also, as shown in FIG. 2, the electrostatic charger according to the present invention comprises, as its basic arrangement (case 2), an electromagnetic wave irradiation device 2 (included in a first electrode device), a rear surface electrode 1*a* (included in a second electrode device) arranged on the rear surface of a photoconductor 1, and a DC voltage power supply 5. In this arrangement, the rear surface electrode 1*a* of the photoconductor 1 is connected to ground, and an electromagnetic wave irradiation end 8 (having an electromagnetic wave output end face 8*a*) of the electromagnetic wave irradiation device 2 is applied with a voltage of −3 (kV) from the DC voltage power supply 5 (included in an electric field forming system). Therefore, an electric field is produced between the photoconductor 1 and the electromagnetic wave irradiation device 2 in the same direction as that in FIG. 1. Note that the distance between the electromagnetic wave irradiation device 2 and the photoconductor 1 is 5 (mm).

The present inventors confirmed that the photoconductor 1 was charged to a potential of about −500 (V) without any smell of ozone, when the photoconductor 1 was moved at a linear velocity of 40 (mm/s) while the electromagnetic wave irradiation device 2 irradiated soft X-rays having a wavelength of about $10^{-10}$ to $10^{-9}$ (m). In addition, upon cascade-developing the photoconductor 1 after execution of the charging process, no charging nonuniformity was confirmed.

When X-rays were used in place of soft X-rays in the arrangement shown in FIG. 2, the present inventors found out that the surface of the photoconductor 1 was uniformly charged although the charge potential slightly differed.

Figure 4:
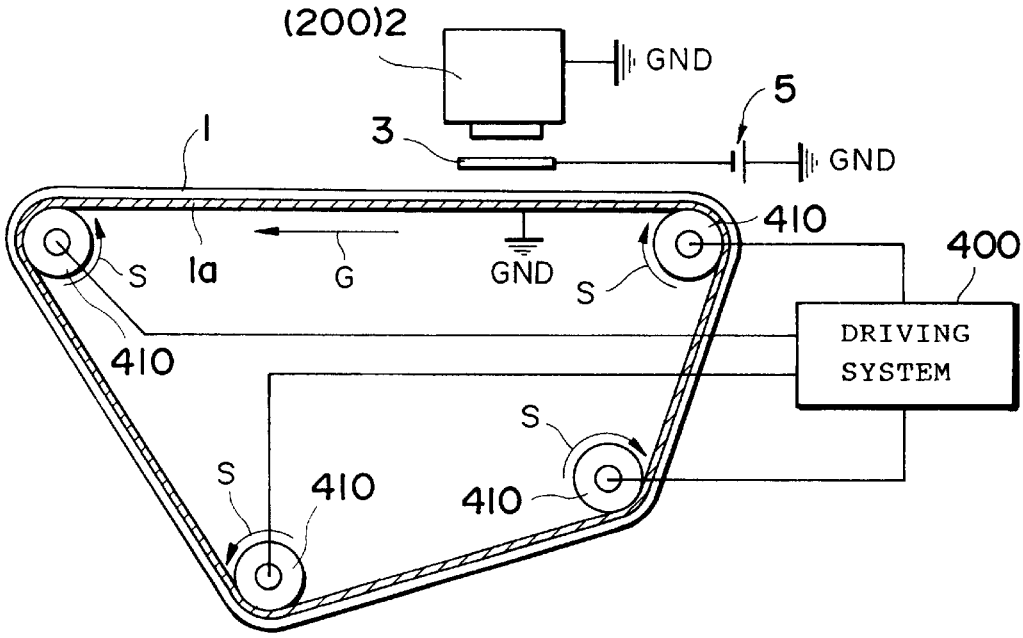
FIG. 4 is a schematic view showing the arrangement (case 1) of a driving mechanism for moving the member to be charged and the member to be charge-removed in a predetermined direction.
Figure 5:
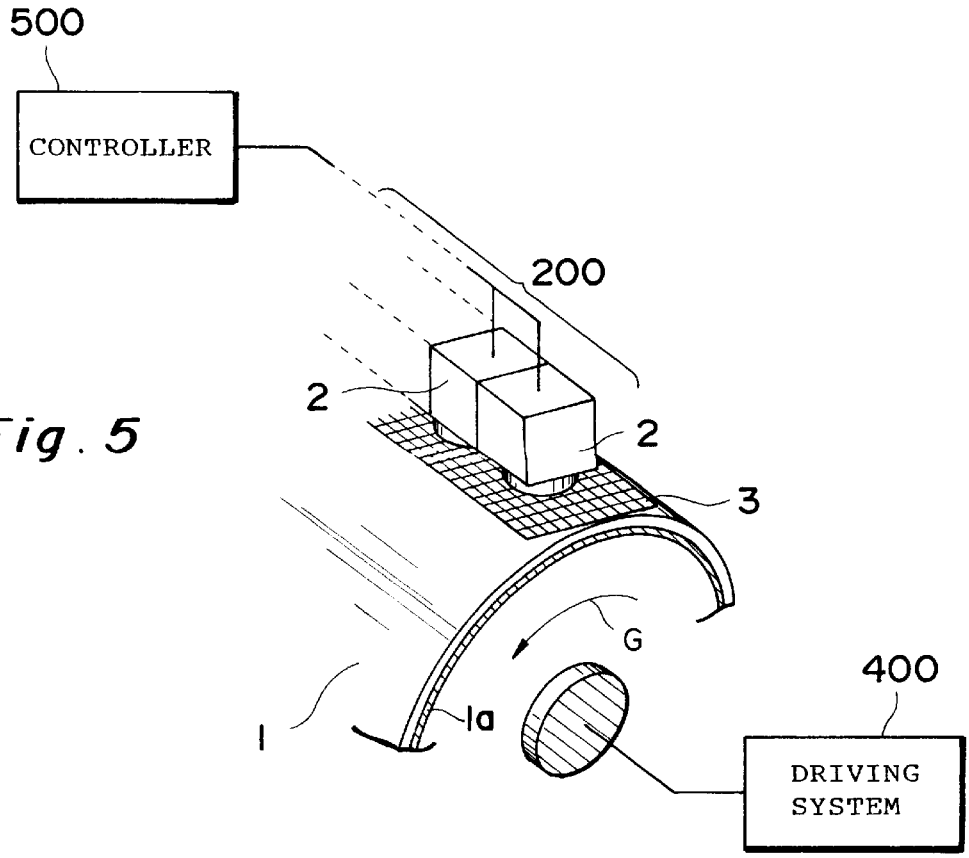
FIG. 5 is a perspective view showing the arrangement (case 2) of the driving mechanism for moving the member to be charged and the member to be charge-removed in the predetermined direction.

The photoconductor 1 is moved in a predetermined direction (a direction indicated by an arrow G in FIGS. 4 and 5) by a mechanism shown in, e.g., FIGS. 4 and 5. In particular, FIG. 4 shows a mechanism for moving the photoconductor 1, SO that the region to be charged of the photoconductor 1 becomes flat, and FIG. 5 shows the mechanism used when the photoconductor 1 has a hollow cylindrical shape.

In the mechanism shown in FIG. 4, when a driving system 400 rotates rollers 410 at a predetermined velocity in a direction indicated by an arrow S in FIG. 4, the photoconductor 1 can move at a predetermined linear velocity in the moving direction indicated by the arrow G in FIG. 4. On the other hand, in the mechanism shown in FIG. 5, when the driving system 400 rotates the central shaft of the photoconductor 1 (photosensitive drum) in the direction indicated by the arrow G in FIG. 5, the surface of the photoconductor 1 can move at a predetermined linear velocity in the direction indicated by the arrow G in FIG. 5.

A plurality of electromagnetic wave irradiation devices 2 are arranged in line to constitute an array 200, as shown in FIG. 5. Irradiation of an electromagnetic wave from the electromagnetic wave irradiation devices 2 that constitute the array 200 is controlled by a controller 500. When the controller 500 turns on/off the electromagnetic wave irradiation devices 2 while the major surface (the surface to be charged) of the photoconductor moves at a predetermined linear velocity, a desired electrostatic latent image (electrostatic charge pattern) is formed on the major surface of the photoconductor 1.

Embodiment (1-1)

Figure 3:
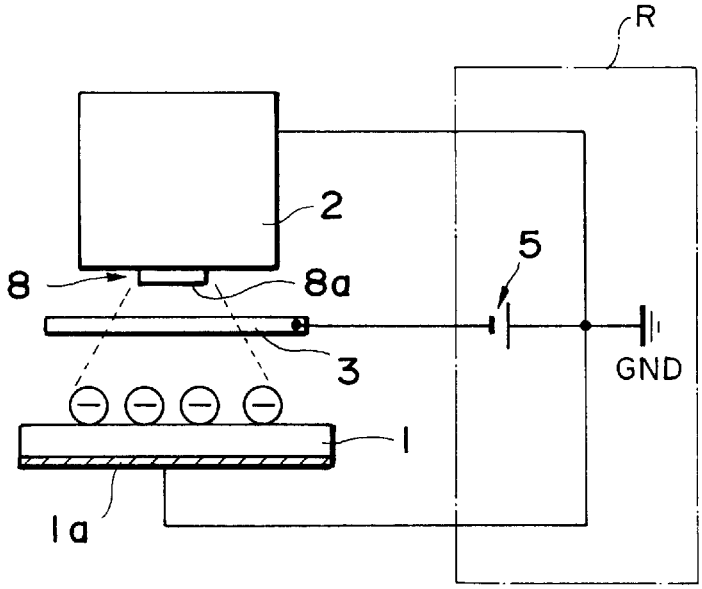
FIG. 3 is a schematic view showing the arrangement of the first embodiment (Embodiment 1-1) of the electrostatic charger according to the present invention.

The first embodiment of the electrostatic charger according to the present invention will be described below with reference to FIG. 3. As shown in FIG. 3, the charger comprises an electromagnetic wave irradiation device 2 (included in a first electrode device), a grid 3 (included in an intermediate electrode device) arranged between a photoconductor 1 and the electromagnetic wave irradiation device 2, a DC voltage power supply 5, and a rear surface electrode 1*a* (included in a second electrode device) which faces the electromagnetic wave irradiation device 2 to sandwich the photoconductor 1 therebetween. Note that an electric field forming system for producing a desired electric field between the electromagnetic wave irradiation device 2 and the photoconductor 1 comprises the above-mentioned first electrode device (the electromagnetic wave irradiation device 2 in this embodiment), the second electrode device (the rear surface electrode 1*a*), the intermediate electrode device (grid electrode 3), and a power supply system R including the DC voltage power supply 5.

The electric field forming system applies a negative voltage from the DC voltage power supply 5 to the grid 3, and connects the rear surface electrode 1*a* of the photoconductor 1 and the electromagnetic wave irradiation device 2 to ground (applies 0 V thereto). Therefore, an electric field is produced in the space between the photoconductor 1 and the grid 3 in a direction from the photoconductor 1 toward the grid 3. Note that the grid 3 used was a stainless steel mesh. A line diameter a of this stainless steel mesh is 0.1 (mm), its pitch b is about 0.8 (mm), and its aperture ratio is about 0.77 (see FIG. 6). Note that the aperture ratio is defined by $(b-a)^2/b^2$ (where a is the line diameter or width, and b is the pitch) in this specification.

Figure 6:
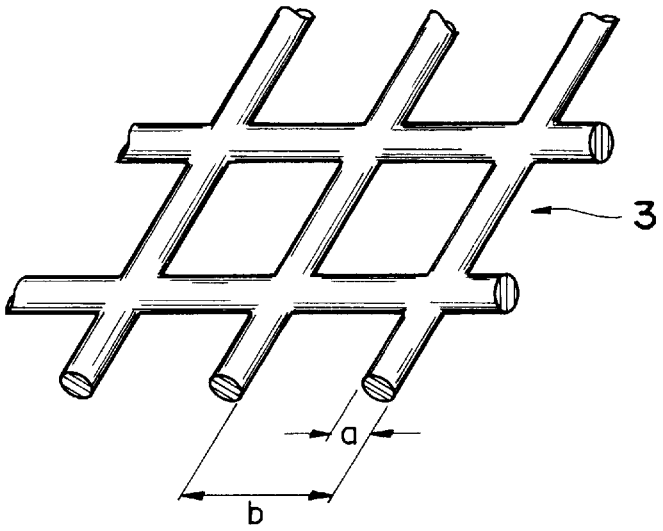
FIG. 6 is a perspective view showing the arrangement of an intermediate electrode device (metal mesh) which can be applied to the electrostatic charger and discharger according to the present invention.
Figure 7:
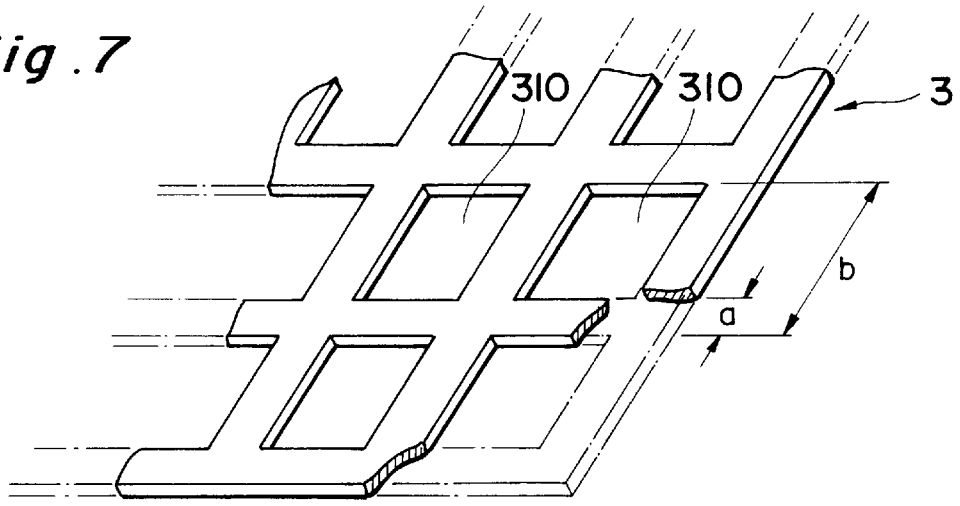
FIG. 7 is a perspective view showing the arrangement of an intermediate electrode device (conductive plate) which can be applied to the electrostatic charger and discharger according to the present invention.

The intermediate electrode device (grid 3) may comprise a conductive plate, which has a plurality of through holes 310, and comprises one of beryllium (Be), magnesium (Mg), calcium (Ca), strontium (Sr), barium (Ba), aluminum (Al), carbon, a carbon film, and their compounds or alloys, as shown in FIG. 7, in place of the metal mesh shown in FIG. 6.

Figure 8:
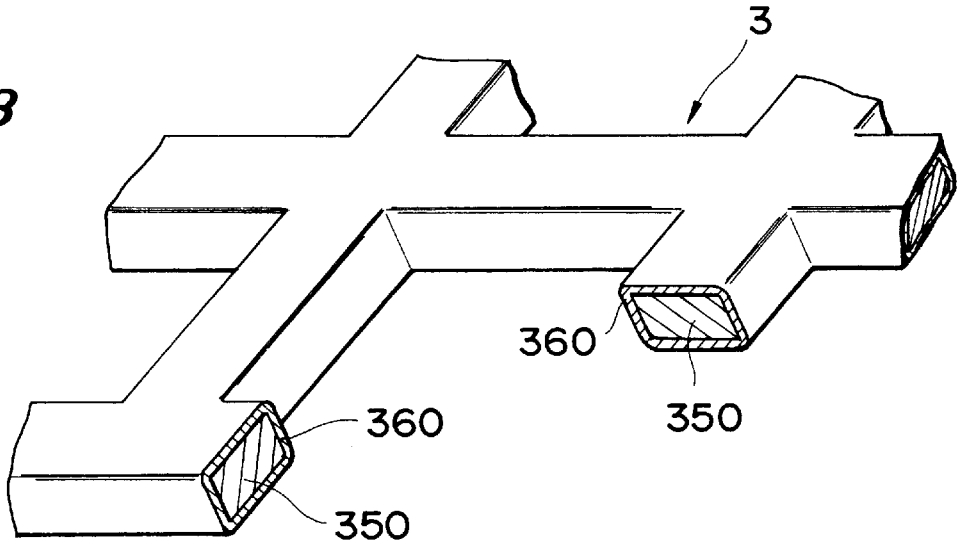
FIG. 8 is a perspective view showing the arrangement of an intermediate electrode device (an insulator film, the surface of which is coated with a metal film) which can be applied to the electrostatic charger and discharger according to the present invention.

Furthermore, the intermediate electrode device may be constituted by coating the surface of an insulator film 350 with a metal film 360, as shown in FIG. 8.

In the first embodiment, the distance between the electromagnetic wave irradiation device 2 and the photoconductor 1 is 6 (mm), and the grid 3 is separated from the photoconductor 3 by 3 (mm).

With the above arrangement, the present inventors learned that the photoconductor 1 was uniformly charged to a potential of about −300 (V), when the electric field forming system applied a voltage of −2 (kV) to the grid 3 (production of a charging electric field), and the electromagnetic wave irradiation device 2 irradiated soft X-rays having a wavelength of about $10^{-10}$ to $10^{-9}$ (m) while moving the photoconductor 1 at a linear velocity of 100 (mm/s).

Note that the first embodiment uses a mesh having an aperture ratio of 0.77 as the grid (electrode) 3. Since too small an aperture ratio results in not only a decrease in charging efficiency with respect to the photoconductor 1 but also a cause of charging nonuniformity, the aperture ratio is preferably set to be 0.5 or more.

In the first embodiment, a negative voltage is applied to the grid 3. Alternatively, when the apparatus applies a positive voltage to the grid 3, the major surface of the photoconductor 1 can be charged positive.

On the other hand, uniform charging could be attained using soft X-rays and ultraviolet rays in place of X-rays. However, the present inventors found that the charge potential was slightly small in the case of ultraviolet rays. In view of this, as the electromagnetic wave to be used, soft X-rays or X-rays are preferable.

Embodiment (1-2)

Figure 9:
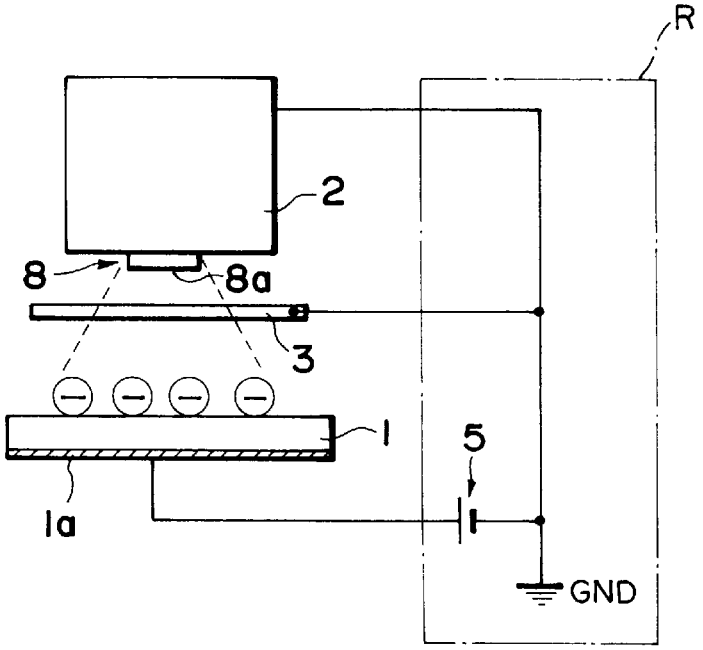
FIG. 9 is a schematic view showing the arrangement of the second embodiment (Embodiment 1-2) of the electrostatic charger according to the present invention.

The second embodiment of the electrostatic charger according to the present invention will be described below with reference to FIG. 9. As shown in FIG. 9, the charger of the second embodiment comprises at least an electromagnetic wave irradiation device 2, a rear surface electrode 1*a* arranged on the rear surface of a photoconductor 1, a grid 3 arranged between the photoconductor 1 and the electromagnetic wave irradiation device 2, and a DC voltage power supply 5. The rear surface electrode 1*a* of the photoconductor 1 is applied with a positive voltage from the DC voltage power supply 5, and the electromagnetic wave irradiation device 2 and the grid 3 are connected to ground. Hence, an electric field is produced between the photoconductor 1 and the grid 3 in a direction from the photoconductor 1 toward the grid 3. Note that a beryllium (Be) plate having a thickness of 100 ($\mu$m) is used as the grid 3, and is set at a position separated by 3 (mm) from the photoconductor 1. Also, the distance between the electromagnetic wave irradiation device 2 and the photoconductor 1 is 6 (mm).

With the above arrangement, the present inventors confirmed that the photoconductor 1 was uniformly charged to a potential of about −600 (V), when the electric field forming system connected the grid 3 to ground and applied a voltage of 2 (kV) to the rear surface electrode 1*a* of the photoconductor 1 (production of a charging electric field), and the electromagnetic wave irradiation device 2 irradiated soft X-rays having a wavelength of about $10^{-10}$ to $10^{-9}$ (m) while moving the photoconductor 1 at a linear velocity of 40 (mm/s).

Also, a good charging result was obtained when X-rays were used in place of the soft X-rays. However, the photoconductor 1 was not charged when ultraviolet rays were used.

In the second embodiment, the grid 3 comprises a beryllium plate. However, when a stainless steel or copper plate having the same thickness as that of the beryllium plate was used, the photoconductor 1 was charged little. Since the material used for the grid 3 need only have a high transmittance of X-rays and conductivity, a conductive plate (see FIG. 7) which comprises one of magnesium (Mg), calcium (Ca), strontium (Sr), barium (Ba), aluminum (Al), carbon, a carbon film, and their compounds or alloys in place of beryllium, or an insulator film 350 (e.g., a resin), the surface of which is coated with a metal film 360, may be used. However, of these materials, beryllium which is excellent in X-ray transmission performance is most suitable. Also, radium is not preferable in terms of safety since it produces radiation. Even when the beryllium plate is used, the thickness of the beryllium plate has a large influence on the charging efficiency with respect to the photoconductor 1. For example, when a 500-$\mu$m thick beryllium plate is used, the charge potential of the photoconductor 1 lowers by about 30%. For this reason, the beryllium plate preferably has a smaller thickness. However, in consideration of the mechanical strength, it is not practical to use a beryllium plate having a thickness less than 20 ($\mu$m).

Embodiment (1-3)

Figure 10:
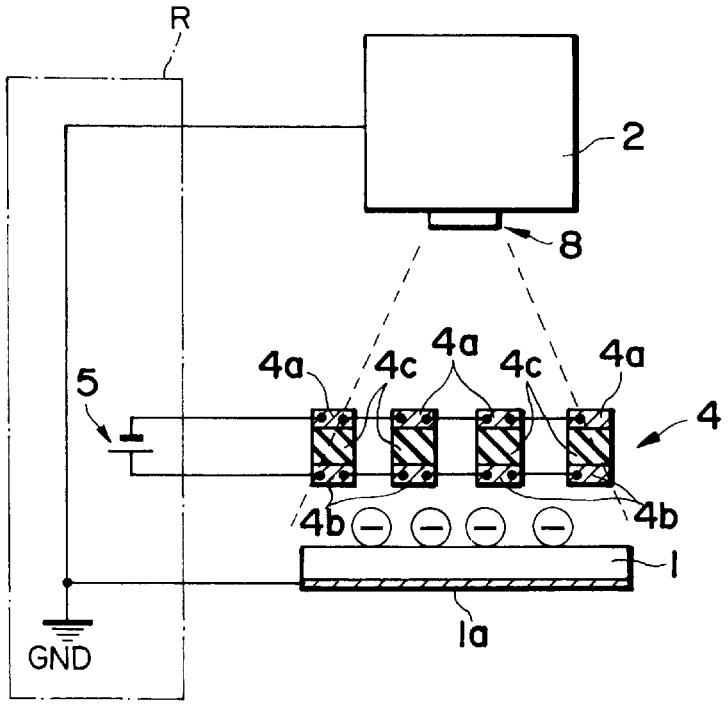
FIG. 10 is a schematic view showing the arrangement of the third embodiment (Embodiment 1-3) of the electrostatic charger according to the present invention.
Figure 11:
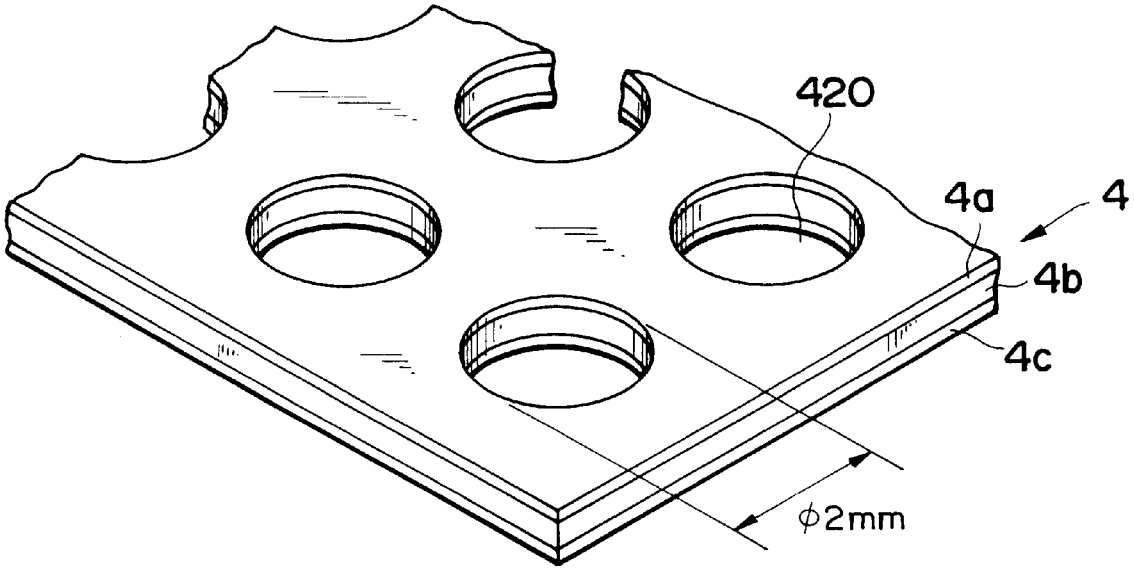
FIG. 11 is a perspective view showing the arrangement of an electrode pair (intermediate electrode device) which can be applied to the charger shown in FIG. 10.
Figure 12:
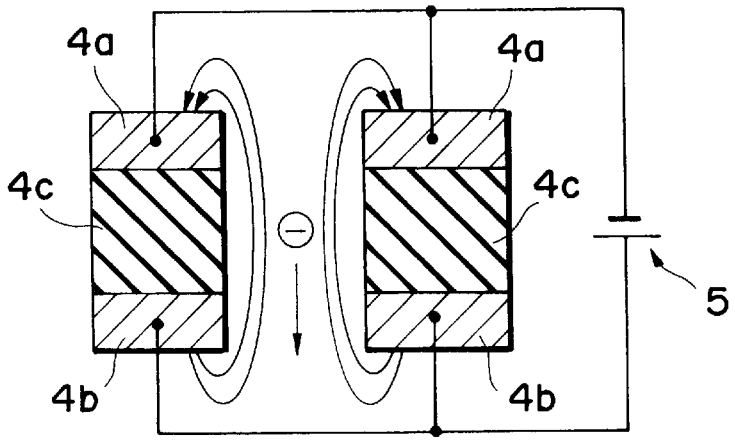
FIG. 12 is a diagram for explaining the function of the electrode pair shown in FIGS. 10 and 11.

The third embodiment of the electrostatic charger according to the present invention will be described below with reference to FIGS. 10 to 12. As shown in FIG. 10, the charger of the third embodiment comprises an electromagnetic wave irradiation device 2 (included in a first electrode device), an electrode pair 4 (included in an intermediate electrode device) arranged between a photoconductor 1 and the electromagnetic wave irradiation device 2, and a DC voltage power supply 5 (included in an electric field forming system). Note that the electromagnetic wave irradiation device 2 and a rear surface electrode 1*a* (included in a second electrode device) of the photoconductor 1 are connected to ground. The electrode pair 4 has a planar shape which has a structure in which first and second electrodes 4*a* and 4*b* are arranged on the two surfaces of an insulator 4*c*, and is formed with a plurality of through holes 420, as shown in FIG. 11. Note that the intermediate electrode device may be constituted by arranging a plurality of electrode pairs 4 parallel to the photoconductor 1. Furthermore, since the DC voltage power supply 5 applies a predetermined voltage across the first and second electrodes 4*a* and 4*b* to produce a potential difference therebetween, an electric field is produced in the space between adjacent ones of a plurality of electrode pairs 4 or in the through holes 420 of the electrode pair. For this reason, ions produced by ionization upon irradiating an electromagnetic wave are accelerated in the space between the adjacent electrode pairs 4 or in the through holes 420, reach the photoconductor 1, and become attached to the major surface of the photoconductor 1 (see FIG. 12).

Note that the electrode pair 4 was prepared in such a manner that 50-$\mu$m thick copper electrodes are formed on the two surfaces of a 2-mm thick bakelite plate, and thereafter, a large number of through holes each having a diameter of 2 (mm) was formed to have an aperture ratio of about 0.6 (see FIG. 11). Furthermore, the DC voltage power supply 5 applies a voltage of 1.5 (kV) across the first and second electrodes 4*a* and 4*b*, so that the potential of the first electrode 4*a* is 0 (V) and that of the second electrode 4*b* is 1.5 (kV). Note that the electrode pair 4 is arranged 1 (mm) above the photoconductor 1, and a soft X-ray irradiation device serving as the electromagnetic wave irradiation device 2 is arranged 5 (mm) above the photoconductor 1.

With the above arrangement, the present inventors confirmed that the photoconductor 1 was charged to a potential of about −500 (V) without producing any ozone, when the X-ray irradiation device irradiated soft X-rays having a wavelength of about $10^{-10}$ to $10^{-9}$ (m) while moving the photoconductor 1 at a linear velocity of 40 (mm/s).

In the arrangement of the third embodiment, charging could be attained using both ultraviolet rays and X-rays, and good results could be obtained in both cases.

Embodiments (1-4) and (1-5)

Figure 13:
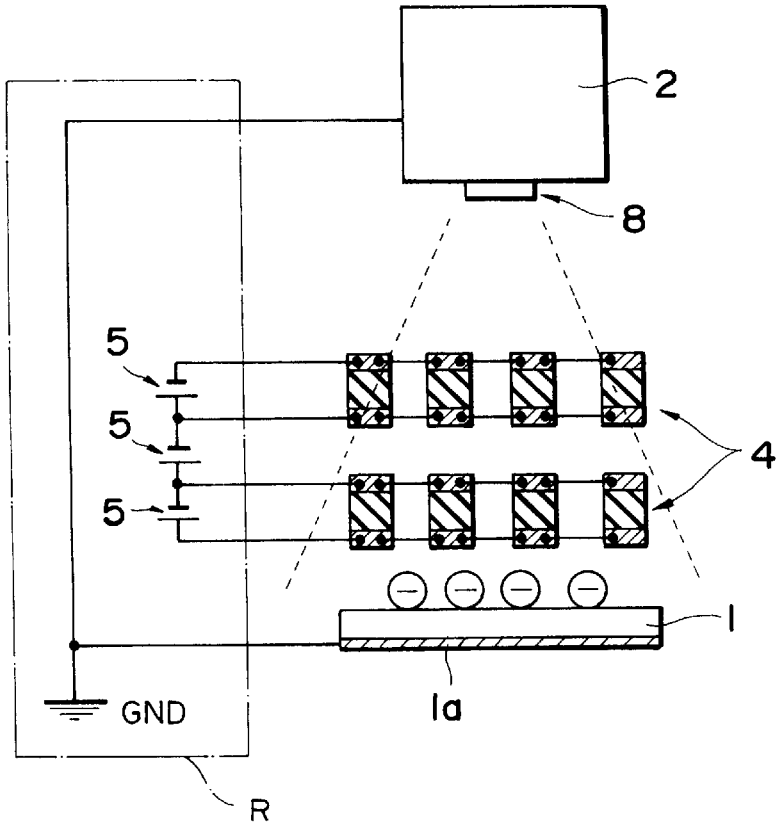
FIG. 13 is a schematic view showing the arrangement of the fourth embodiment (Embodiment 1-4) of the electrostatic charger according to the present invention.
Figure 14:
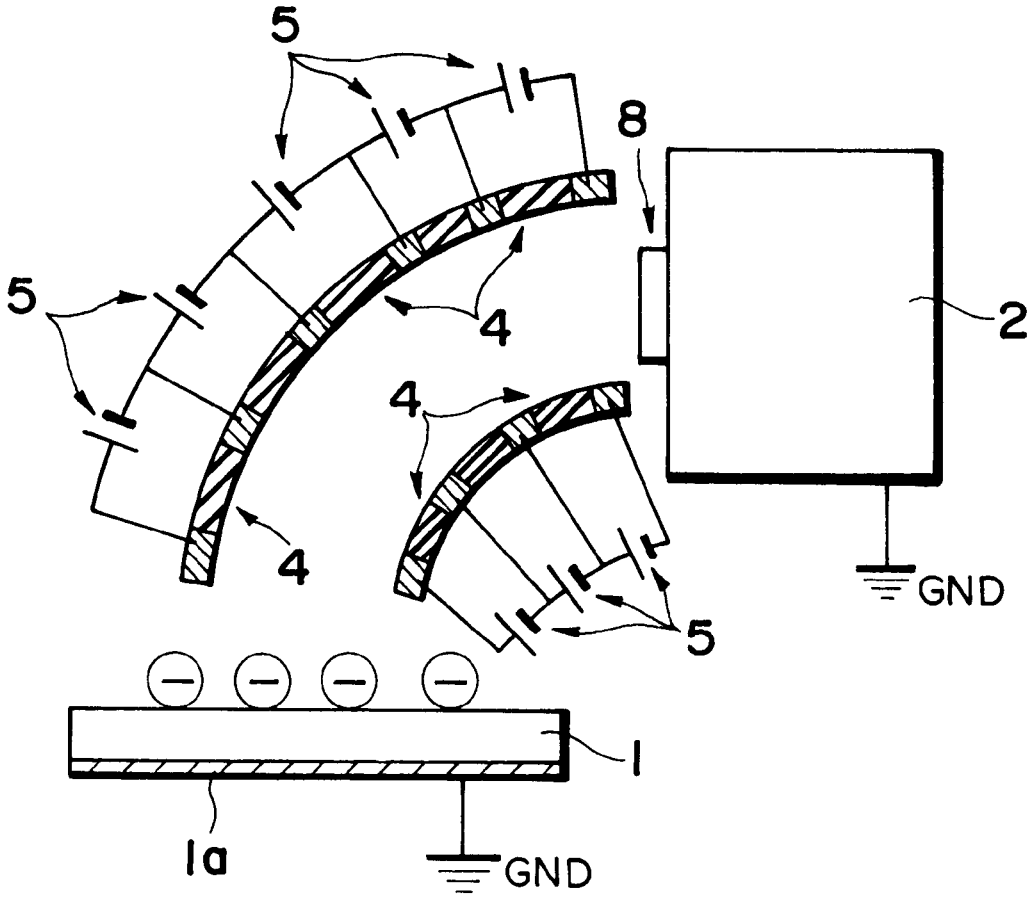
FIG. 14 is a schematic view showing the arrangement of the fifth embodiment (Embodiment 1-5) of the electrostatic charger according to the present invention.

In the electrostatic charger according to the present invention, only one layer of the electrode pair 4 is arranged in the third embodiment. For example, as shown in FIG. 13, the intermediate electrode device may be constituted by stacking two or more layers of electrode pairs 4, and the electromagnetic wave irradiation device 2 may be further separated from the photoconductor 1 (the fourth embodiment). On the other hand, in the electrostatic charger according to the present invention, as shown in FIG. 14, the intermediate electrode device may be constituted by arranging two layers each including a plurality of electrode pairs 4 which are coupled in an arcuated pattern via insulators (the fifth embodiment). According to the fifth embodiment, since the propagation direction of ions produced by ionization upon irradiating an electromagnetic wave can be bent, the irradiation direction of the electromagnetic wave can be shifted, and the degree of freedom in the layout of the electromagnetic wave irradiation device 2 can be improved.

In each electrode pair 4 (intermediate electrode device) shown in FIGS. 10 to 14, the insulator 4*c* between the first and second electrodes 4*a* and 4*b* comprises a resin in each embodiment. Alternatively, air insulation (for example, an air bridge is constituted using an insulating spacer) may be used without arranging any specific insulating member.

As has been described in the first to fifth embodiments (Embodiments 1-1 to 1-5), since the electrostatic charger according to the present invention realizes the non-contact charging process, contamination and deterioration of the apparatus itself can be minimized, and the reliability of charging with respect to the surface of the photoconductor as the member to be charged can be improved. Also, no ozone is produced during the charging process.

In particular, in the electrostatic charger according to the present invention, since the electric field forming system includes the intermediate electrode device (mesh or planar grid electrode or electrode pair) arranged between the electromagnetic wave irradiation device and the photoconductor as the member to be charged, a charging electric field can be easily produced by setting the electrode and the member to be charged at appropriate potentials.

In the electrostatic charger according to the present invention, since the electric field forming system further includes the rear surface electrode (included in the second electrode device) arranged at a position facing the electromagnetic wave irradiation device to sandwich the member to be charged therebetween, a charging electric field can be easily produced by setting the electrode and the electromagnetic wave irradiation device (included in the first electrode device) at appropriate potentials.

Also, in the electrostatic charger according to the present invention, the intermediate electrode device arranged between the electromagnetic wave irradiation device and the member to be charged can comprise at least a layer of electrode pairs, which produce a predetermined potential difference between the electromagnetic wave irradiation device side and the member to be charged side. In this case, a charging electric field can be easily produced, and the degree of freedom in the layout of the electromagnetic wave irradiation device can be increased.

Furthermore, in the electrostatic charger according to the present invention, the intermediate electrode device arranged between the electromagnetic wave irradiation device and the member to be charged can comprise a grid electrode, which comprises a metal mesh or a conductive plate formed with a plurality of through holes at a high density. In this case, the intermediate electrode device can be easily fabricated with low cost.

Embodiment (1-6)

Figure 15:
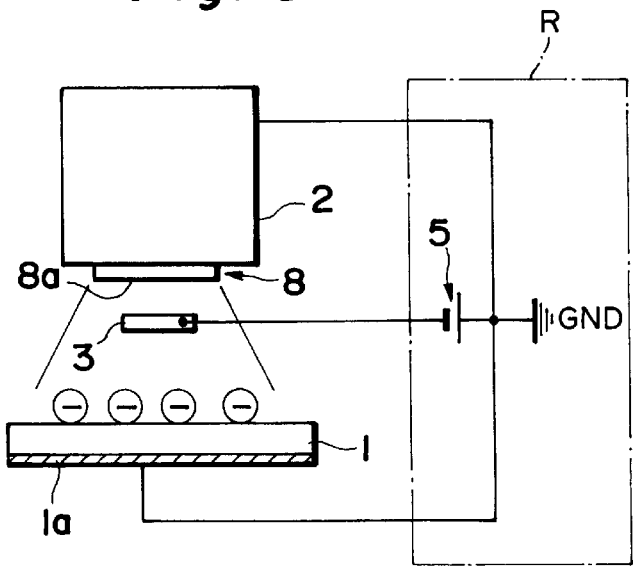
FIG. 15 is a schematic view showing the arrangement of the sixth embodiment (Embodiment 1-6) of the electrostatic charger according to the present invention.

The sixth embodiment of the electrostatic charger according to the present invention will be described below with reference to FIGS. 15 to 18. As shown in FIG. 15, the charger of the sixth embodiment comprises an electromagnetic wave irradiation device 2 (included in a first electrode device), a rear surface electrode 1*a* (included in a second electrode device) formed on the rear surface of a photoconductor 1, a grid electrode 3 (included in an intermediate electrode device) arranged between the photoconductor 1 and the electromagnetic wave irradiation device 2, and a DC voltage power supply 5 (included in an electric field forming system). The rear surface electrode 1*a* and the electromagnetic wave irradiation device 2 are connected to ground. The DC voltage power supply 5 is connected to the grid 3 to apply a negative voltage thereto, thereby producing an electric field in the space above the photoconductor 1. As the photoconductor 1, an organic photoconductor (OPC) which is charged negative is used. In an electromagnetic wave irradiation end 8 (having an electromagnetic wave output end face 8*a*) of the electromagnetic wave irradiation device 2, the diameter of an aperture portion 85 is about 40 (mm), and soft X-rays having a wavelength of about $10^{-10}$ to $10^{-9}$ (m) are irradiated to the space via the electromagnetic wave output end face 8*a*. The grid 3 comprises a metal mesh which comprises stainless steel, and has a size of 20 (mm)× 20 (mm). The line diameter, a, of this stainless steel mesh is 0.1 (mm), its pitch is about 0.8 (mm), and its aperture ratio is about 0.77. Note that the distance between the electromagnetic wave irradiation device 2 and the photoconductor 1 is 6 (mm), and the grid 3 is arranged immediately below the electromagnetic wave irradiation end 8 of the electromagnetic wave irradiation device 2 at a position 3 (mm) from the photoconductor 1.

With the above arrangement, the present inventors confirmed that the photoconductor 1 was uniformly charged to a potential of about −300 (V), when the electric field forming system applied a voltage of −2 (kV) to the grid 3 (production of a charging electric field), and the electromagnetic wave irradiation device 2 irradiated soft X-rays via the electromagnetic wave output end face 8*a* while moving the photoconductor 1 at a linear velocity of 20 (mm/s).

Figure 16:
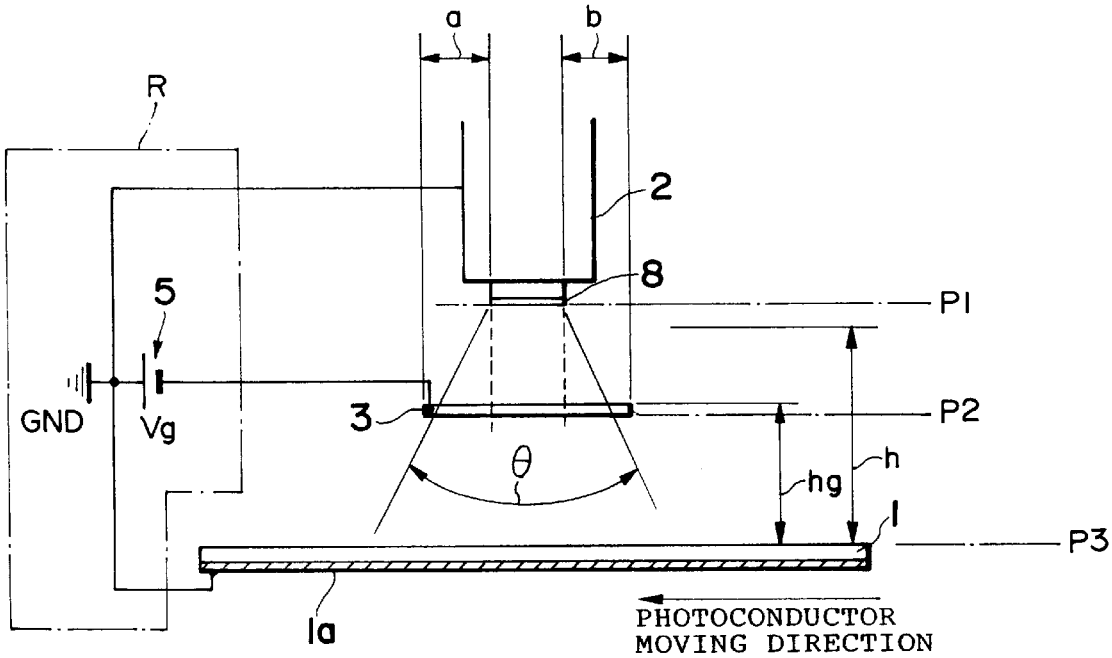
FIG. 16 is a schematic view for explaining the structural relationship among the respective portions of the charger (the sixth embodiment) shown in FIG. 15.

Subsequently, as shown in FIG. 16, the present inventors made similar evaluations by changing the size of the grid 3 (more specifically, the ranges of lengths a and b of portions extending from the portion, facing the edge portion of the electromagnetic wave irradiation end 8, of the grid 3 to the downstream and upstream sides in the moving direction of the photoconductor 1). The table in FIG. 17 summarizes the evaluation results.

Figures 17, 18:
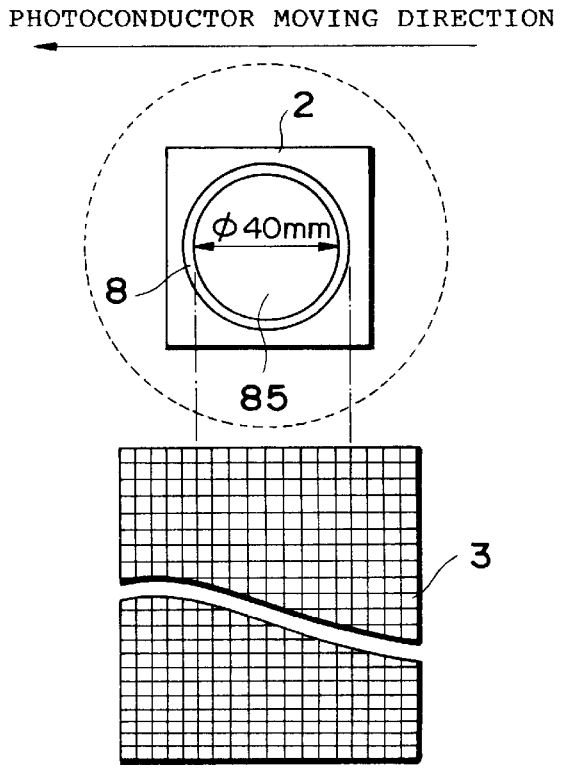
FIG. 17 is a table showing the measurement results of the charge potential on the surface of the member to be charged when the size of the intermediate electrode device (conductive plate) is changed in the arrangement shown in FIG. 16.
FIG. 18 is a view that compares the sizes of the electromagnetic wave output end face of an electromagnetic wave irradiation device, and the intermediate electrode device in the electrostatic charger according to the present invention.

In FIG. 16, when b is fixed to be 0 (mm) and a is changed within the range from −5 to 10 (mm), the charge potential increases with a, and the effect of extending the portion of the grid 3 to the downstream side in the moving direction of the photoconductor 1 is demonstrated (see FIG. 17). When an electromagnetic wave is irradiated in a state without any charging electric field, since ions having a polarity opposite to the charging polarity of the photoconductor 1, of anions and cations produced by ionization are attracted by the photoconductor 1, they adversely influence the charged state of the photoconductor 1. Accordingly, by extending the portion of the grid 3 to the downstream side in the moving direction of the photoconductor 1 like in this embodiment, the charging width (the distance, along the moving direction of the photoconductor 1, of the region on the photoconductor 1, where charges are placed) increases, and contact between the photoconductor 1 and ions having a polarity opposite to the charging polarity of the photoconductor 1 can be avoided in a state wherein no electric field is formed, thereby improving the charging efficiency with respect to the photoconductor 1. When a=10 (mm) or more, the charge potential is saturated, and no effect of extending the portion of the grid 3 along the moving direction of the photoconductor 1 is obtained. This is because no electromagnetic wave is irradiated onto the space of a=10 (mm) or more (they do not reach the space) and, hence, no ionization occurs.

On the other hand, when a is fixed to be 0 (mm) and b is changed within the range from −5 to 10 (mm), the charge potential increases with b, and the effect of extending the portion of the grid 3 to the upstream side along the moving direction of the photoconductor 1 is demonstrated (see FIG. 17). This is because the charging width is increased by extending the portion of the grid 3 to the upstream side along the moving direction of the photoconductor 1. Note that the charge potential is saturated in the space of b=10 (mm) or more, since no electromagnetic wave is irradiated in the space of b=10 (mm) or more (they do not reach the space) and they do not contribute to charging.

Finally, when charging was made while setting a=10 (mm) and b=10 (mm), a charge potential as high as −630 (V) could be obtained. As can be understood from the above description, the charging efficiency can be improved by setting the area of the grid 3 to be larger than that of the aperture portion 85 of the electromagnetic wave irradiation end 8 of the electromagnetic wave irradiation device 2 (see FIG. 18).

When the extended amounts a and b of the grid 3 exceed a given value, they cease to contribute to improvement of the charging efficiency any more. This critical value varies depending on the irradiation distance h of an electromagnetic wave (the distance between the electromagnetic wave irradiation device 2 and the photoconductor 1) and the electromagnetic wave irradiation angle θ, as shown in FIG. 16. In the sixth embodiment, both the a and b have 10 (mm) as a critical value. However, in general, a and b increase with h and θ.

Basically, since it is nonsense to form an electric field outside the electromagnetic wave irradiation region on the photoconductor 1, a and b need not be equal to or larger than h×tan(θ/2). Conversely, when the grid 3 is too large, the apparatus itself becomes bulky. For this reason, a and b are preferably set to be equal to or smaller than h×tan(θ/2).

Note that the charge potential can also be increased by increasing the voltage to be applied to the grid 3. However, in this case, when the application voltage is too high, it causes discharging between the grid 3 and the photoconductor 1 and, consequently, ozone is produced. For this reason, the voltage to be applied to the grid 3 is preferably lower than the discharging limit voltage between the grid 3 and the photoconductor 1. In FIG. 16, P1 represents the plane where the electromagnetic wave output end face 8*a* is set, P2 represents the plane where the grid 3 is set, P3 represents the surface to be charged of the photoconductor 1, and hg represents the distance between the grid 3 and the photoconductor 1.

Embodiment (1-7)

Figure 19:
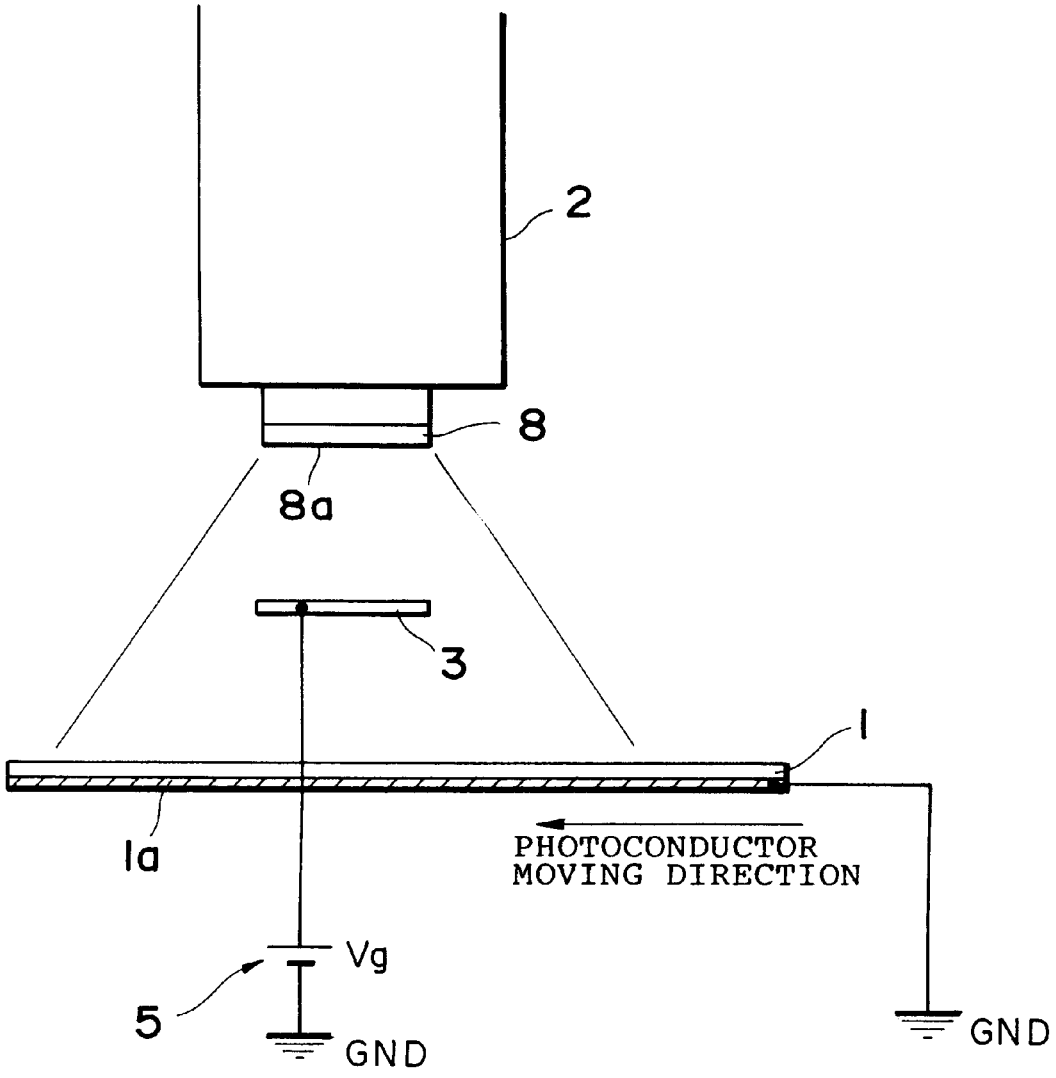
FIG. 19 is a schematic view showing the arrangement of the seventh embodiment (Embodiment 1-7) of the electrostatic charger according to the present invention.

The seventh embodiment of the electrostatic charger according to the present invention will be described below with reference to FIGS. 19 to 22. As shown in FIG. 19, the charger of the seventh embodiment comprises an electromagnetic wave irradiation device 2, a rear surface electrode 1*a* (included in a second electrode device) of a photoconductor 1, a grid electrode 3 (included in an intermediate electrode device) arranged between the photoconductor 1 and the electromagnetic wave irradiation device 2, and a DC voltage power supply 5 (included in an electric field forming system). Note that the rear surface electrode 1*a* of the photoconductor 1 is connected to ground. Also, the DC voltage power supply 5 is connected to the grid 3 and applies a positive voltage thereto, thereby producing a desired electric field in the space above the photoconductor 1. The photoconductor 1 comprises an Se photoconductor which is charged positive. In an electromagnetic wave irradiation end 8 (having an electromagnetic wave output end face 8*a*) of the electromagnetic wave irradiation device 2, the diameter of an aperture portion 80 is about 40 (mm), and soft X-rays having a wavelength of about $10^{-10}$ to $10^{-9}$ (m) are irradiated to the space via the electromagnetic wave output end face 8*a*. The grid 3 comprises a beryllium (Be) plate which has a thickness of 100 (μm) and a size of 40 (mm)×40 (mm). The distance between the electromagnetic wave irradiation device 2 and the photoconductor 1 is 6 (mm), and the grid 3 is arranged immediately below the electromagnetic wave irradiation end 8 to be separated by 3 (mm) from the photoconductor 1.

With the above arrangement, the present inventors found out that the photoconductor 1 was uniformly charged to a potential of about 450 (V), when the DC voltage power supply 5 applied a voltage Vg of 2 (kV) to the grid 3 (production of a charging electric field), and X-rays were irradiated while moving the photoconductor 1 at a linear velocity of 100 (mm/s).

Note that the arrangement of this embodiment can use X-rays in place of soft X-rays. Even when X-rays are used, uniform charging equivalent to that attained by soft X-rays can be attained. However, soft X-rays are preferably used in terms of safety.

Figure 20:
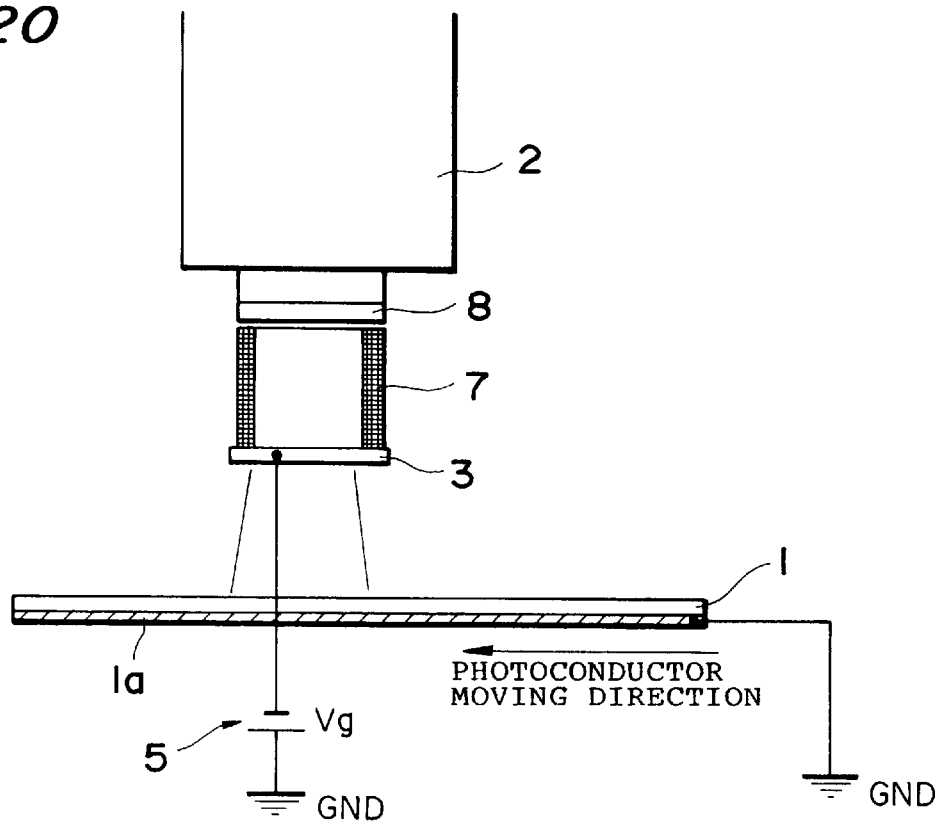
FIG. 20 is a schematic view showing the arrangement of the first application example of the charger (the seventh embodiment) shown in FIG. 19.

Next, when a vinyl chloride resin slit 7 (a member for limiting the electromagnetic wave irradiation region where the electromagnetic wave from the electromagnetic wave irradiation device reaches) which has a thickness of 3 (mm) and a central hole with a diameter of 35 (mm) was inserted between the grid 3 and the electromagnetic wave irradiation device 2 as in the arrangement (the first application example of the seventh embodiment) shown in FIG. 20, the charging efficiency was improved by about 15(%). This is because the slit 7 narrows the electromagnetic wave irradiation region (the region where the electromagnetic wave from the electromagnetic wave irradiation device reaches) to prevent ionization in a space where no charging electric field is formed. Since the material of the slit 7 need only have a low transmittance with respect to the electromagnetic wave, it is not limited to the resin material used in this embodiment but may be a metal material such as copper, iron, or the like. However, when the grid 3 and the electromagnetic wave irradiation device 2 must be electrically isolated from each other, a resin material, a rubber material, glass, or ceramics are more preferable.

Note that the charging efficiency with respect to the photoconductor 1 can be further improved by decreasing the surface roughness of the side surface of the hole formed in the slit 7, which surface is irradiated with the electromagnetic wave from the electromagnetic irradiation device 2, since the reflection efficiency of electromagnetic wave on this side surface is improved. In this sense, the above-mentioned side surface of the slit 7 is preferably a mirror surface.

Figure 21:
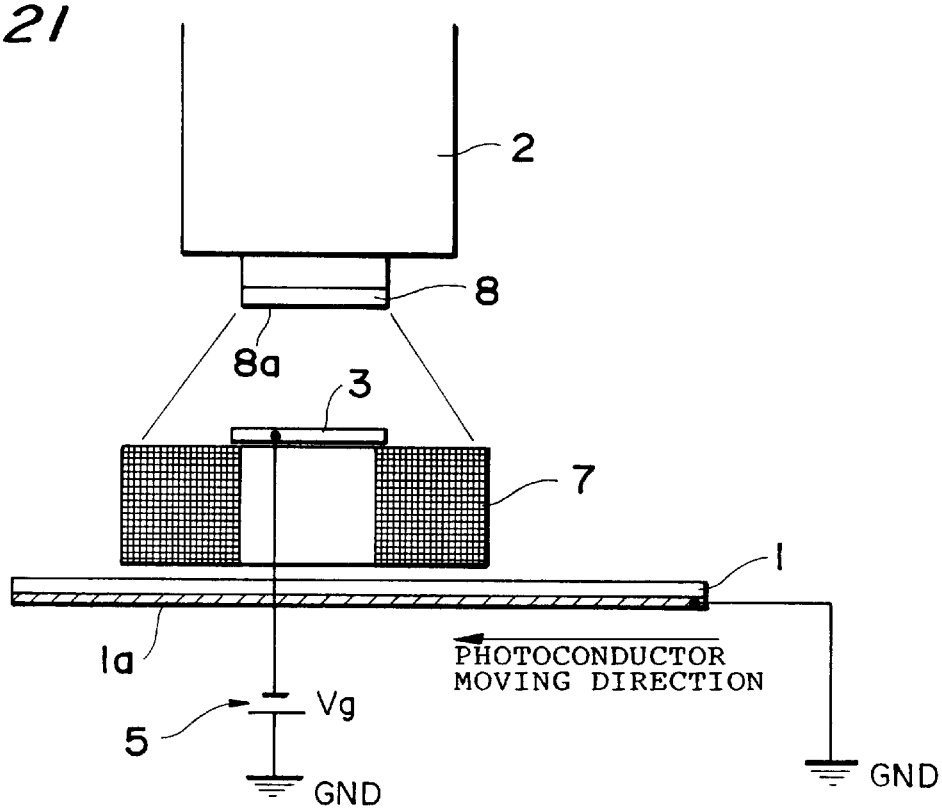
FIG. 21 is a schematic view showing the arrangement of the second application example of the charger (the seventh embodiment) shown in FIG. 19.
Figure 22:
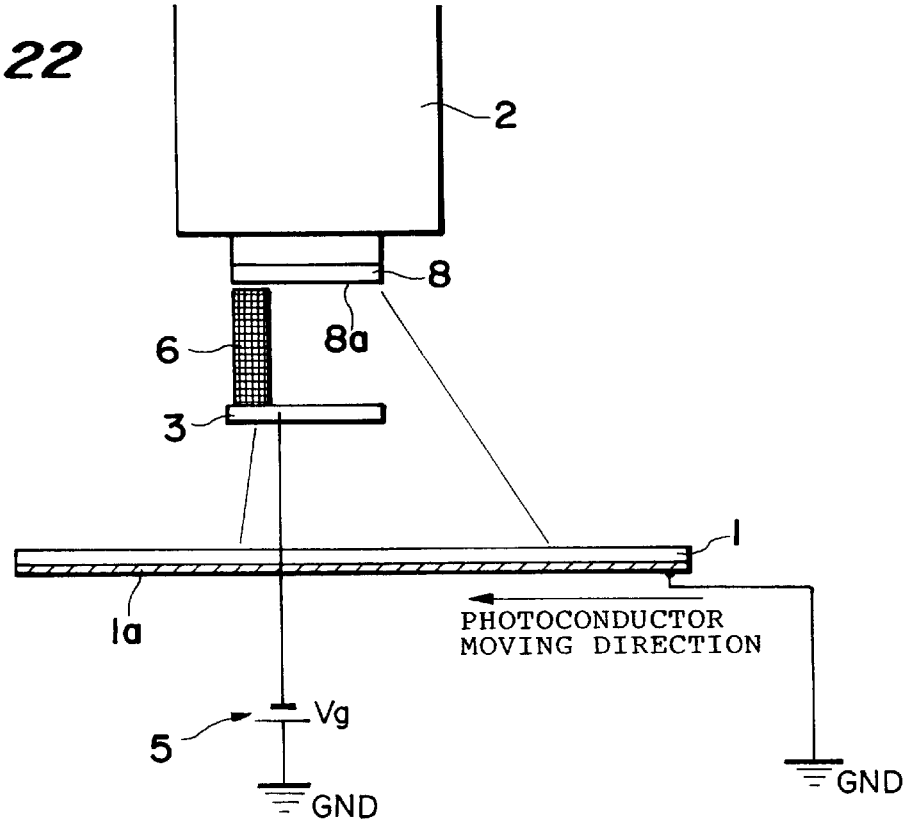
FIG. 22 is a schematic view showing the arrangement of the third application example of the charger (the seventh embodiment) shown in FIG. 19.

On the other hand, the insertion position of the slit 7 may be that between the grid 3 and the photoconductor 1 as in the arrangement (the second application example of the seventh embodiment) shown in FIG. 21. Furthermore, the shape of the slit 7 is not limited to a planar shape formed with a through hole (round hole or square hole) extending from the electromagnetic wave irradiation device 2 to the photoconductor 1. For example, the same effect as described above may be obtained by inserting a barrier member 6 serving as the above-mentioned limiting member between the grid 3 and the electromagnetic wave irradiation device 2 as in the arrangement (the third application example of the seventh embodiment) shown in FIG. 22, so as to prevent an electromagnetic wave from being irradiated onto the range from the region to be charged toward the downstream side in the moving direction of the photoconductor 1.

Embodiment (1-8)

Figure 23:
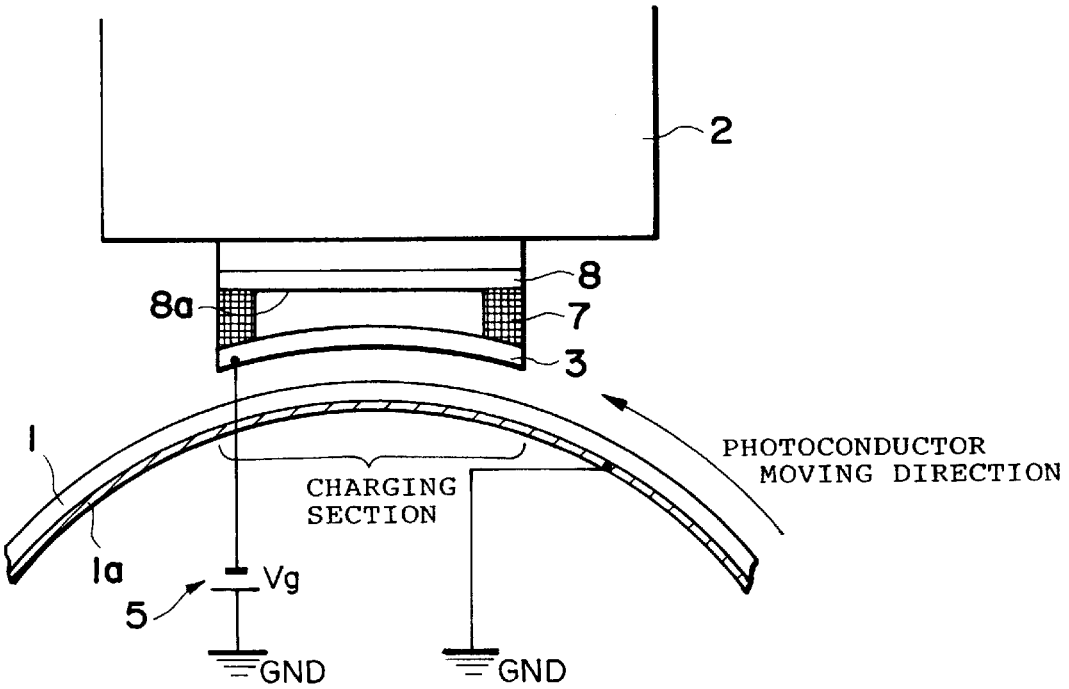
FIG. 23 is a schematic view showing the arrangement of the eighth embodiment (Embodiment 1-8) of the electrostatic charger according to the present invention.

The eighth embodiment of the electrostatic charger according to the present invention will be described below with reference to FIG. 23. As shown in FIG. 23, the charger of the eighth embodiment comprises an electromagnetic wave irradiation device 2, a rear surface electrode 1*a* (included in a second electrode device) of a photoconductor 1, a grid electrode 3 (included in an intermediate electrode device) arranged between the photoconductor 1 and the electromagnetic wave irradiation device 2, a slit 7 serving as a limiting member for limiting the electromagnetic wave irradiation region, and a DC voltage power supply 5 (included in an electric field forming system). Note that the rear surface electrode 1*a* of the photoconductor 1 is connected to ground. Also, the DC voltage power supply 5 is connected to the grid 3 and applies a negative voltage Vg thereto, thereby producing a desired electric field in the space above the photoconductor 1.

Furthermore, in the eighth embodiment, the photoconductor 1 comprises an OPC photoconductor which has a cylindrical shape having a diameter of 40 (mm) and is charged negative. In order to obtain a charging width of 20 (mm), the slit 7 having a central square hole having a width of 20 (mm) is fixed to an electromagnetic wave irradiation end 8 of the electromagnetic wave irradiation device 2, as shown in FIG. 23. That portion, on the photoconductor side, of the slit 7 is worked to have a curvature nearly equal to that of the photoconductor 1, and a stainless steel mesh serving as the grid 3 is attached to the worked surface. With this structure, the gap between the grid 3 and the photoconductor 1 can be constantly set to be 3 (mm) in the charging section. Note that the distance between the photoconductor 1 and the electromagnetic wave irradiation end 8 is 6 (mm).

With the above arrangement, the present inventors detected that the photoconductor 1 was charged to a potential of about −450 (V), when the DC voltage power supply 5 applied a voltage Vg of −2 (kV) to the grid 3 (production of a charging electric field), and the electromagnetic wave irradiation device 2 irradiated soft X-rays having a wavelength of about $10^{-10}$ to $10^{-9}$ (m) while moving the photoconductor 1 at a linear velocity of 20 (mm/s). In order to demonstrate the effect of using the curved grid 3, a flat grid was arranged 3 (mm) above the photoconductor 1, and the same experiment was conducted. As a result, the charge potential on the photoconductor 1 was about −400 (V). In order to increase the charge potential, the gap between the grid 3 and the photoconductor 1 may be narrowed from the upstream to downstream side of the charging section. However, to form an effective field at the same grid voltage, it is best to set the grid 3 and the photoconductor 1 to have roughly equal curvatures, so that they extend substantially parallel to each other. The effect of setting the grid 3 and the photoconductor 1 to have the same curvature becomes more remarkable as the diameter of the photoconductor 1 (photosensitive drum) becomes smaller. In this way, the technique for curving the grid 3 is expected to become more significant as an image forming apparatus using the electrophotography technique is made more compact.

As has been described in the sixth to eighth embodiments (Embodiments 1-6 to 1-8), in the electrostatic charger according to the present invention, since the electric field forming system has the intermediate electrode device arranged between the electromagnetic wave irradiation device and the member to be charged, the major surface of the member to be charged can be charged in a non-contact manner. Since the non-contact charging system is realized, contamination and deterioration of the apparatus itself can be minimized, the charging reliability can be improved, and no ozone is produced. Furthermore, when that portion of the intermediate electrode device located beneath the electromagnetic wave irradiation device extends to at least one of the upstream and downstream sides along the moving direction of the member to be changed, the charging region on the photoconductor can be broadened, and no electromagnetic wave is irradiated onto the member to be charged after the charging process. With this structure, the charge potential does not drop, and the charging efficiency with respect to the member to be charged can be improved.

The electrostatic charger according to the present invention may comprise a limiting member for limiting the region (electromagnetic wave irradiation region) where the electromagnetic wave from the electromagnetic wave irradiation device reaches at least at a position between the electromagnetic wave irradiation device and the intermediate electrode device or a position between the intermediate electrode device and the member to be charged. With this arrangement, since the electromagnetic wave is irradiated onto only the region corresponding to the charging electric field produced above the member to be charged, the charging efficiency with respect to the member to be charged can be further improved.

Furthermore, in the electrostatic charger according to the present invention, when the member to be charged has a predetermined curvature (for example, when the surface of a photosensitive drum is to be charged), the intermediate electrode device arranged between the electromagnetic wave irradiation device and the member to be charged is shaped to have a required curvature, so that the intermediate electrode device becomes substantially parallel to the member to be charged. With this structure, a charging electric field can be efficiently formed, and the charging efficiency with respect to the member to be charged can be improved.

Figure 24:
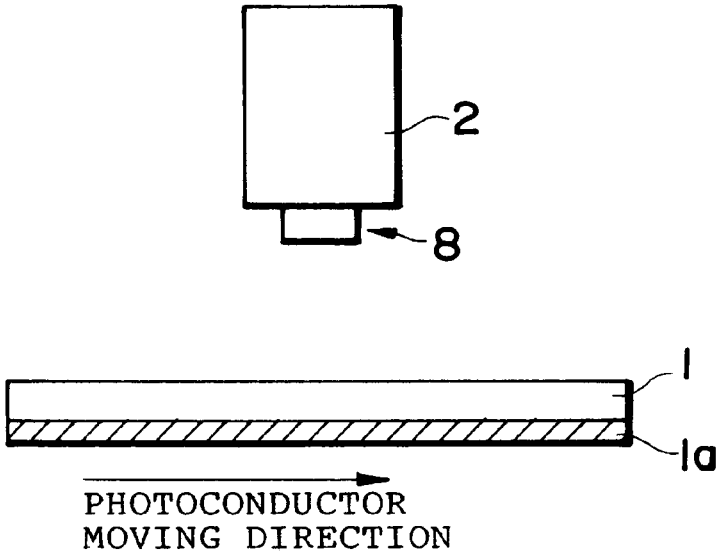
FIG. 24 is a schematic view showing the basic arrangement of an electrostatic charger according to the present invention.

Recapitulating again, FIG. 24 is a schematic view showing an example of the basic arrangement of the electrostatic charger according to the present invention. As described above, the charging apparatus comprises, as its basic arrangement, an electromagnetic wave irradiation device 2, a counter electrode 1*a* (rear surface electrode) arranged at a position facing the electromagnetic wave irradiation device 2 to sandwich a photoconductor 1 as the member to be charged therebetween, and an electric field forming system for producing a desired electric field between the electromagnetic wave irradiation device 2 and the photoconductor 1. The photoconductor 1 moves in the direction of an arrow in FIG. 24. The movement of the photoconductor 1 is attained by the mechanism shown in FIGS. 4 and 5, as described above.

Figure 25:
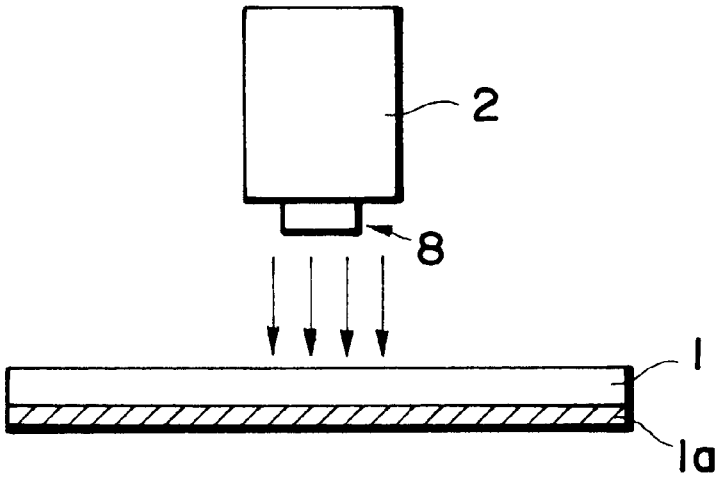
FIG. 25 is a schematic view for explaining the direction of an electric field used when the surface of the member to be charged is charged positive in the charging process of the charger (basic arrangement) shown in FIG. 24.
Figure 26:
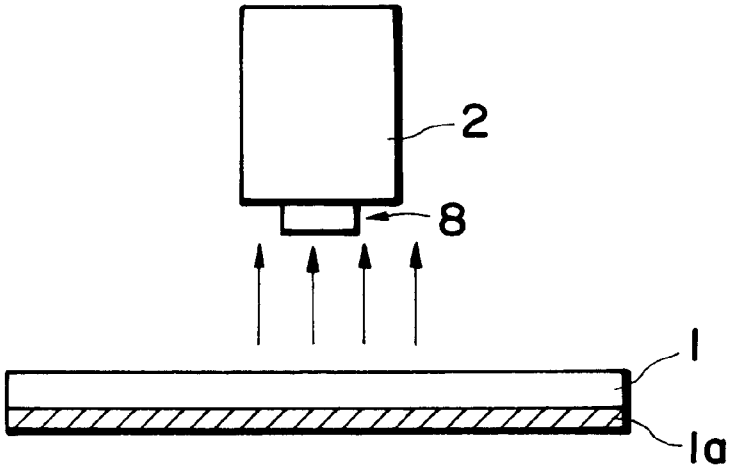
FIG. 26 is a schematic view for explaining the direction of an electric field used when the surface of the member to be charged is charged negative in the charging process of the charger (basic arrangement) shown in FIG. 24.

When an electromagnetic wave is irradiated from the electromagnetic wave irradiation device 2, ionization occurs in a space where the electromagnetic wave has reached, and anions and cations are produced. When the surface of the photoconductor 1 is to be charged to a charge potential Vs, if Vs is positive, the electric field must be directed from the electromagnetic wave irradiation device 2 toward the photoconductor 1, as shown in FIG. 25; if Vs is negative, the electric field must be directed from the photoconductor 1 toward the electromagnetic wave irradiation device 2, as shown in FIG. 26.

Embodiment (1-9)

Figure 27:
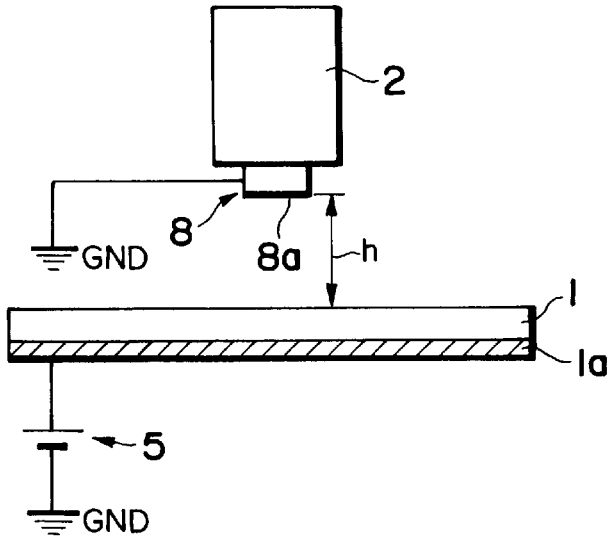
FIG. 27 is a schematic view showing the arrangement of the ninth embodiment (Embodiment 1-9) of the electrostatic charger according to the present invention.

Therefore, for example, when Vs is negative, the electric field forming system connects the DC voltage power supply 5 to the counter electrode 1*a* as in the arrangement (the ninth embodiment) shown in FIG. 27, and applies a positive voltage, which has a polarity opposite to that of Vs and has an absolute value larger than that of Vs, to the counter electrode 1*a*, thereby connecting, to ground, the electromagnetic wave irradiation end 8 (serving as a first electrode device), which has the surface (an electromagnetic wave output end face 8*a*), facing the photoconductor 1, of the electromagnetic wave irradiation device 2 (included in the first electrode device). With this arrangement, an electric field is produced between the electromagnetic wave irradiation device 2 and the photoconductor 1, as shown in FIG. 26, and cations of ions ionized by electromagnetic wave irradiation move toward the surface (the surface to be charged) of the photoconductor 1. In this arrangement, since a bias voltage is applied to the counter electrode 1*a,* exposure, development, and transfer processes as post-processes of charging in the electrophotography process may be complicated. However, the arrangement of the electromagnetic wave irradiation device 2 can be simplified since its case need only be connected to ground.

Embodiment (1-10)

Figure 28:
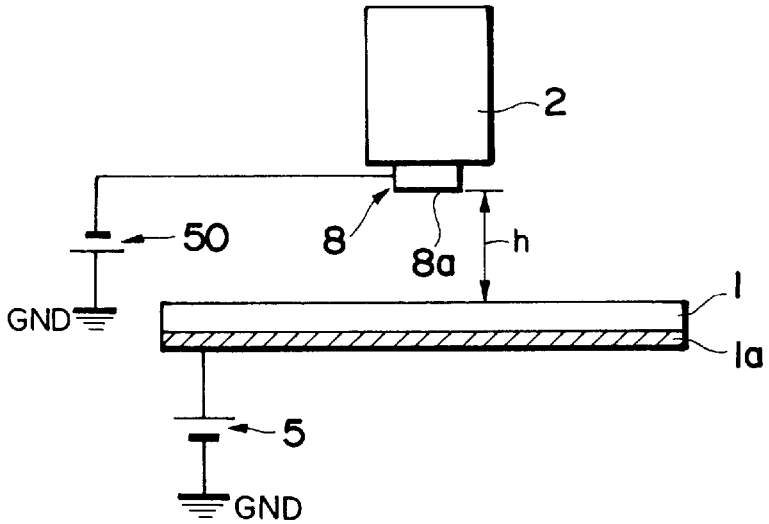
FIG. 28 is a schematic view showing the arrangement of the 10th embodiment (Embodiment 1-10) of the electrostatic charger according to the present invention.

As in the arrangement (the 10th embodiment) shown in FIG. 28, in addition to the arrangement (the ninth embodiment) shown in FIG. 27, a DC voltage power supply 50 may be connected to the electromagnetic wave irradiation end 8 (serving as an electrode device), which has the surface (the electromagnetic wave output end face 8*a*), facing the photoconductor 1, of the electromagnetic wave irradiation device 2, and a negative bias voltage may be applied to the electromagnetic wave irradiation end 8. In this case, although two power supplies are required and the sum of voltages of the two power supplies must exceed the absolute value of Vs, the strength of the electric field applied to the gap can be increased, and ions can efficiently move toward the surface to be charged of the photoconductor 1. If the strength of the electric field remains the same, the bias voltage to be applied to the counter electrode 1*a* can be decreased, and the load on exposure, development, transfer processes, and the like as the post-processes of charging in the electrophotography process can be reduced.

Embodiment (1-11)

Figure 29:
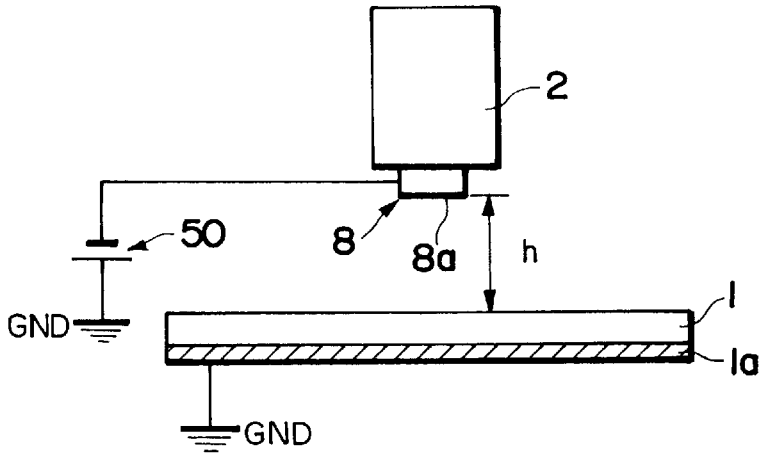
FIG. 29 is a schematic view showing the arrangement of the 11th embodiment (Embodiment 1-11) of the electrostatic charger according to the present invention.

In the arrangement (the 11th embodiment) shown in FIG. 29, the counter electrode 1*a* is connected to ground, the DC voltage power supply 50 is connected to the electromagnetic wave irradiation end 8 (serving as an electrode device), which has the surface (the electromagnetic wave output end face 8*a*), facing the photoconductor 1, of the electromagnetic wave irradiation device 2, and a negative bias voltage is applied to the electromagnetic wave irradiation end 8. In this case, since the potential of the counter electrode 1*a* is 0 V, it conveniently has no influence on exposure, development, transfer processes, and the like as the post-processes of charging in the electrophotography process. Although a higher voltage must be applied to the electromagnetic wave irradiation end 8, as compared to the arrangement (the 10th embodiment) shown in FIG. 28, only one power supply is required.

Embodiment (1-12) to Embodiment (1-14)

In the case of the arrangements (the ninth and 11th embodiments) shown in FIGS. 27 and 29, a power supply that can generate a voltage higher than Vs with respect to a required charge potential Vs is required. In the arrangement (the 10th embodiment) shown in FIG. 28, the power supplies 5 and 50 need not always generate voltages having an absolute value larger than that of Vs. In the arrangements of the ninth and 11th embodiments, since a bias voltage is applied to the electromagnetic wave irradiation end 8 located on the photoconductor side of the electromagnetic wave irradiation device 2, the electromagnetic wave irradiation end 8 and the entire electromagnetic wave irradiation device 2 must be insulated. If they are not insulated, the device has a net potential with respect to the ground, which adversely influences electromagnetic wave irradiation. Also, such device is dangerous in case a person touches it.

In the arrangements (the ninth to 11th embodiments) shown in FIGS. 27 to 29, when discharging has occurred in the gap between the electromagnetic wave irradiation device 2 and the photoconductor 1, charging nonuniformity appears on the photoconductor 1, resulting in image deterioration. Also, ozone is produced by discharging. Since ozone deteriorates the photoconductor 1 or its peripheral members and is harmful to the human body, discharging should be avoided. If h represents the gap width between the electromagnetic wave irradiation device 2 and the photoconductor 1, an insulating breakdown voltage Vt (a voltage that causes discharging between the electromagnetic wave irradiation device 2 and the photoconductor 1) is given by the equation below according to the Paschen's law when the gap width h is equal to or smaller than 100 ($\mu$m):

$$Vt=312+6.2\times10^{6}\cdot h$$

On the other hand, when the gap width h exceeds 100 ($\mu$m), the insulating breakdown voltage Vt is given by:

$$Vt=24.05\cdot\delta\cdot h(1+0.328/(\delta^{1/2}\cdot h^{1/2}))$$

where $\delta$ is the relative density of air, h being in (m), and Vt being in (v).

If $\Delta V$ represents the potential difference between the photoconductor 1 and the electromagnetic wave irradiation device 2, discharging occurs when the following relation holds:

$$\Delta V>Vt$$

For this reason, in order to prevent discharging, $\Delta V$ must be equal to or lower than the insulating breakdown voltage Vt which is determined by the gap width h.

Figure 30:
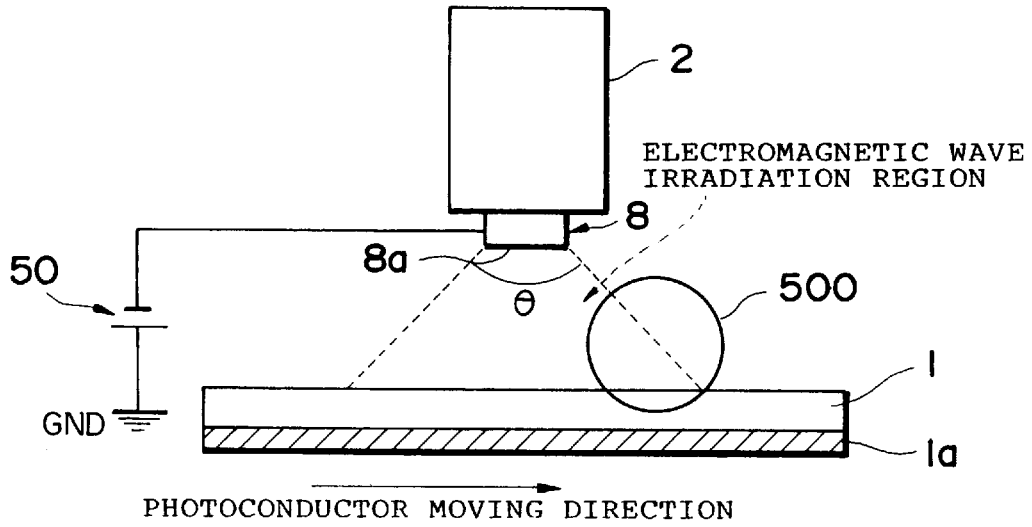
FIG. 30 is a schematic view for explaining the electromagnetic wave irradiated region of the electrostatic charger according to the present invention.

A trapezoidal electromagnetic wave irradiation region (a region where the electromagnetic wave from the electromagnetic wave irradiation device 2 reaches) below the electromagnetic wave irradiation device 2 will be explained below with reference to FIG. 30. As shown in FIG. 30, when the electromagnetic wave output end face 8*a* of the electromagnetic wave irradiation device 2 is smaller than the electromagnetic wave irradiation region, the charging electric field formed by the electric field forming system weakens in a region (a region indicated by 500 in FIG. 30) on the downstream side, in the moving direction of the photoconductor 1 in the electromagnetic wave irradiation region. For this reason, even when the photoconductor 1 is charged immediately below the electromagnetic wave irradiation device 2, the charge is removed on its downstream side, and a charge potential drop occurs. It is surmised that such phenomenon occurs since the electric field on the downstream side in the moving direction of the photoconductor 1 is weaker than that immediately below the electromagnetic wave irradiation device 2. In view of this problem, as in the arrangement (the 12th embodiment) shown in FIG. 31, an electrode (a downstream electrode) 60 must be arranged on the downstream side, in the moving direction of the photoconductor 1, of the electromagnetic wave output end face 8*a* of the electromagnetic wave irradiation device 2 to produce an electric field equivalent to that produced immediately below the electromagnetic wave irradiation device 2 on the downstream side. Let h be the distance between the electromagnetic wave irradiation device 2 and the photoconductor 1, and θ be the electromagnetic wave irradiation angle. Then, if the width, L, along the moving direction of the photoconductor 1, of the downstream electrode 60 satisfies:

$$L > h \cdot \tan(\theta/2) \quad (1)$$

a sufficiently high electric field strength can be obtained even at the downstream side.

Figure 31:
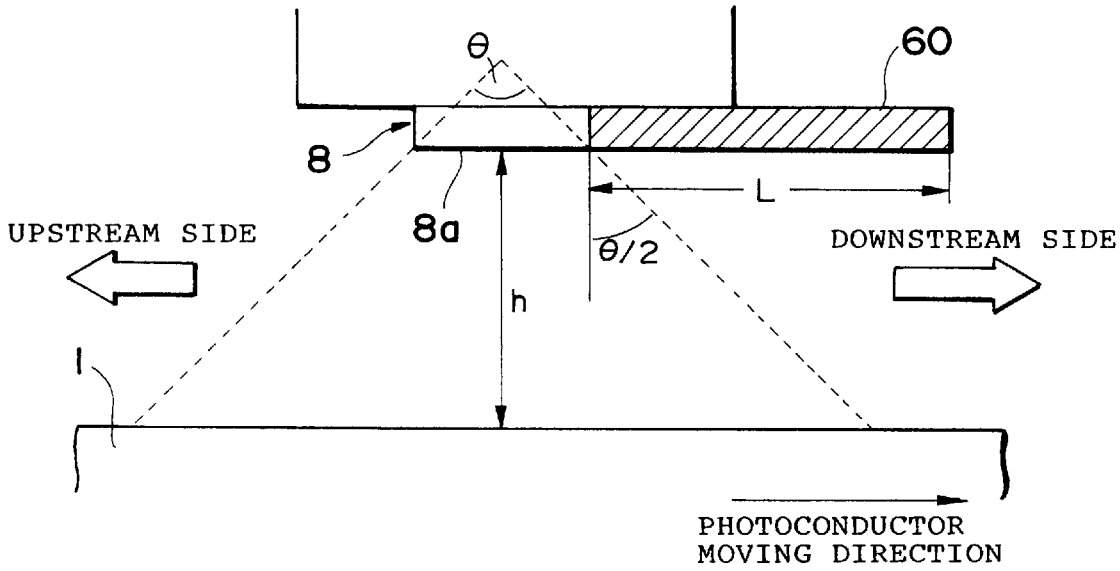
FIG. 31 is a schematic view showing the arrangement of the 12th embodiment (Embodiment 1-12) of the electrostatic charger according to the present invention.

In the arrangement (the 12th embodiment) shown in FIG. 31, the electrode 60 is added to the electromagnetic wave output end face 8*a* of the electromagnetic wave irradiation device 2. Alternatively, as in the arrangement (the first application example of the 12th embodiment) shown in FIG. 32, an edge portion 70 of the electromagnetic wave irradiation end 8 of the electromagnetic wave irradiation device 2 may be extended along the moving direction of the photoconductor 1 in place of adding the electrode 60. Note that the edge portion 70 must have at least a length L from an aperture portion 85 of the electromagnetic wave irradiation end 8 to the downstream side along the moving direction of the photoconductor 1, and the L must satisfy relation (1) above.

The bias to be applied to the electrode 60 must be equal to or lower than the insulating breakdown voltage Vt determined by the gap width h between the electromagnetic wave irradiation device 2 and the photoconductor 1, needless to say. In the electrostatic charger according to the present invention, since the electrode 60 is arranged outside the electromagnetic wave irradiation region to form a charging electric field, the electrode 60 need not be transparent with respect to the electromagnetic wave and, hence, the range of choice of the material for the electrode 60 is broadened. Rather, the electrode 60 preferably comprises a material that can easily absorb an electromagnetic wave to prevent an electromagnetic wave from leaking outside the apparatus (the electrode 60 serves as an electromagnetic wave shield member).

Figures 32, 33, 34:
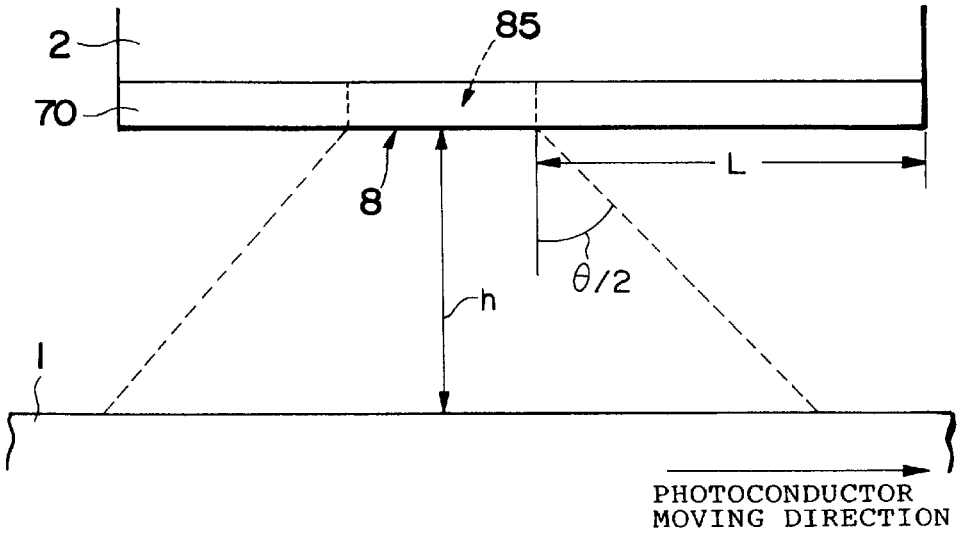
FIG. 32 is a schematic view showing the arrangement of the first application example of the charger apparatus (the 12th embodiment) shown in FIG. 31.
FIG. 33 is a table showing the measurement results of the charge potential on the surface of the member to be charged when an electrode width L is changed in the arrangement (the 12th embodiment) shown in FIG. 31.
FIG. 34 is a table showing the measurement results of the charge potential on the surface of the member to be charged when the moving velocity of the member to be charged (photoconductor) is changed in the arrangement (the 12th embodiment) shown in FIG. 31.

The table shown in FIG. 33 summarizes the results of experiments conducted under the conditions that a polyethylene terephthalate sheet, on one surface of which aluminum was deposited, was used as the photoconductor 1, and a soft X-ray source was used as the electromagnetic wave irradiation device 2 in the arrangement (the 12th embodiment) shown in FIG. 31. More specifically, the average energy of soft X-rays is 6 (keV), and their irradiation angle θ is 110°. The polyethylene terephthalate sheet is set so that its aluminum-deposited surface is applied with a voltage of +1 (kV), and its sheet surface (the surface to be charged facing the aluminum-deposited surface) faces the electromagnetic wave irradiation device 2. Furthermore, an aluminum downstream electrode 60 is arranged on the downstream side, in the moving direction of the photoconductor, of the electromagnetic wave irradiation end 8 of the electromagnetic wave irradiation device 2, and the electromagnetic wave irradiation device 2 and the downstream electrode 60 are respectively connected to ground. The distance h between the electromagnetic wave irradiation device 2 and the photoconductor 1 is 10 (mm), and the diameter of the aperture portion 85 of the electromagnetic wave irradiation end 8 is 12 (mm).

The table shown in FIG. 33 summarizes the results obtained when the charging process was executed using a plurality of downstream electrodes 60 having different widths L by moving the photoconductor 1 at a linear velocity of 4 (mm/s) while irradiating the electromagnetic wave from the electromagnetic wave irradiation device 2, and the charge potential on the photoconductor 1 was measured.

According to relation (1) above, if L>14 (mm) a sufficiently high charge potential can be obtained. On the other hand, the experimental results (FIG. 33) reveal that, if L=15 (mm) or more, a constant charge potential of about −650 (V) can be obtained.

The above description has been made with reference to the region on the downstream side, in the moving direction of the photoconductor, of the electromagnetic wave irradiation end 8 of the electromagnetic wave irradiation device 2. However, when the linear velocity of the photoconductor 1 increases above a certain level, the charging performance cannot follow it, and a sufficiently high charge potential cannot be obtained. FIG. 34 is a table showing the relationship between the moving velocity of the photoconductor 1 and the charge potential in the above-mentioned arrangement. Note that the table in FIG. 34 shows the experimental results obtained under substantially the same conditions as that in FIG. 33 above, except that the width L of the downstream electrode 60 was fixed at 20 (mm).

As can be seen from the experimental results in the table shown in FIG. 34, as the moving velocity of the photoconductor 1 becomes higher, the charge potential becomes lower. As the causes of such potential drop, too high a moving velocity of the photoconductor 1 that a part of the ions produced by the electromagnetic wave cannot reach the photoconductor 1, too weak an attraction force of charges toward the photoconductor 1, and so on can be enumerated. In this case, the following measures may be taken: the electric field strength between the electromagnetic wave irradiation device 2 and the photoconductor 1 may be increased, the electromagnetic wave intensity may be increased, and so on. In addition, an arrangement in which an electrode (upstream electrode) 80 is also arranged on the upstream side along the moving direction of the photoconductor (at a position facing the downstream electrode 60 to sandwich the electromagnetic wave irradiation end 8 therebetween) is available. More specifically, as in the arrangement (the second application example of the 12th embodiment) shown in FIG. 35, when the upstream and downstream electrodes 80 and 60 are arranged to sandwich the electromagnetic wave irradiation end 8 therebetween, ions produced on the upstream side are also attracted by the photoconductor 1, thus improving the charging efficiency. As described above, in the charger of the 12th embodiment (FIG. 31), which comprises only the downstream electrode 60, ions produced on the upstream side are not effectively used. As is apparent from the above description, the arrangement shown in FIG. 35 can improve the charging efficiency more than that shown in FIG. 31. These electrodes 60 and 80 are included in the first electrode device.

Figures 35, 36:
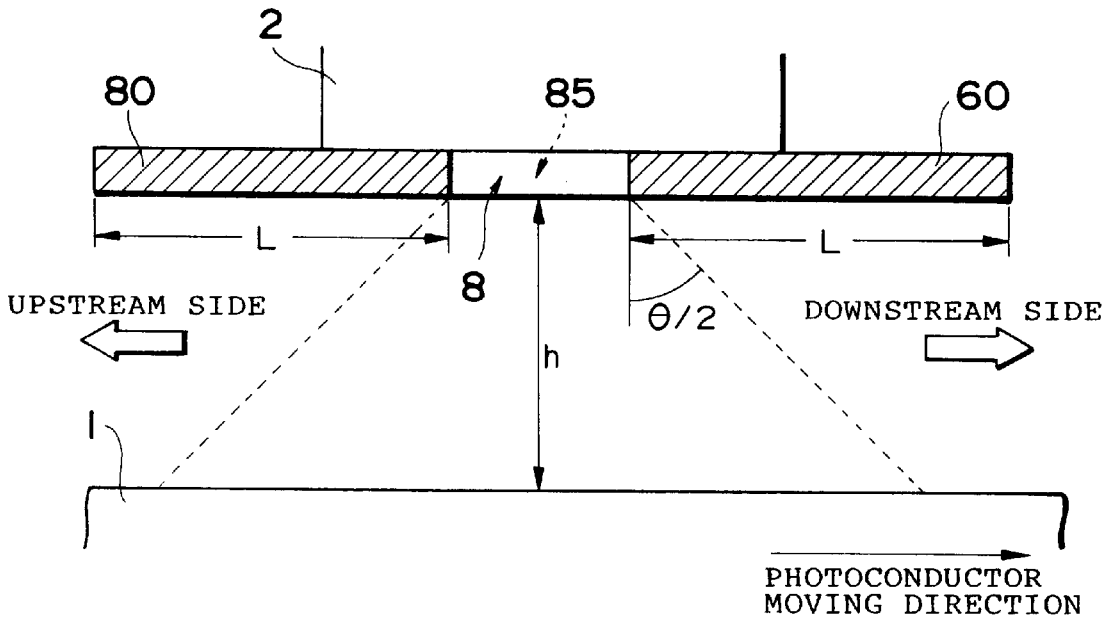
FIG. 35 is a schematic view showing the arrangement of the second application example of the charger (the 12th embodiment) shown in FIG. 31.
FIG. 36 is a table showing the measurement results of the charge potential on the surface of the member to be charged when the moving velocity of the member to be charged (photoconductor) is changed in the arrangement (the second application example of the 12th embodiment) shown in FIG. 35.

FIG. 36 is a table that summarizes the experimental results obtained by measuring the relationship between the linear velocity (mm/s) and the charge potential (V) of the photoconductor 1 when the widths L of the upstream and downstream electrodes 80 and 60 arranged to sandwich the electromagnetic wave irradiation end 8 therebetween were respectively set to be 20 (mm) in the above-mentioned arrangement (the second application example of the 12th embodiment) shown in FIG. 35.

As can be seen from the experimental results in the table shown in FIG. 36, when the upstream electrode 80 is arranged on the surface, facing the photoconductor 1, of the electromagnetic wave irradiation device 2 together with the downstream electrode 60, the charging efficiency can be improved, and a decrease in charging efficiency can be minimized even when the linear velocity (mm/s) of the photoconductor 1 increases.

Figure 37:
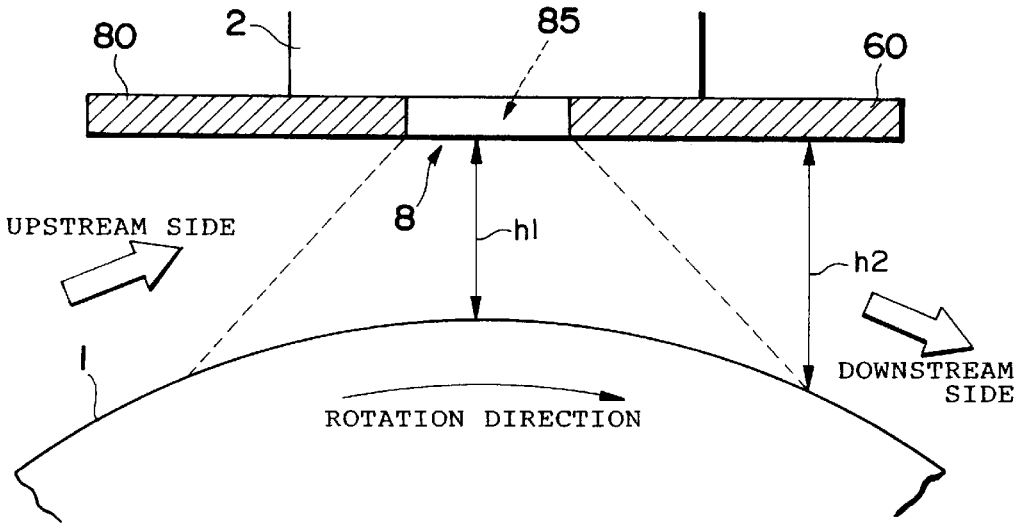
FIG. 37 is a schematic view showing the arrangement of the third application example of the charger (the 12th embodiment) shown in FIG. 31.
Figure 38:
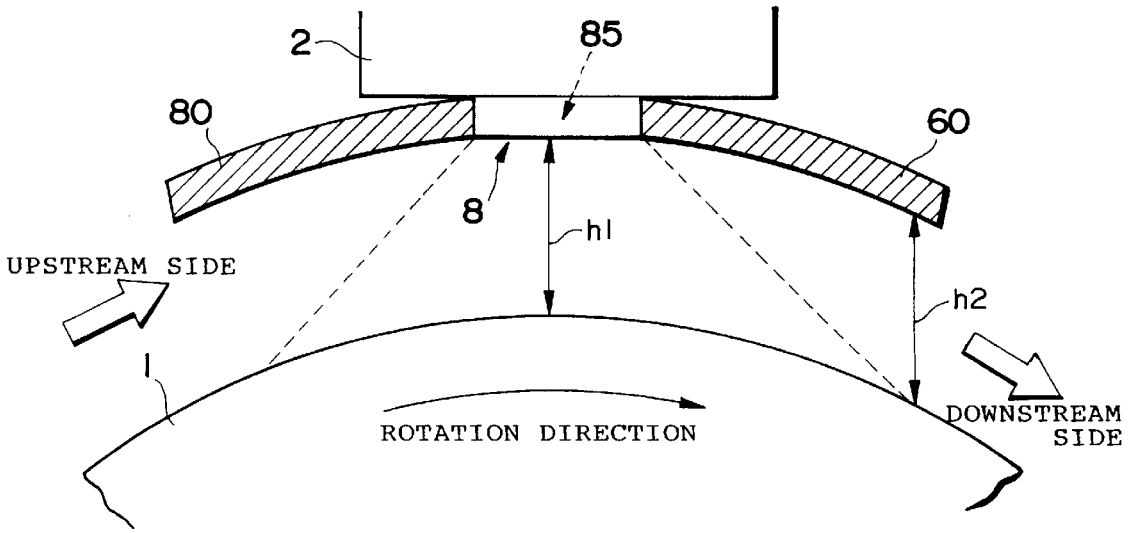
FIG. 38 is a schematic view showing the arrangement of the 13th embodiment (Embodiment 1-13) of the electrostatic charger according to the present invention.

As in the arrangement (the third application example of the 12th embodiment) shown in FIG. 37, when the photoconductor 1 has a cylindrical shape (in the case of a photosensitive drum), if the diameter of the photoconductor 1 decreases, the gap between itself and the electromagnetic wave irradiation device 2 cannot be constant, and changes upon moving the photoconductor 1. Even when the gap immediately below the electromagnetic wave irradiation device 2 is h1, it becomes h2 on the downstream side, and a charge may be removed from the photoconductor 1 due to a low electric field strength. Hence, it is preferable that the downstream electrode 60 be arranged to assure a nearly constant gap width even when the photoconductor (electrostatic latent image carrier) 1 moves. As in the arrangement shown in FIG. 38, the downstream electrode 60 preferably has a curvature substantially equal to that of the photoconductor 1. Note that FIG. 38 shows the arrangement of the 13th embodiment of the electrostatic charger according to the present invention.

Figure 39:
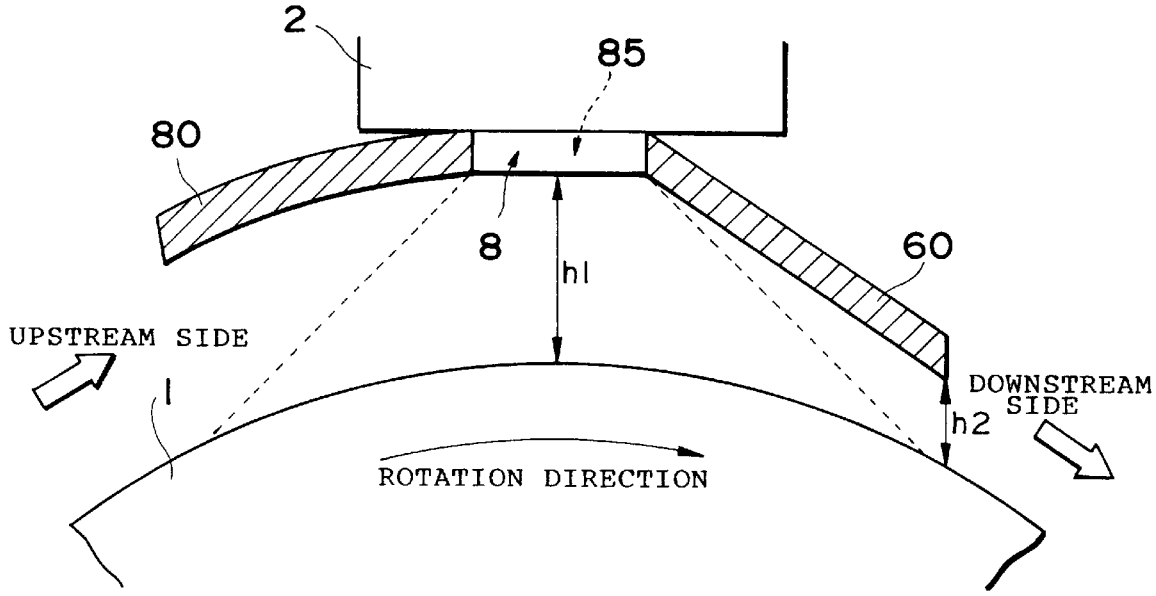
FIG. 39 is a schematic view showing the arrangement of the 14th embodiment (Embodiment 1-14) of the electrostatic charger according to the present invention.

The downstream electrode 60 need not have high shape precision, and the charger may be arranged to satisfy h1>h2 to intensify the electric field on the downstream side, as in the arrangement (the 14th embodiment) shown in FIG. 39, so as to improve the charging efficiency. In this case, it must be minded that no discharging occurs at the position of the gap h2. The same applies to the layout of the upstream electrode 80 but this layout has a small influence when the linear velocity (mm/s) of the photoconductor 1 is not so high.

Measurement experiments conducted for the above-mentioned 13th embodiment will be explained in more detail below.

Experiment 1

A cylindrical organic photoconductor (OPC) having a diameter of 100 (mm) and an axial length of 30 (cm) was prepared as the photoconductor 1, and a soft x-ray source that produced soft X-rays having an average energy of 6 (keV) was prepared as the electromagnetic wave irradiation device 2. A slit having a diameter of 10 (mm) was used as the electromagnetic wave irradiation end 8 of the soft X-ray source 2. Furthermore, a beryllium metal is fitted in the aperture portion 85 of the electromagnetic wave irradiation end 8, and the interior of a soft X-ray tube is maintained at a high vacuum. The X-ray irradiation angle from the soft X-ray source is θ shown in FIG. 31, and is 110°. On the upstream and downstream sides, in the rotation direction of the photoconductor, of the surface, facing the photoconductor 1, of the soft X-ray source 2, the upstream and downstream electrodes 80 and 60, each of which has a curvature that allows the electrode to extend substantially parallel to the photoconductor 1, and has a width of 10 (mm), are arranged, as in the arrangement (the 13th embodiment) shown in FIG. 38. These electrodes 60 and 80 are electrically connected to the beryllium metal in the electromagnetic wave irradiation end 8, but are electrically isolated from other members of the soft X-ray source 2. The core metal of the cylindrical photoconductor 1 is connected to ground, and the electrodes 60 and 80 are respectively applied with a bias of −2 (keV). Note that the soft X-ray source 2 is fixed at a position 5 (mm) from the photoconductor 1.

With this arrangement, the present inventors confirmed that the photoconductor 1 was charged (the charge potential was about −750 (V)) when soft X-rays were irradiated while rotating the photoconductor 1 at a linear velocity of 20 (mm/s). Subsequently, when charged toner particles were dusted over the charged portion, no toner was attached to the charged portion and, hence, the absence of charging non-uniformity was also verified.

Experiment 2

Experiment 2 was conducted using the same arrangement (the 13th embodiment) as in Experiment 1 above. Also, the electrodes 60 and 80 arranged on the soft X-ray source 2 are respectively connected to ground, and a bias of +2 (kV) is applied to the core metal of the cylindrical photoconductor 1. With this arrangement, the present inventors detected that the same results as in Experiment 1 could also be obtained when soft X-rays were irradiated.

Experiment 3

Experiment 3 was conducted using the same arrangement (the 13th embodiment) as in Experiment 1 above. Also, the electrodes 60 and 80 arranged on the soft X-ray source 2 are respectively applied with a bias of −1 (kV), and the core metal of the cylindrical photoconductor 1 is applied with a bias of +1 (kV). With this arrangement, the present inventors found out that the same results as in Experiments 1 and 2 could also be obtained when soft X-rays were irradiated.

As has been described in the ninth to 14th embodiments (Embodiments 1-9 to 1-14), in the electrostatic charger according to the present invention, the electric field forming system applies a voltage, which has a characteristic opposite to that of a required charge potential Vs and an absolute value larger than that of Vs, to the counter electrode and applies 0 V to the photoconductor as the member to be charged (first aspect); applies an appropriate voltage having a polarity opposite to that of the required charge potential Vs to the counter electrode, applies an appropriate voltage having the same polarity as that of Vs to the first electrode device (an electrode arranged on the electromagnetic wave irradiation end side of the electromagnetic wave irradiation device), and sets the potential difference between the two electrodes to become larger than the absolute value of Vs (second aspect); or applies 0 V to the counter electrode and applies a potential, which has the same polarity as that of Vs, and an absolute value larger than that of Vs, to the first electrode device (third aspect). In this manner, the charging electric field for causing ions produced by an electromagnetic wave to become attached to the surface of the photoconductor can be efficiently formed in the space, and an ozone-less (free from any ozone production), non-contact charging type apparatus can be provided.

When discharging has occurred between the electromagnetic wave irradiation device and the photoconductor, the surface of the photoconductor is charged nonuniformly and such nonuniform charging adversely influences the image formed. In addition, ozone is produced by discharging, and is harmful to the environment and human body. However, in the electrostatic charger according to the present invention, the potential difference between the electrode arranged on the photoconductor side of the electromagnetic wave irradiation device, and the counter electrode is set to be smaller than the insulating breakdown voltage of air in the gap width h (where h is the distance between the electromagnetic wave irradiation device and the photoconductor). With this arrangement, discharging can be prevented between the electromagnetic wave irradiation device and the photoconductor, and the above-mentioned problems can be solved.

On the downstream side in the moving direction of the photoconductor, if an electric field having a sufficiently high strength is not formed, a charge is removed from the photoconductor, and a required charge potential cannot be obtained. However, in the electrostatic charger according to the present invention, since the electrode arranged on the photoconductor side of the electromagnetic wave irradiation device is designed to have an appropriate width L on the downstream side in the moving direction of the photoconductor, the above-mentioned problem of charge removal can be solved.

Furthermore, when the surface to be charged of the member to be charged has a predetermined curvature like in a cylindrical photosensitive drum, and the curvature is large, the gap width between the first electrode device and the photoconductor changes upon movement of the photoconductor, and the charging electric field strength also changes. As a consequence, the charging electric field strength weakens on the downstream side, thus disturbing efficient charging. However, in the electrostatic charger according to the present invention, since the electrode (included in the first electrode device) arranged on the photoconductor side of the electromagnetic wave irradiation device has a shape with a curvature, which maintains a substantially constant gap width between itself and the photoconductor or narrows toward the downstream side in the moving direction of the photoconductor, the above-mentioned problem can be solved, and efficient charging can be realized.

In the above-mentioned electrostatic charger according to the present invention, a large number of ions are produced in air by an electromagnetic wave irradiated by the electromagnetic wave irradiation device 2, and ions having a polarity opposite to that of the counter electrode 1*a* of the produced ions are attracted by the surface (the surface to be charged) of the photoconductor 1 by the charging electric field formed between the electromagnetic wave irradiation device and the photoconductor 1, thereby charging the photoconductor 1. However, in the basic arrangement shown in, e.g., FIG. 24, since an electromagnetic wave is directly irradiated onto the photoconductor 1, such direct irradiation may result in deterioration of the photoconductor 1 and images depending on the wavelength of the electromagnetic wave and the material of the photoconductor 1. In view of this problem, it is preferable that the electromagnetic wave be not directly irradiated onto the photoconductor 1 as the member to be charged.

Figure 40:
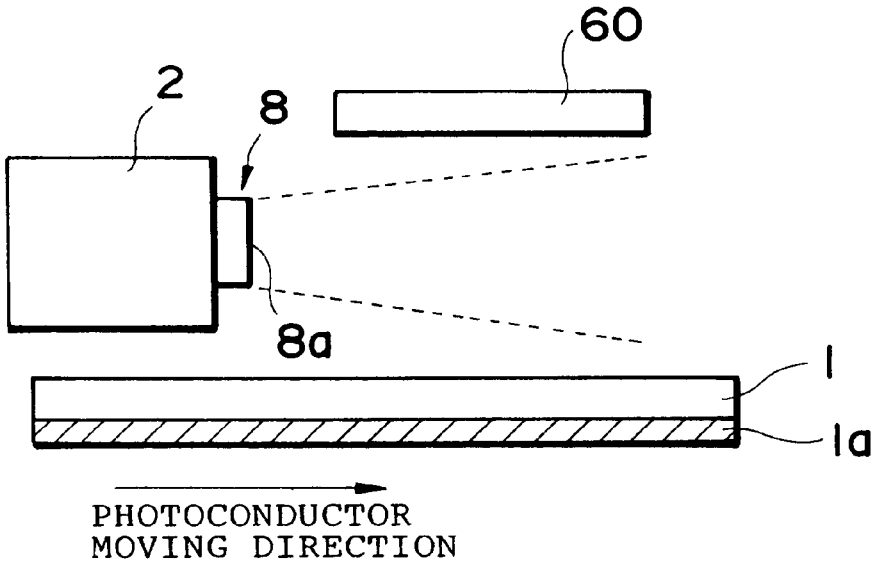
FIG. 40 is a schematic view showing the basic arrangement of an electrostatic charger according to the present invention.

FIG. 40 shows the basic arrangement of the electrostatic charger according to the present invention, which can solve the above-mentioned problem. As in the embodiments described above, the charger shown in FIG. 40 comprises the electromagnetic wave irradiation device 2, and the electrode 60 (included in the first electrode device) and the counter electrode 1*a* (included in the second electrode device), which are arranged to sandwich the photoconductor 1 as the movable member to be charged therebetween. Note that the electrodes 60 and 1*a* are included in the electric field forming system for producing a charging electric field in a space corresponding to the electromagnetic wave irradiation region.

In the charger shown in FIG. 40, the electromagnetic wave irradiation device 2 is arranged, so that the electromagnetic wave output end face 8*a* is tilted by a predetermined angle (90° in this apparatus) with respect to the surface to be charged of the photoconductor 1.

The irradiation direction of electromagnetic wave from the electromagnetic wave irradiation device is preferably set to be substantially parallel to the moving direction of the photoconductor 1 or to point slightly upward therefrom. Since an electromagnetic wave is irradiated to have a given width (irradiation angle θ) owing to the internal arrangement of the electromagnetic wave irradiation device 2, they may be irradiated onto the photoconductor 1 on the downstream side in the moving direction of the photoconductor. On the other hand, the direction of the electric field is preferably set to be perpendicular to the surface to be charged of the photoconductor 1 in consideration of the charging efficiency.

Embodiment (1-15)

If an electromagnetic wave leaks outside the apparatus, they may inflict an adverse influence. For this reason, as in the arrangement (the 15th embodiment) shown in FIG. 41, an electromagnetic wave shield plate 90 must be arranged at a position facing the electromagnetic wave output end face 8*a* of the electromagnetic wave irradiation device 2 to shield the electromagnetic wave. The electromagnetic wave shield plate 90 comprises different materials depending on the wavelengths of electromagnetic wave. For example, when X-rays or soft X-rays are used, materials such as lead, aluminum, glass, vinyl chloride, acrylic plate, and the like, which contain a large number of elements that can effectively absorb an electromagnetic wave used, may be used. The electromagnetic wave shield plate 90 must have a sufficiently large size to prevent the electromagnetic wave from leaking outside the apparatus.

Figure 42:
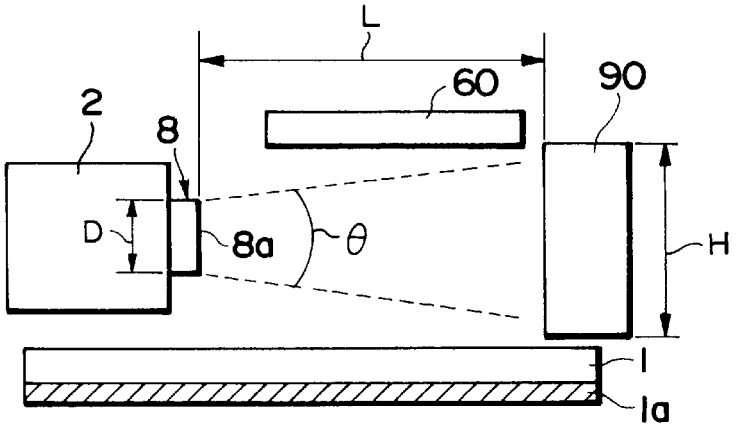
FIG. 42 is a schematic view for explaining the structural relationship among the respective portions in the arrangement (the 15th embodiment) shown in FIG. 41.

As shown in FIG. 42, if L represents the distance between the electromagnetic wave irradiation device 2 to the electromagnetic wave shield plate 90 and D represents the width, in the direction of height (the direction perpendicular to the surface to be charged of the photoconductor 1), of the aperture portion 85 of the electromagnetic wave irradiation end 8, the height, H, of the electromagnetic wave shield plate preferably satisfies:

$$H>2\times L\cdot\tan(\theta/2)+D$$

If the height H of the electromagnetic wave shield plate 90 satisfies the above relation, there is no fear of direct the leakage of electromagnetic wave behind the plate.

Note that the above description has been made about the dimension, in the direction of height, of the electromagnetic wave shield plate 90. Also, the same applies to the dimension, in the direction of depth (widthwise direction), of the electromagnetic wave shield plate 90. In this case, the width, in the direction of depth, of the aperture portion 85 of the electromagnetic wave irradiation end 8 corresponds to D, and the width of the electromagnetic wave shield plate 90 corresponds to H.

When the electromagnetic wave shield plate 90 comprises an insulator such as vinyl chloride, acrylic plate, glass, or the like, the electromagnetic wave shield plate 90 itself may adsorb ions and may be charged. Accordingly, since the charging efficiency of the photoconductor 1 slightly lowers until the electromagnetic wave shield plate 90 is sufficiently charged, a region with a low charge potential is formed on the surface of the photoconductor 1 for a while from the beginning of irradiation of electromagnetic wave. However, after the electromagnetic wave shield plate 90 is sufficiently charged, no serious problem is posed since the charging efficiency with respect to the photoconductor 1 stabilizes. In this manner, when the charging process is executed in practice, the photoconductor 1 must be rotated in an idle state for a predetermined period of time while an electromagnetic wave is irradiated. In this case, this period of time requires only several seconds. When the electromagnetic wave shield plate 90 comprises an insulator such as vinyl chloride, acrylic plate, or the like, it is easy to work, and is light in weight as compared to metals, resulting in low cost. Also, since discharging hardly occurs between the plate 90 and the charged photoconductor 1, easy design is assured.

On the other hand, when the electromagnetic wave shield plate 90 comprises a good conductor such as a lead plate, aluminum plate, or the like, the electrode 60 and the electromagnetic wave shield plate 90 are preferably set at nearly equal potentials. This is to prevent discharging between the electrode 60 and the electromagnetic wave shield plate 90, and to allow an electric field produced by the electrode 60 to efficiently point to the photoconductor 1. In this case, discharging between the electromagnetic wave shield plate 90 and the photoconductor 1 must be prevented. If discharging has occurred, an unwanted discharging pattern is formed on the photoconductor 1, resulting in charging nonuniformity. In order to prevent discharging, it is effective to sufficiently separate the edge portion, on the photoconductor side, of the electromagnetic wave shield plate 90 from the photoconductor 1. In this case, the apparatus must be designed to prevent an electromagnetic wave from leaking between the edge portion and the photoconductor 1. Also, discharging can also be prevented by covering the edge portion, on the photoconductor side, of the electromagnetic wave shield plate 90 with an insulator (see FIG. 47) or bending the plate to have an appropriate curvature.

Embodiment (1-16) to Embodiment (1-18)

Figure 41:
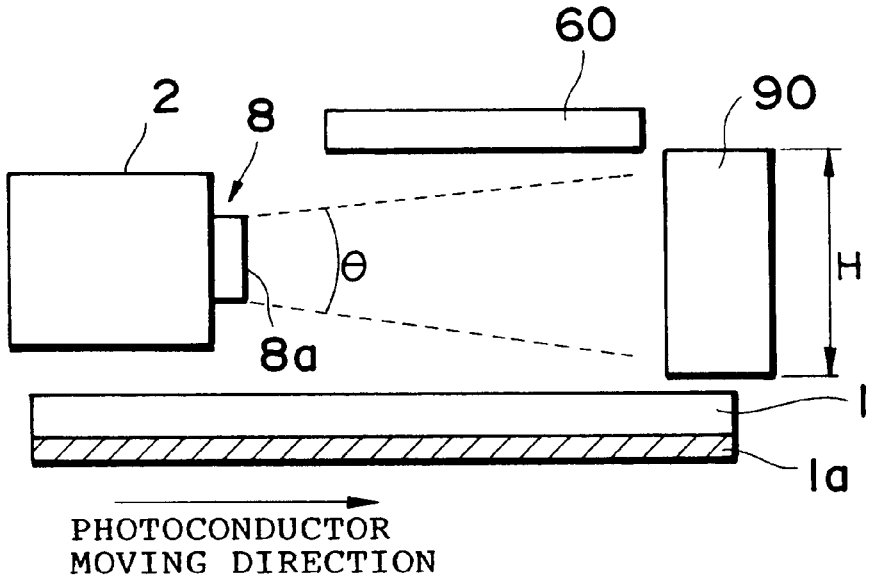
FIG. 41 is a schematic view showing the arrangement of the 15th embodiment (Embodiment 1-15) of the electrostatic charger according to the present invention.

In the charger of the 15th embodiment show in FIGS. 41 and 42, the electrode 60 and the electromagnetic wave shield plate 90 are two electrically separated members. Alternately, as in the arrangement (the 16th embodiment) shown in FIG. 43, an integrated electrode 60 having both the functions of the above-mentioned electrode 60 and plate 90 may be used. With this arrangement, a portion 60*a,* facing the photoconductor 1, of the electrode 60 serves as an electrode device for forming a charging electric field together with the counter electrode 1*a,* and the remaining portion 60*b* of the electrode 60 also serves as an electromagnetic wave shield member. In the arrangement shown in FIG. 43, since there is no gap between the electrode portion 60*a* and the electromagnetic wave shielding portion 60*b,* an electromagnetic wave never leak, and the electrode portion 60*a* and the electromagnetic wave shielding portion 60*b* are set at equal potentials, preferably.

Figure 43:
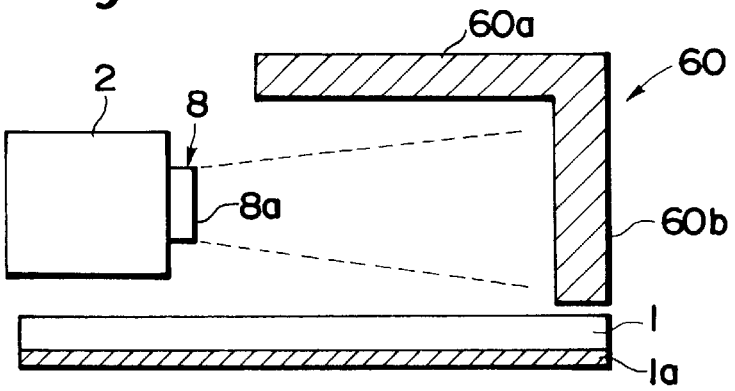
FIG. 43 is a schematic view showing the arrangement of the 16th embodiment (Embodiment 1-16) of the electrostatic charger according to the present invention.
Figure 47:
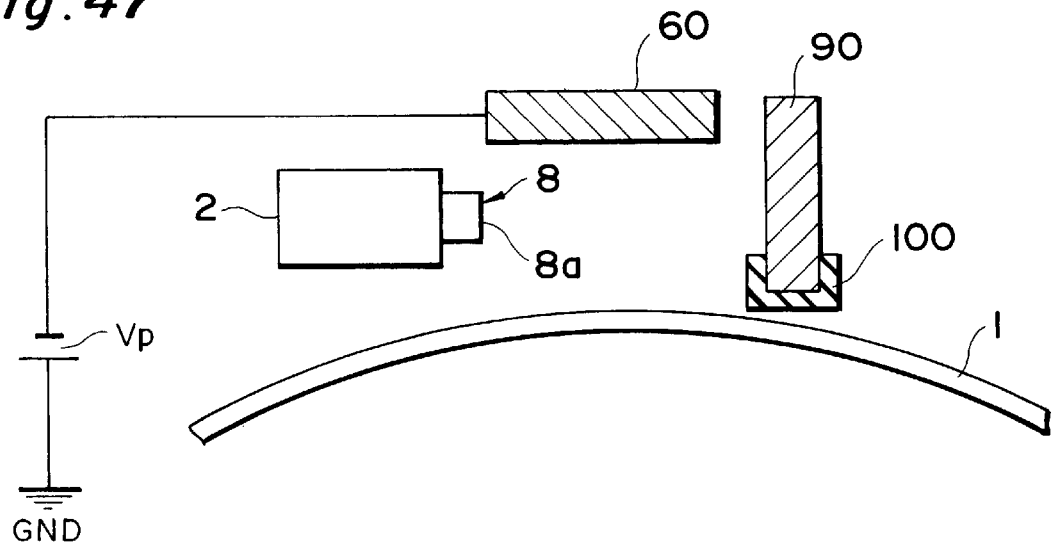
FIG. 47 is a schematic view showing the arrangement of the 17th embodiment (Embodiment 1-17) of the electrostatic charger according to the present invention.

On the other hand, in the arrangement (the 16th embodiment) shown in FIG. 43, since a bias is also applied to the electromagnetic wave shielding portion 60*b,* the above-mentioned measure must be taken to prevent discharging between the electrode and the photoconductor 1 (e.g., by covering the edge portion, on the photoconductor side, of the electromagnetic wave shield plate 90 with an insulator 100 as in the arrangement (the 17th embodiment) shown in FIG. 47, or bending the plate 90 to have an appropriate curvature), needless to say.

Figure 54:
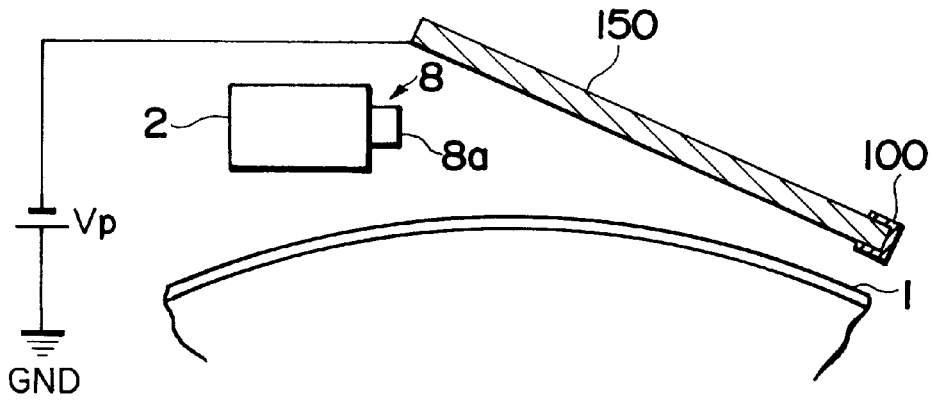
FIG. 54 is a schematic view showing the arrangement of the 18th embodiment (Embodiment 1-18) of the electrostatic charger according to the present invention.

Furthermore, the arrangement (the 18th embodiment) shown in FIG. 54 in which the electrode portion 60*a* and the electromagnetic wave shielding portion 60*b* are formed by a single plate may be adopted. In this arrangement (the 18th embodiment) as well, a charging electric field is satisfactorily formed, and the electromagnetic wave shielding effect is expected. In this case, it is preferable to take a measure of, e.g., covering the edge portion, on the photoconductor side, of an electrode plate 150 with an insulator or the like, needless to say. Furthermore, the electrode plate 150 (having both the electrode function and the electromagnetic wave shielding function) must have a sufficiently large length to prevent an electromagnetic wave from leaking behind the plate.

Measurement experiments conducted for the above-mentioned 15th to 18th embodiments will be explained in more detail below.

Experiment 4

An organic photoconductor (OPC) drum having a diameter of 100 (mm) was prepared as the photoconductor 1, and a soft x-ray source having an average energy of 6 (keV) was prepared as the electromagnetic wave irradiation device 2. The photoconductor 1 was driven under two different conditions, i.e., at linear velocities of 64 (mm/s) and 150 (mm/s). The irradiation angle θ of soft X-rays is 53°, and the aperture portion 85 of the electromagnetic wave irradiation end 8 has a circular shape with a diameter D of 5 (mm).

Figure 44:
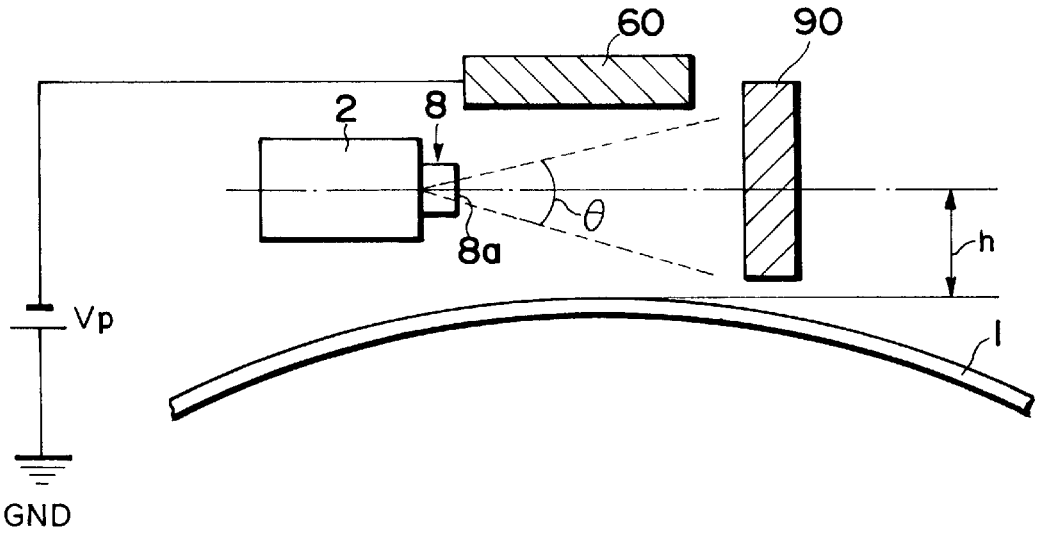
FIG. 44 is a schematic view showing an example of the experimental arrangement of the arrangement (the 15th embodiment) shown in FIG. 41.

Note that the soft X-ray irradiation device 2 is arranged above the organic photoconductor 1 (OPC), as shown in FIG. 44. Although not shown, the rear surface of the photoconductor is connected to ground via a metal core. The distance h from the photoconductor 1 to the soft X-ray irradiation axis is 10 (mm). On the other hand, the electromagnetic wave shield plate 90 comprises vinyl chloride, and is set at a position separated by the distance L=12 (mm) from the electromagnetic wave output end face 8*a* from which soft X-rays exit. The height H of the electromagnetic wave shield plate 90 is 20 (mm), which is larger than the value obtained by the above relation:

$$2\times L\cdot\tan(\theta/2)+D\approx 17\ (mm)$$

Hence, the plate 90 is deemed capable of sufficiently shielding soft X-rays. In addition, the thickness of the electromagnetic wave shield plate 90 is 5 (mm).

Figure 45:
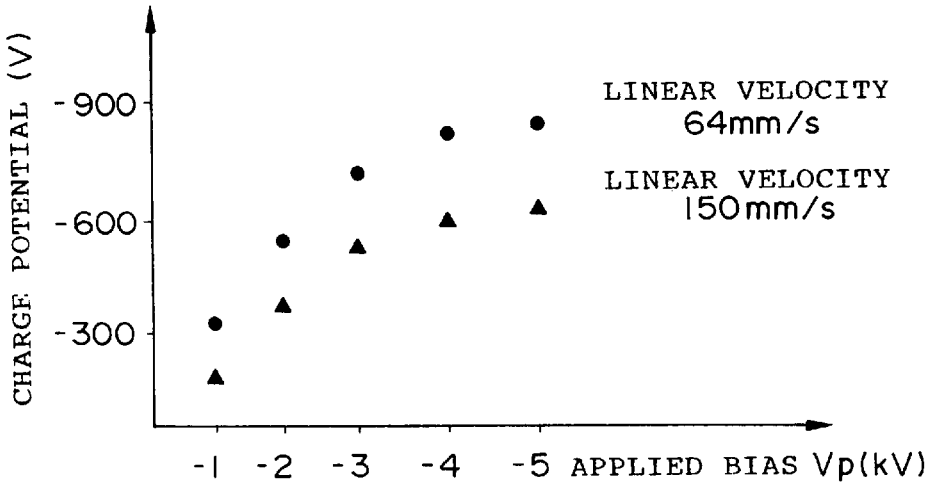
FIG. 45 is a graph showing the relationship between the applied bias (kV) and the charge potential (V) on the surface of the member to be charged (photoconductor) in the experimental arrangement (the 15th embodiment) shown in FIG. 44.

On the other hand, the electrode 60 is set at a height of 20 (mm) above the photoconductor 1, and is applied with an applied bias Vp. FIG. 45 is a graph showing the results corresponding to the two conditions, i.e., the linear velocities of 64 (mm/s) and 150 (mm/s) (the abscissa plots the applied bias Vp, and the ordinate plots the charge potential on the photoconductor 1). As can be seen from these results, the charge potential on the photoconductor 1 becomes higher as the linear velocity is lower and as the applied bias is higher. However, when the applied bias exceeds −4 (kV), the charge potential is saturated, and the charging efficiency is expected to cease to improve even if the bias is increased.

Figure 46:
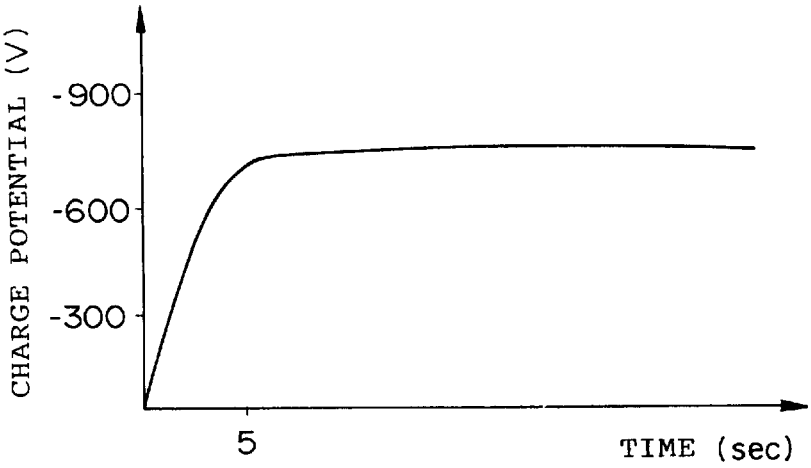
FIG. 46 is a graph showing the relationship between the time (sec) elapsed from the beginning of electromagnetic wave irradiation and the charge potential (V) on the surface of the member to be charged (photoconductor) when the moving velocity (photoconductor linear velocity) of the member to be charged is set to be 64 (mm/s) and the applied bias is set to be −3 (kV) in the experimental arrangement (the 15th embodiment) shown in FIG. 44.

Furthermore, FIG. 46 is a graph that plots the rise time of the photoconductor charge potential from the beginning of irradiation of electromagnetic wave when the linear velocity of the photoconductor is 64 (mm/s) and the applied bias is −3 (kV). In FIG. 46, the abscissa plots the time (sec) elapsed from the beginning of irradiation, and the ordinate plots the charge potential (V) on the photoconductor 1. As can be seen from this graph, about 5 sec are required until ions formed in a space upon irradiating an electromagnetic wave move toward the photoconductor 1 since they are attracted by an electric field and charge the photoconductor 1 up to the saturation potential. This delay is also generated since the electromagnetic wave shield plate 90 consumes some ions upon being charged. However, this value varies depending on the linear velocity (mm/s) of the photoconductor 1 and the applied bias (V).

The tables shown in FIGS. 48 and 49 summarize the measurement results of the radiation intensity on the rear side of the shield plate when the thickness of the electromagnetic wave shield plate 90 was changed. In particular, FIG. 48 summarizes the measurement results when a vinyl chloride plate was used as the electromagnetic wave shield plate 90, and FIG. 49 shows the measurement results when an acrylic plate was used. As can be seen from the results in these two tables, soft X-rays can be sufficiently shielded if the shield plate 90 has a thickness of 8 (mm) in the case of the acrylic plate or 1 (mm) in the case of the vinyl chloride plate. However, these results are those for soft X-rays, and the same does not necessarily apply to an electromagnetic wave having different wavelengths such as X-rays, ultraviolet rays, or the like.

Experiment 5

An organic photoconductor (OPC) drum having a diameter of 100 (mm) was prepared as the photoconductor 1, and a soft X-ray source having an average energy of 6 (keV) was prepared as the electromagnetic wave irradiation device 2. The photoconductor 1 was driven under two different conditions, i.e., at linear velocities of 64 (mm/s) and 150 (mm/s). The irradiation angle θ of soft X-rays is 53°.

The soft X-ray irradiation device 2 is arranged above the organic photoconductor 1 (OPC), as shown in FIG. 47. Although not shown, the rear surface of the photoconductor is connected to ground via a metal core. The distance h from the photoconductor 1 to the soft X-ray irradiation axis is 10 (mm). The electromagnetic wave shield plate 90 is an aluminum plate having a height H=20 (mm) and a thickness of 1 (mm), and is set at a position a distance L=12 (mm) from the electromagnetic wave output end face 8*a* from which soft X-rays are irradiated. The edge portion, on the photoconductor side, of the electromagnetic wave shield plate 90 is covered by a 1-mm thick insulating rubber member 100, as shown in FIG. 47, to prevent discharging between the edge portion and the photoconductor 1. An aluminum electrode 60 is set at a height of 20 (mm) above the photoconductor 1, and the aluminum shield plate 90 and the aluminum electrode 60 are respectively applied with an applied bias Vp.

Figure 50:
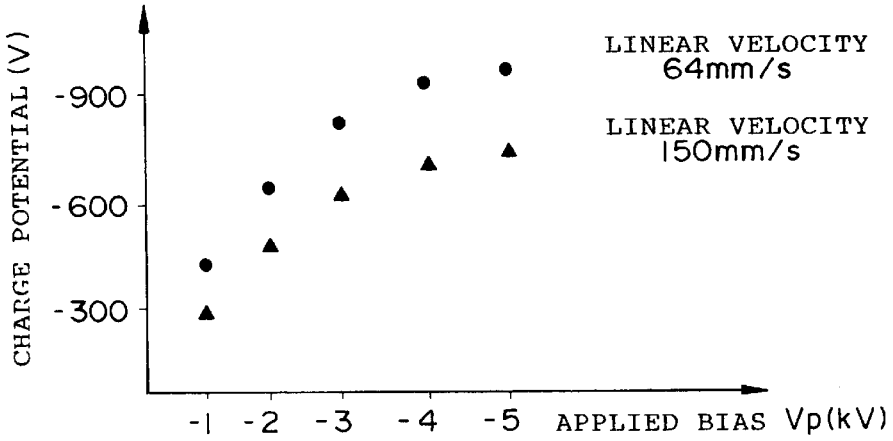
FIG. 50 is a graph showing the relationship between the applied bias (kV) and the charge potential (V) on the surface of the member to be charged (photoconductor) under the first condition in the arrangement (the 17th embodiment) shown in FIG. 47.
Figure 51:
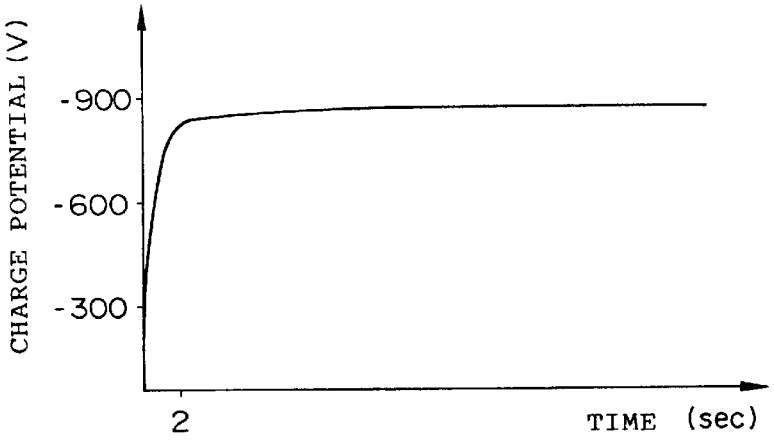
FIG. 51 is a graph showing the relationship between the time (sec) elapsed from the beginning of electromagnetic wave irradiation, and the charge potential (V) on the surface of the member to be charged (photoconductor) under the first condition when the moving velocity (photoconductor linear velocity) of the member to be charged is set to be 64 (mm/s) and the applied bias is set to be −3 (kV) in the arrangement (17th embodiment) shown in FIG. 47.

The relationship between the applied bias (V) and the charge potential (V) on the photoconductor 1 is as shown in the graph in FIG. 50. As can be seen from this graph, the charging efficiency can be slightly improved as compared to Experiment 4 above. FIG. 51 is a graph that plots the rise time of the charge potential on the photoconductor 1 from the beginning of irradiation of electromagnetic wave, when the linear velocity of the photoconductor 1 was set to be 64 (mm/s) and the applied bias to the electromagnetic wave shield plate 90 and the electrode 60 was set to be −3 (kV). In FIG. 51, the abscissa plots the time (sec) elapsed from the beginning of the irradiation, and the ordinate plots the charge potential (V) on the photoconductor 1. As can be seen from FIG. 51, the rise time can be shortened as compared to the measurement results of Experiment 4 above since the electromagnetic wave shield plate 90 need not be charged.

Figure 52:
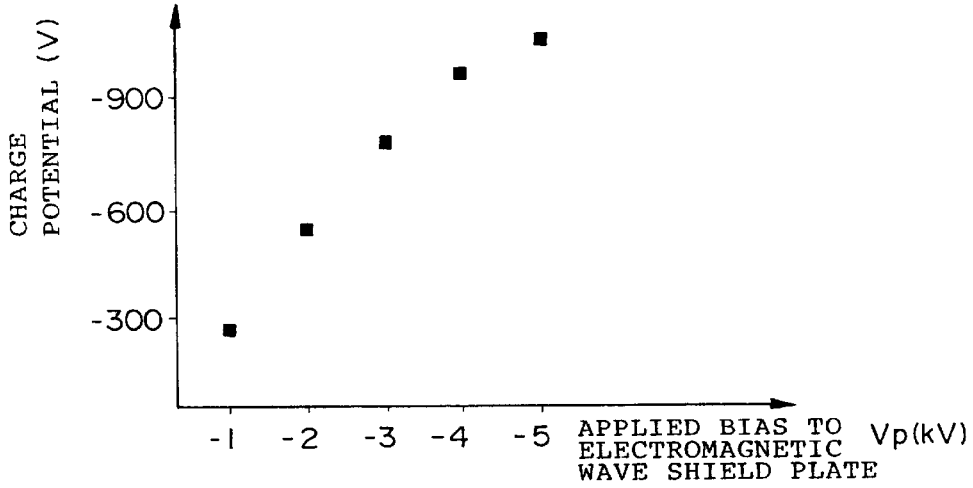
FIG. 52 is a graph showing the relationship between the applied bias (kV) to the electromagnetic wave shield member and the charge potential (V) on the surface of the member to be charged (photoconductor) under the first condition when the applied bias to a counter electrode device is set to be −3 kV in the arrangement (the 17th embodiment) shown in FIG. 47.

FIG. 52 is a graph that plots the relationship between the applied bias (Vp) to the electromagnetic wave shield plate 90 and the charge potential on the photoconductor 1 when the applied bias to the electrode 60 was set to be −3 (kV). As can be seen from FIG. 52 as well, the charging efficiency becomes higher as the bias applied to the electromagnetic wave shield plate 90 increases. However, it is most preferable to set the electromagnetic wave shield plate 90 and the electrode 60 at equal potentials since only one power supply is required.

Experiment 6

An organic photoconductor (OPC) drum having a diameter of 100 (mm) was prepared as the photoconductor 1, and an X-ray source (having a wavelength of $10^{-12}$ to $10^{-11}$ (m)) was prepared as the electromagnetic wave irradiation device 2. The photoconductor 1 is driven under two different conditions, i.e., at linear velocities of 64 (mm/s) and 150 (mm/s). The irradiation angle θ of soft X-rays is 53°.

The X-ray irradiation device 2 is arranged above the organic photoconductor (OPC) 1, as shown in FIG. 47. Although not shown, the rear surface of the photoconductor 1 is connected to ground via a metal core. The distance h from the photoconductor 1 to the X-ray irradiation axis is 10 (mm). The electromagnetic wave shield plate 90 comprises a lead plate having a height of 20 (mm) and a thickness of 10 (mm), and is set at a position a distance of 12 (mm) from the electromagnetic wave output end face 8*a*. Furthermore, the edge portion, on the photoconductor side, of the electromagnetic wave shield plate 90 is covered by a 1-mm thick insulating rubber member 100, as shown in FIG. 47, to prevent discharging between the edge portion and the photoconductor 1.

A lead electrode 60 is set at a height of 20 (mm) above the photoconductor 1, and the lead shield plate 90 and the lead electrode 60 are applied with an applied bias Vp.

Figure 53:
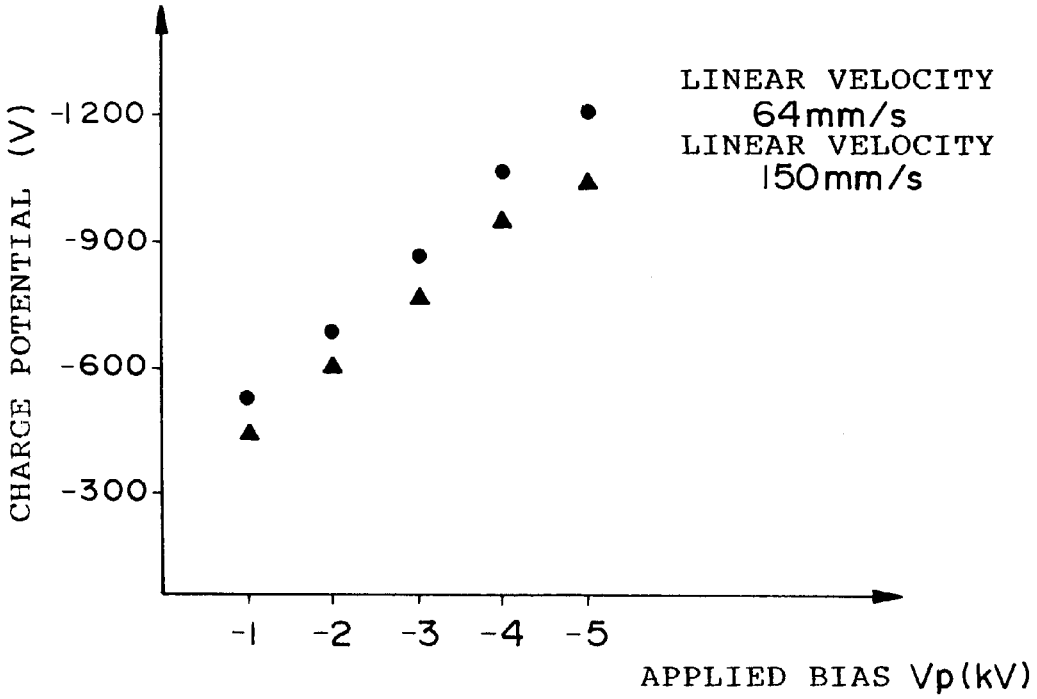
FIG. 53 is a graph showing the relationship between the applied bias (kV) and the charge potential (V) on the surface of the member to be charged (photoconductor) under the second condition in the arrangement (the 17th embodiment) shown in FIG. 47.

In this arrangement, the relationship between the applied bias (V) and the charge potential (V) on the photoconductor 1 is as shown in the graph in FIG. 53. As can be seen from this graph, the charging efficiency with respect to the photoconductor 1 can be improved more than that in Experiment 5 above.

As has been described in the 15th to 18th embodiments (Embodiments 1-15 to 1-18), in the electrostatic charger of the present invention, since the electromagnetic wave irradiation device is arranged not to directly irradiate an electromagnetic wave onto the photoconductor as the member to be charged, the photoconductor can be prevented from being deteriorated by an electromagnetic wave from the electromagnetic wave irradiation device, and the service life of an image forming apparatus can be prolonged.

Furthermore, since the electrostatic charger according to the present invention comprises the electromagnetic wave shield member, an electromagnetic wave can be prevented from leaking outside the apparatus in addition to the above-mentioned effect, thus improving safety.

When the electromagnetic wave shield member comprises an insulator, a decrease in charging efficiency with respect to the photoconductor can be avoided. Also, since such electromagnetic wave shield member is light in weight and allows easy working, a low-cost, lightweight apparatus can be realized.

On the other hand, when the electromagnetic wave shield member comprises a metal, the strength of a charging electric field for moving ions can be increased, and the charging efficiency with respect to the photoconductor can be further improved. Also, the rise time for charging can be shortened. Furthermore, when the electromagnetic wave shield member comprises a metal, it can be constituted integrally with the electrode device included in the electric field forming system. Therefore, the number of parts can be decreased, and easy assembly is assured. Furthermore, electromagnetic wave leakage can also be effectively prevented.

When the electromagnetic wave shield member comprises a metal, discharging between the electromagnetic wave shield member and the photoconductor poses must be prevented. However, by attaching an insulator to the edge portion, on the photoconductor side, of the electromagnetic wave shield member, discharging between the electromagnetic wave shield member and the photoconductor can be effectively prevented, and charging nonuniformity on the photoconductor can also be prevented.

An electrostatic discharger according to the present invention will be described hereinafter with reference to FIGS. 55 to 80.

The principle of the discharging process of the present invention will be described below.

Figure 55:
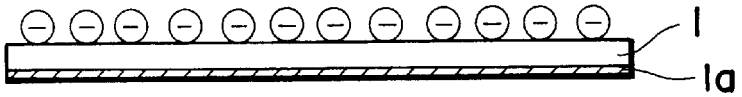
FIGS. 55 and 56 are views for explaining the discharging method of an electrostatic discharger according to the present invention.
Figure 56:
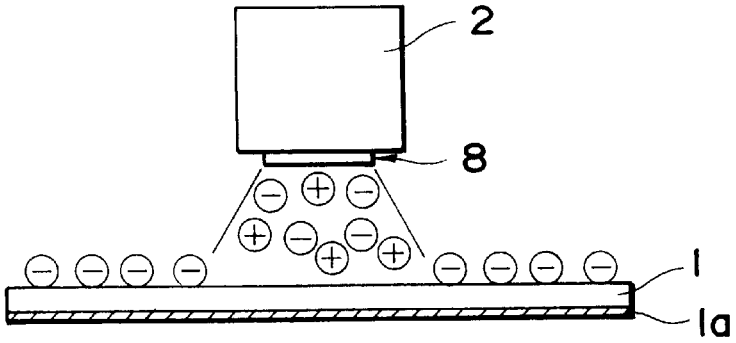
Figure 57:
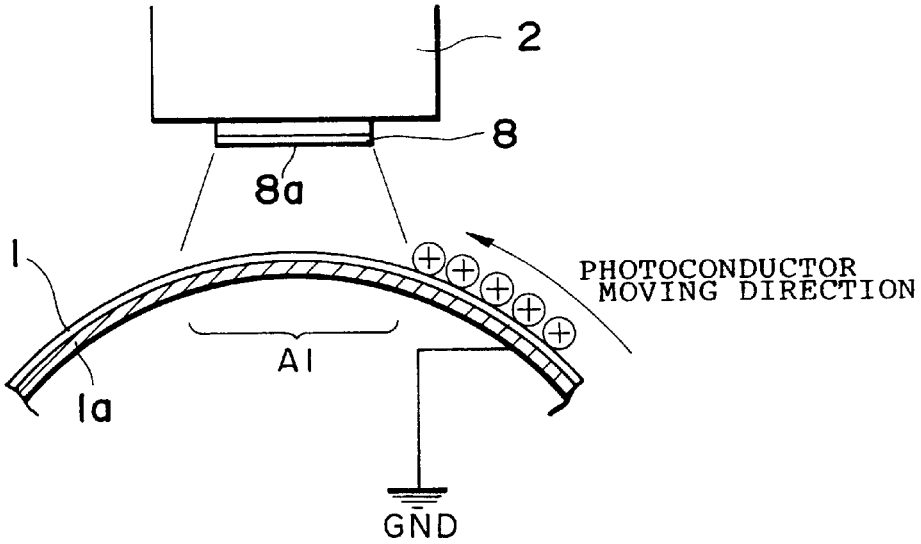
FIG. 57 is a schematic view showing the basic arrangement (case 1) of an electrostatic discharger according to the present invention.
Figure 58:
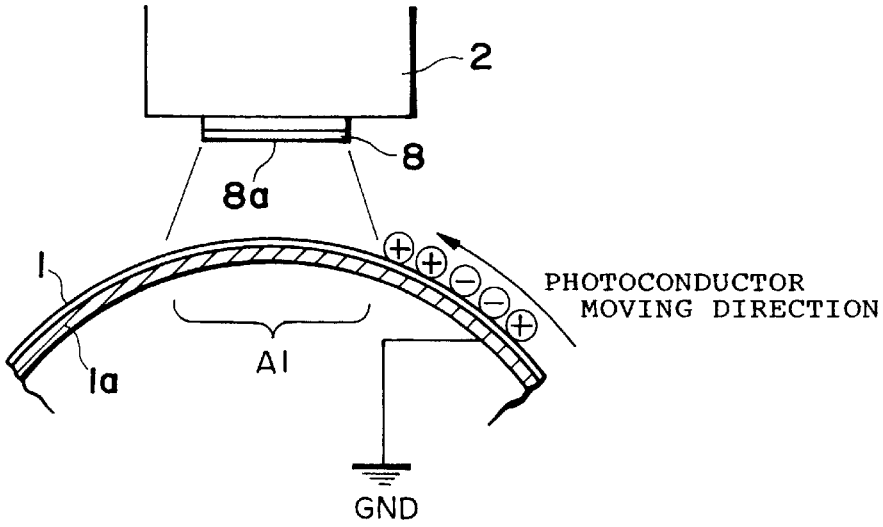
FIG. 58 is a schematic view showing the basic arrangement (case 2) of an electrostatic discharger according to the present invention.

When an electromagnetic wave is irradiated into air, the air in the irradiated region is ionized to produce anions and cations. Therefore, when an electromagnetic wave is irradiated, as shown in FIG. 56, onto the space above a substance 1 (the member to be charge-removed), which is charged, as shown in FIG. 55, the charges on the member 1 to be charge-removed are neutralized and removed by ions produced in the space above the member 1 to be charge-removed. Of course, the discharging method of the present invention can be applied to charge removal of a photoconductor (the member to be charge-removed) on which an electrostatic latent image (a positive charge pattern) is formed in an image forming apparatus that uses the electrophotography technique. For example, when the apparatus arrangement shown in FIG. 57 is adopted, the residual charges on a portion A1 of a photoconductor 1 can be removed in a non-contact manner. Note that FIG. 57 is an explanatory view of the case wherein positive charges are to be removed. Also, since negative charges can be canceled by the same arrangement as in FIG. 57, as in an example shown in FIG. 58, even charges having both polarities on the surface of the photoconductor 1, which cannot be removed by a conventional charge removal lamp, can be removed.

A conventional corona charger can cancel charges of both polarities, but suffers a serious problem, i.e., produces a large amount of ozone. Contrary to this, since the electrostatic discharger according to the present invention does not produce any ozone, it is expected to be superior to the corona charger. Note that ultraviolet rays, soft X-rays, X-rays, γ-lines, or the like can be used as an electromagnetic wave in the present invention. However, in consideration of ionization efficiency and safety, soft X-rays or X-rays having a wavelength of $10^{-11}$ to $10^{-9}$ (m) are preferable.

Embodiment (2-1)

Figure 59:
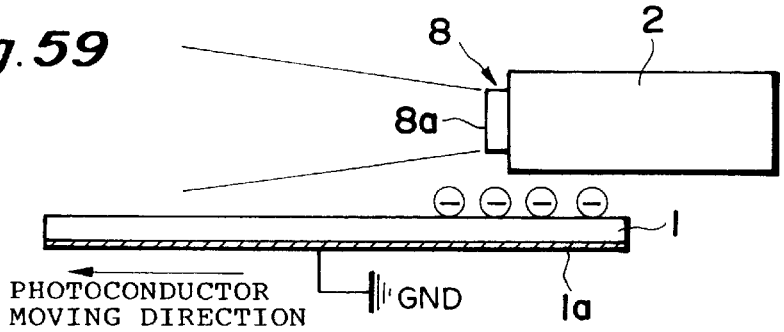
FIG. 59 is a schematic view showing the arrangement of the first embodiment (Embodiment 2-1) of the electrostatic discharger according to the present invention.
Figure 60:
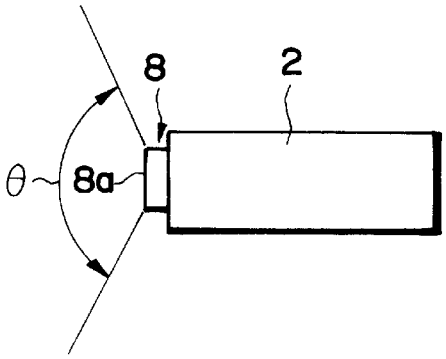
FIG. 60 is a schematic view for explaining the electromagnetic wave irradiation angle of an electromagnetic wave irradiation device used in the electrostatic discharger according to the present invention.
Figure 61:
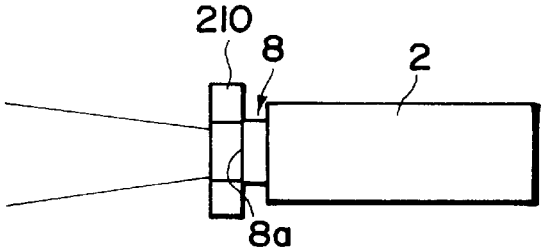
FIG. 61 is a schematic view for explaining the setting position of an electromagnetic wave irradiation angle limiting member (slit) used in the electrostatic discharger according to the present invention.
Figure 62:
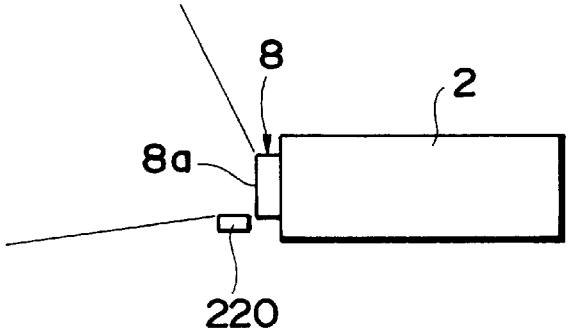
FIG. 62 is a schematic view for explaining the setting position of an electromagnetic wave shield member used in the electrostatic discharger according to the present invention.

FIG. 59 shows the arrangement of the first embodiment of the electrostatic discharger according to the present invention. The discharger of the first embodiment comprises an arrangement in which an electromagnetic wave irradiation device 2 is set so that its electromagnetic wave output end face 8*a* is tilted by a predetermined angle (90° in this embodiment) with respect to the charged surface of the photoconductor 1 as the member to be charge-removed. When the member 1 to be charge-removed comprises a material that may deteriorate upon irradiation of an electromagnetic wave, direct irradiation of an electromagnetic wave onto the member 1 to be charge-removed can be avoided by adopting the arrangement of the first embodiment (FIG. 59), and charges can be removed from the member 1 to be charge-removed without deteriorating it. Note that the irradiation angle of electromagnetic wave varies depending on the electromagnetic wave irradiation device 2. For this reason, when the electromagnetic wave irradiation device 2 having a larger irradiation angle θ is used, as shown in FIG. 60, a slit 210 (a limiting member for limiting the electromagnetic wave irradiation region where the electromagnetic wave from the electromagnetic wave irradiation device 2 reaches) is arranged on an electromagnetic wave irradiation end 8, as shown in FIG. 61, or an electromagnetic wave shield member 220 is arranged on the member to be charge-removed side of the electromagnetic wave irradiation end 8, as shown in FIG. 62, thus suppressing divergence of electromagnetic wave irradiated from the electromagnetic wave irradiation device 2.

As the material of the slit 210 or the electromagnetic wave shield member 220 arranged on the electromagnetic wave irradiation end 8 of the electromagnetic wave irradiation device 2, most of all metal materials or resin materials may be used. However, a material with high transmittance with respect to an electromagnetic wave, e.g., beryllium (Be), magnesium (Mg), calcium (Ca), strontium (Sr), barium (Ba), carbon, or a carbon film is not preferable.

Embodiment (2-2)

Figure 63:
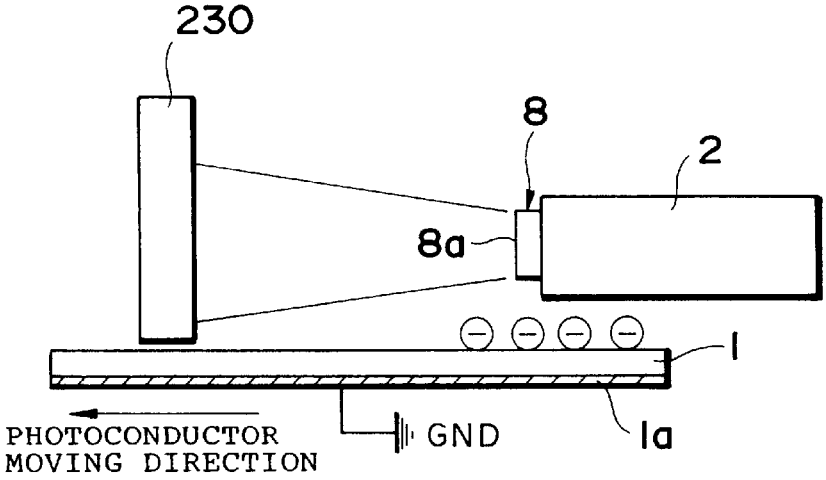
FIG. 63 is a schematic view showing the arrangement of the second embodiment (Embodiment 2-2) of the electrostatic discharger according to the present invention.

FIG. 63 shows the arrangement of the second embodiment of the electrostatic discharger according to the present invention, which apparatus is obtained by improving the discharger (the first embodiment) shown in FIG. 59. In the arrangement (the first embodiment) shown in FIG. 59, when a device that irradiates an electromagnetic wave having a short wavelength and a high intensity is adopted as the electromagnetic wave irradiation device 2, the irradiated electromagnetic wave may leak outside the apparatus, and may harm the human body or the like. In view of this problem, an electromagnetic wave shield member 230 is arranged at a position facing the electromagnetic wave output end face 8*a*, as in the arrangement shown in FIG. 63, thereby preventing electromagnetic wave from leaking outside the apparatus and improving safety.

Embodiment (2-3)

Figure 64:
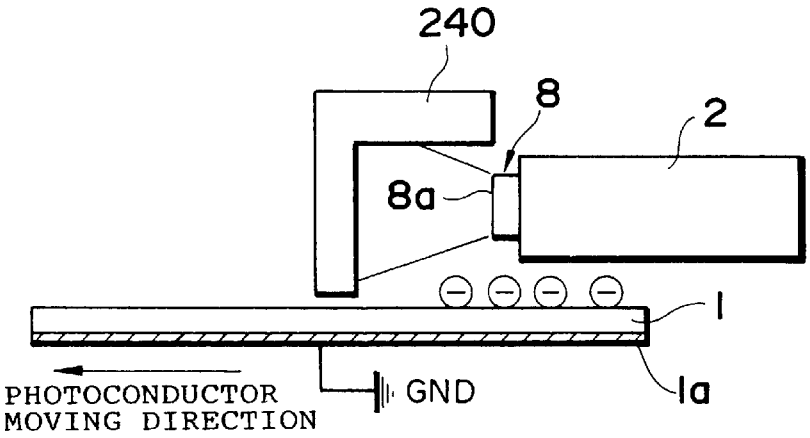
FIG. 64 is a schematic view showing the arrangement of the third embodiment (Embodiment 2-3) of the electrostatic discharger according to the present invention.

FIG. 64 shows the arrangement of the third embodiment of the electrostatic discharger according to the present invention. In order to prevent an electromagnetic wave from leaking toward the region above the electromagnetic wave irradiation region, the upper end of an electromagnetic wave shield member 240 of the third embodiment is bent toward the electromagnetic wave irradiation device 2. Although not shown, another electromagnetic wave shield member may be arranged in the direction of depth of the apparatus. With this arrangement, the safety of the apparatus can be further improved.

Embodiment (2-4)

Figure 65:
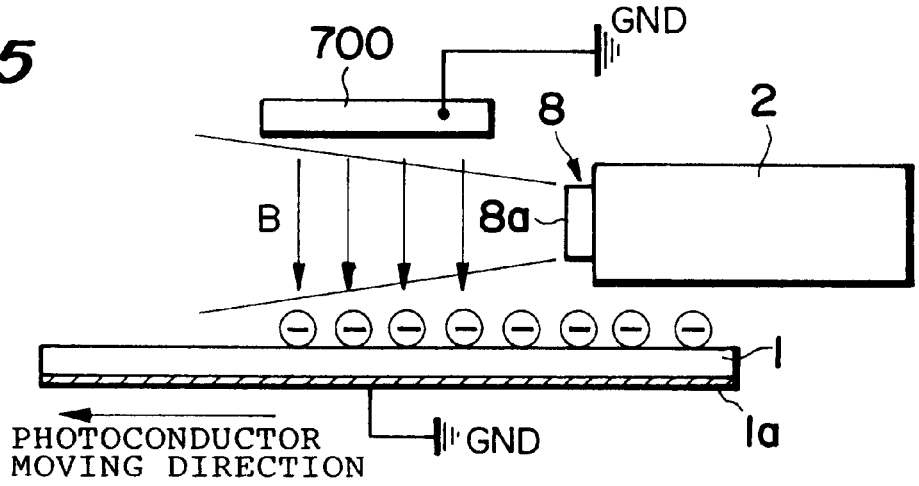
FIG. 65 is a schematic view showing the arrangement of the fourth embodiment (Embodiment 2-4) of the electrostatic discharger according to the present invention.

FIG. 65 shows the arrangement of the fourth embodiment of the electrostatic discharger according to the present invention. In this apparatus, an electrode 700 is arranged above the electromagnetic wave irradiation region. Note that the electrode 700 is connected to ground, and is placed parallel to the major surface of the member 1 to be charge-removed. Since the electrode 700 is arranged, an electromagnetic wave can be prevented from leaking to the region above the electromagnetic wave irradiation region, and an electric field in the direction indicated by an arrow B in FIG. 65, which is effective for charge removal in the ionization region (electromagnetic wave irradiation region) of air is obtained, thus improving the charge removing efficiency. Note that the electrode 700 may be arranged to be closer to the member 1 to be charge-removed. However, if the electrode 700 is too close to the member 1, the ionization space narrows, and the charge removing efficiency lowers undesirably. Also, if the electrode 700 is too far, it is not preferable since the electric field weakens.

Embodiment (2-5) and Embodiment (2-6)

Figure 66:
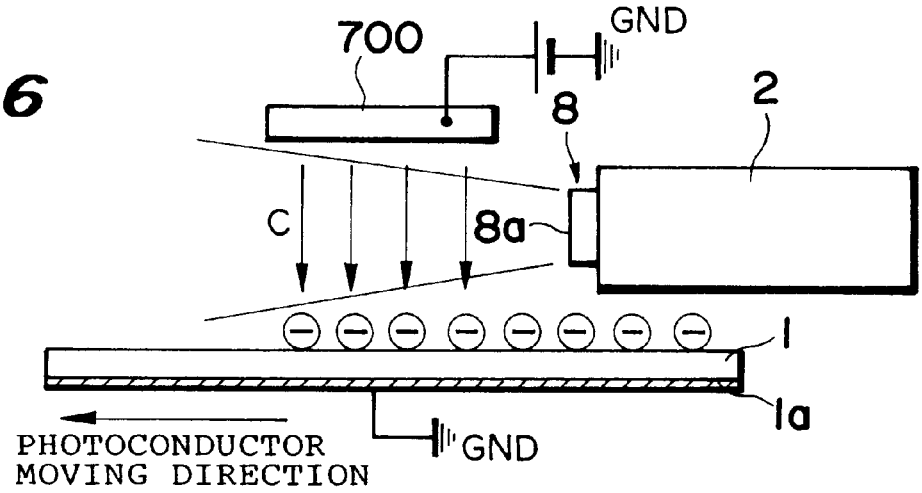
FIG. 66 is a schematic view showing the arrangement of the fifth embodiment (Embodiment 2-5) of the electrostatic discharger according to the present invention.
Figure 67:
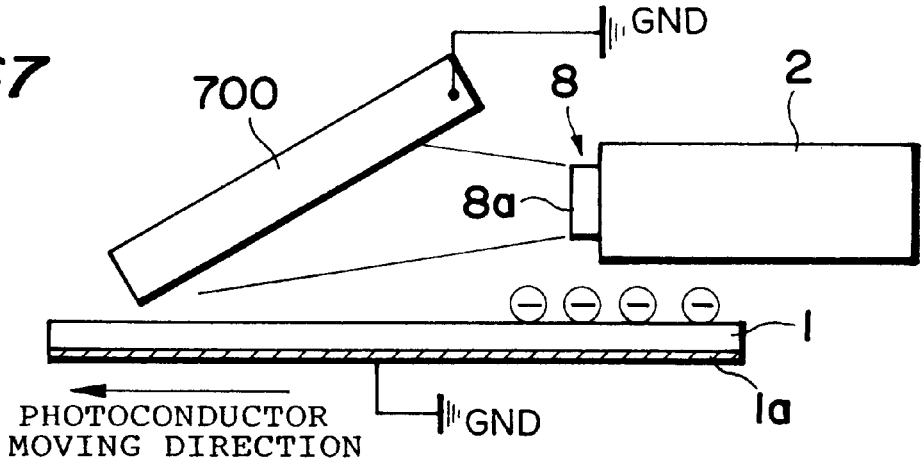
FIG. 67 is a schematic view showing the arrangement of the sixth embodiment (Embodiment 2-6) of the electrostatic discharger according to the present invention.

Furthermore, FIG. 66 shows the arrangement of the fifth embodiment of the electrostatic discharger according to the present invention. In this apparatus, an electric field forming system applies a reverse bias so that the electrode 700 is set at a potential having a polarity opposite to the charge potential of the member 1 to be charge-removed. In this manner, when the electrode 700 is set at a potential with a polarity opposite to that of the charge potential of the member 1 to be charge-removed, the strength of the electric field in the direction indicated by an arrow C in FIG. 66 increases, and the charge removing speed becomes higher. However, if the potential of the electrode 700 is too high, the member 1 to be charge-removed is charged. For this reason, the electrode 700 must be set at a proper potential in correspondence with the energy of electromagnetic wave, the moving velocity and charged amount of the member 1 to be charge-removed, and the like. In FIGS. 65 and 66, the electrode 700 is arranged parallel to the member 1 to be charge-removed, but the present invention is not limited to such specific arrangement. For example, as in the arrangement (the sixth embodiment) shown in FIG. 67, when the electrode 700 is arranged obliquely with respect to the member 1 to be charge-removed (i.e., when the electrode 700 is arranged, so that the distance between the electrode 700 and the member 1 to be charge-removed decreases along the moving direction of the member 1 to be charge-removed), the electrode 700 can also serve as an electromagnetic wave shield member.

Embodiment (2-7)

Figure 68:
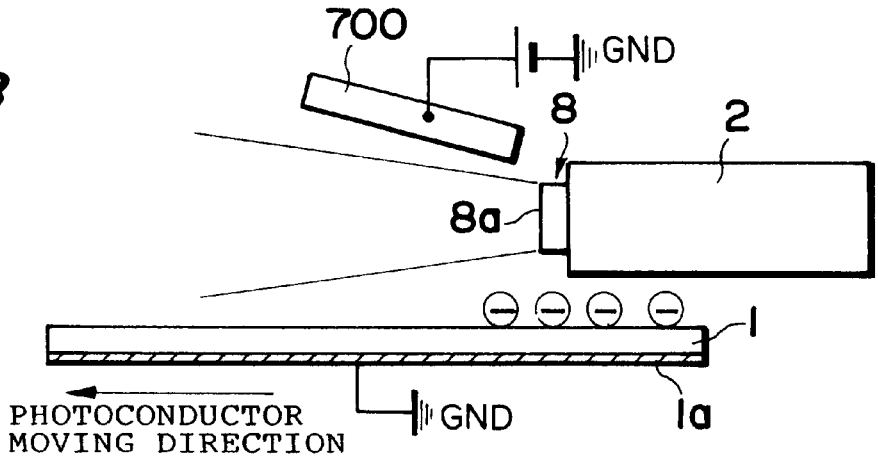
FIG. 68 is a schematic view showing the arrangement of the seventh embodiment (Embodiment 2-7) of the electrostatic discharger according to the present invention.

On the other hand, as shown in FIG. 68, when the electrode 700 is arranged so that the distance between the electrode 700 and the member 1 to be charge-removed increases along the moving direction of the member 1 to be charge-removed, since the electric field strength weakens toward the downstream side in the moving direction of the member 1 to be charge-removed, the member 1 to be charge-removed can be prevented from being re-charged after charge removal. Note that FIG. 68 shows the arrangement of the seventh embodiment of the electrostatic discharger according to the present invention.

Embodiment (2-8)

Figure 69:
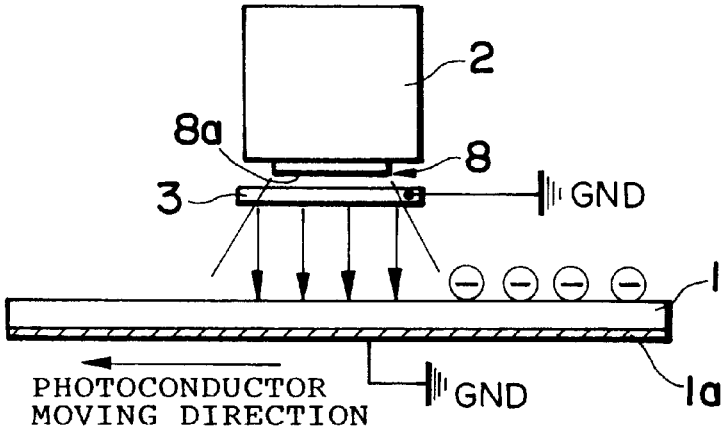
FIG. 69 is a schematic view showing the arrangement of the eighth embodiment (Embodiment 2-8) of the electrostatic discharger according to the present invention.

FIG. 69 shows the arrangement of the eighth embodiment of the electrostatic discharger according to the present invention, and shows an example of the method of producing an electric field in the apparatus arrangement in which an electromagnetic wave is irradiated from a position above the member 1 to be charge-removed. In the eighth embodiment, since ionization must be induced beneath an electrode 3 (between the electrode 3 and the member 1 to be charge-removed), the electrode 3 must comprise a material having high transmittance with respect to an electromagnetic wave or must have a mesh shape having a large aperture ratio (see FIGS. 6 to 8).

Embodiment (2-9)

Figure 70:
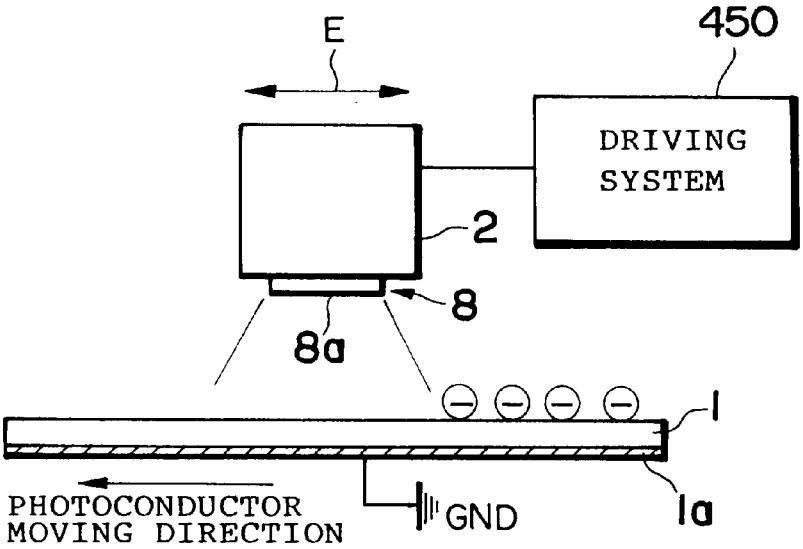
FIG. 70 is a schematic view showing the arrangement of the ninth embodiment (Embodiment 2-9) of the electrostatic discharger according to the present invention.

Furthermore, in the apparatus arrangement in which an electromagnetic wave is irradiated from the positive above the member 1 to be charge-removed, another arrangement that can improve the charge removing speed can also be realized. More specifically, FIG. 70 shows the arrangement of the ninth embodiment of the electrostatic discharger according to the present invention. In this apparatus, by reciprocally moving the electromagnetic wave irradiation device 2 in a direction parallel to the moving direction of the member 1 to be charge-removed, as indicated by a double-headed arrow E, the number of ions produced by ionization increases, and the charge removing efficiency can be improved. A driving system 450 for moving the electromagnetic wave irradiation device 2 may use an actuator such as a solenoid to independently drive the device 2, or may adopt a mechanism which is driven by the movement of the member 1 to be charge-removed using a transmission mechanism such as a gear, belt, cam, and the like. The electromagnetic wave irradiation device 2 need not be translated but may be reciprocally rotated.

Embodiment (2-10)

Figure 71:
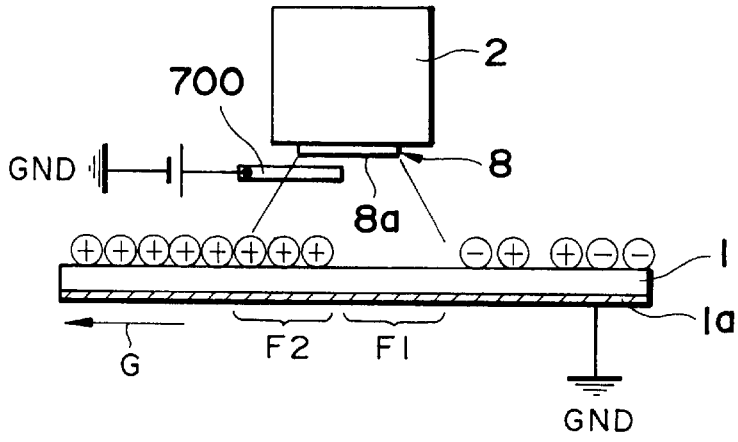
FIG. 71 is a schematic view showing the arrangement of the 10th embodiment (Embodiment 2-10) of the electrostatic discharger according to the present invention, i.e., the arrangement of the apparatus that can realize both the charge removing and charging processes.

FIG. 71 shows the arrangement of the 10th embodiment of the electrostatic discharger according to the present invention, and shows the apparatus arrangement that realizes two functions, i.e., a charge remover and a charger. That is, FIG. 71 shows an example of the arrangement used when the photoconductor 1 as the member to be charge-removed is charged immediately after charge removal. In the arrangement of the 10th embodiment, an electrode 700 comprising a metal material having high transmittance with respect to an electromagnetic wave is inserted in a portion, on the downstream side in the moving direction of the photoconductor, indicated by an arrow G in FIG. 71, of the electromagnetic wave irradiation region between the electromagnetic wave irradiation device 2 and the photoconductor 1. The electrode 700 is applied with a predetermined charging bias. With this arrangement, charge removal of the photoconductor 1 is performed on a region F1, and the photoconductor 1 can be uniformly charged on a region F2. Accordingly, with this arrangement, the functions of a charge removing lamp and a charger, which have been conventionally used, can be realized by a single apparatus.

Embodiment (2-11)

Figure 72:
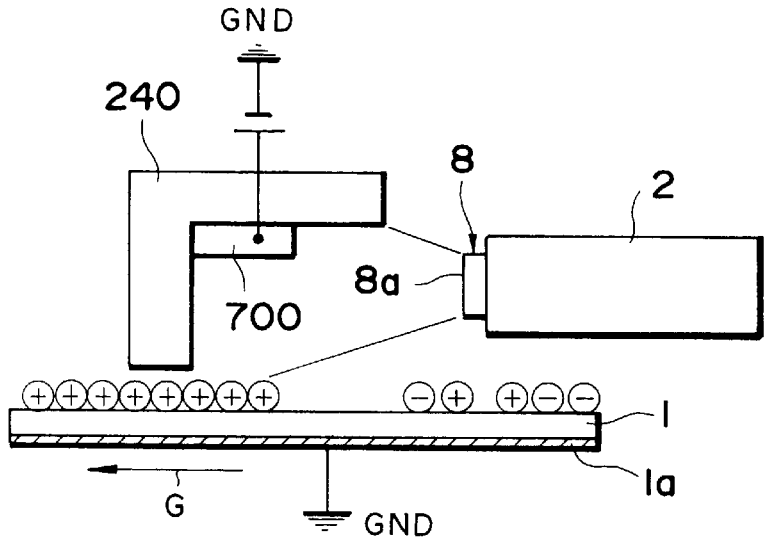
FIG. 72 is a schematic view showing the arrangement of the 11th embodiment (Embodiment 2-11) of the electrostatic discharger according to the present invention, i.e., the arrangement of the apparatus that can realize both the charge removing and charging processes.
Figure 73:
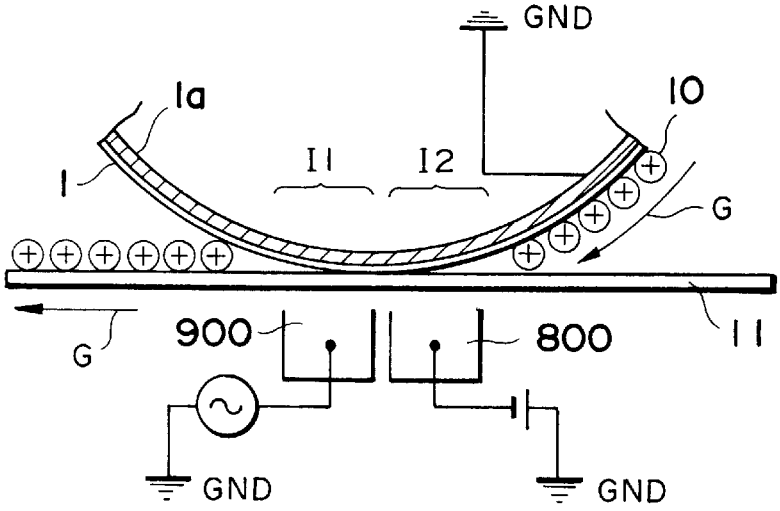
FIG. 73 is a schematic view showing the arrangement of a transfer and separation apparatus using a conventional corona charger.

Furthermore, even in the arrangement in which an electromagnetic wave is irradiated in a direction substantially parallel to the photoconductor 1, the two functions of a charge remover and a charger can be realized by a single apparatus arrangement as in the 10th embodiment mentioned above. FIG. 72 shows the arrangement of the 11th embodiment of the electrostatic discharger according to the present invention. The electrostatic discharger of the 11th embodiment comprises the electrode 700 in addition to the arrangement of the third embodiment shown in FIG. 64. Since the electrode 700 is surrounded by the electromagnetic wave shield member 240 except for a surface facing the electromagnetic wave irradiation region, it need not comprise a metal material with high transmittance with respect to an electromagnetic wave.

Therefore, in the 11th embodiment, a predetermined region, which faces the electromagnetic wave shield member 240, and faces the electrode 700, of the photoconductor 1 serves as the region to be charged, and the remaining region serves as the region to be charge-removed.

Embodiment (2-12)

Figure 74:
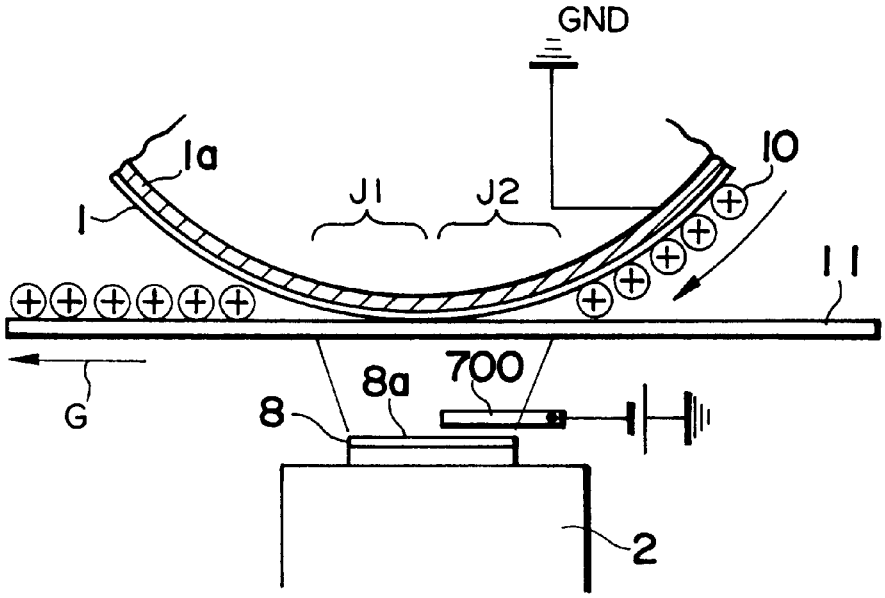
FIG. 74 is a schematic view showing the arrangement of a transfer and separation apparatus which adopts the 12th embodiment (Embodiment 2-12) of the electrostatic discharger according to the present invention, which can realize both the discharging and charging processes.

Note that FIGS. 71 and 72 above show the apparatus arrangements in each of which the photoconductor 1 is charged immediately after charge removal. The transfer process in the conventional electrophotography process uses an apparatus which performs charge removal of a recording paper sheet 11 immediately after charging, as in the arrangement shown in FIG. 73. More specifically, a first corona charger 800 charges the rear surface of the recording paper sheet 11 to a polarity opposite to that of toner 10 at the nip entrance (a region indicated by I2 in FIG. 73) between the photoconductor 1 and the recording paper sheet 11, thereby transferring a toner image formed on the photoconductor 1 onto the recording paper sheet 11. Subsequently, a second corona charger 900 removes charges from the rear surface of the recording paper sheet 11 at the nip exit (a region indicated by 11 in FIG. 73) so as to allow the recording paper sheet 11 to be easily separated from the photoconductor 1. However, in the arrangement shown in FIG. 73, since transfer·separation processes are attained using the corona chargers, a problem of ozone production is posed. In view of this problem, FIG. 74 shows the arrangement for applying the electrostatic discharger according to the present invention to a transfer·separation apparatus. Note that FIG. 74 shows the arrangement of the 12th embodiment of the electrostatic discharger according to the present invention.

As shown in FIG. 74, in the discharger of the 12th embodiment, the electromagnetic wave irradiation device 2 irradiates an electromagnetic wave onto a range broader than the contact portion between the photoconductor 1 and the recording paper sheet 1 from the rear surface side of the recording paper sheet 11. In addition, to apply a transfer bias to only the entrance side (a region indicated by J2 in FIG. 74) of the recording paper sheet 11, the electrode 700 is arranged at a position facing the region J2. With this arrangement, the rear surface of the recording paper sheet 11 is charged at the nip entrance (region J2) to perform transfer, and is subjected to charge removal at the nip exit (a region indicated by J1 in FIG. 74). Therefore, transfer separation can be attained in an ozone-less (free from ozone production) manner. When the electrostatic discharger according to the present invention is adopted as the transfer·separation apparatus, the arrangement in which the electromagnetic irradiation device 2 is arranged to irradiate an electromagnetic wave in a direction substantially parallel to the photoconductor 1 is also available, needless to say. When the photoconductor 1 deteriorates upon being exposed to direct irradiation of an electromagnetic wave, such deterioration can be avoided by limiting the irradiation direction or angle of electromagnetic wave irradiated by the electromagnetic wave irradiation device 2 (see FIGS. 61 and 62). Even in the arrangement that performs direct irradiation, the irradiation timing of electromagnetic wave are appropriately switched in correspondence with the feed timings of the recording paper sheet 11, thereby effectively suppressing an increase in electromagnetic wave irradiation amount onto the photoconductor 1.

Measurement experiments conducted to evaluate the discharging performance of the electrostatic discharger according to the present invention will be described in detail below. In the description of the experiments, a description of the arrangements of the 13th to 16th embodiments (Embodiments 2-13 to 2-16) of the electrostatic discharger according to the present invention will be inserted appropriately.

Experiment 6

In this experiment, the discharging performance was evaluated by irradiating an electromagnetic wave onto the uniformly charged cylindrical photoconductor 1 in the arrangement (basic arrangement) shown in FIG. 57. As the electromagnetic wave irradiation device 2, a soft X-ray source (the peak wavelength is about $2\times10^{-10}$ (m)) for irradiating continuous X-rays having a peak energy of 6 (keV) from an electromagnetic wave irradiation end 8 having an aperture portion 85 with a diameter $\phi$ of 30 (mm), was prepared. The electromagnetic wave irradiation device 2 is arranged at a position about 20 (mm) from the photoconductor 1. As the photoconductor 1, an Se photoconductor and an OPC photoconductor were used, were respectively charged to potentials of 600 (V) and −600 (V), and were subjected to charge removal while being rotated at a linear velocity of 40 (mm). As a result, the present inventors established that charge removal was satisfactorily attained without any smell of ozone and any residual potentials. Upon evaluating the performance using characteristic X-rays (a wavelength of $8.26\times10^{-10}$ (m)) of 1.5 (keV), a satisfactory result was similarly obtained, and the ozone-less charge removing effect could be demonstrated.

In the same arrangement (FIG. 57), the discharging performance using an X-ray irradiation device as the electromagnetic wave irradiation device 2 was also evaluated. The wavelength of X-rays used is about $10^{-11}$ (m). When X-rays were used, charge removal was similarly attained as in the case using soft X-rays, and evaluation was made by setting the linear velocity of each photoconductor 1 to be 200 (mm/s). As a result, a good result could be obtained for the Se photoconductor. However, in the case of the OPC photoconductor, a good discharging performance could be obtained initially, but the photoconductor 1 deteriorated after the charge removal was repeated about 1,000 times, and could not obtain a sufficient charge potential.

Figure 75:
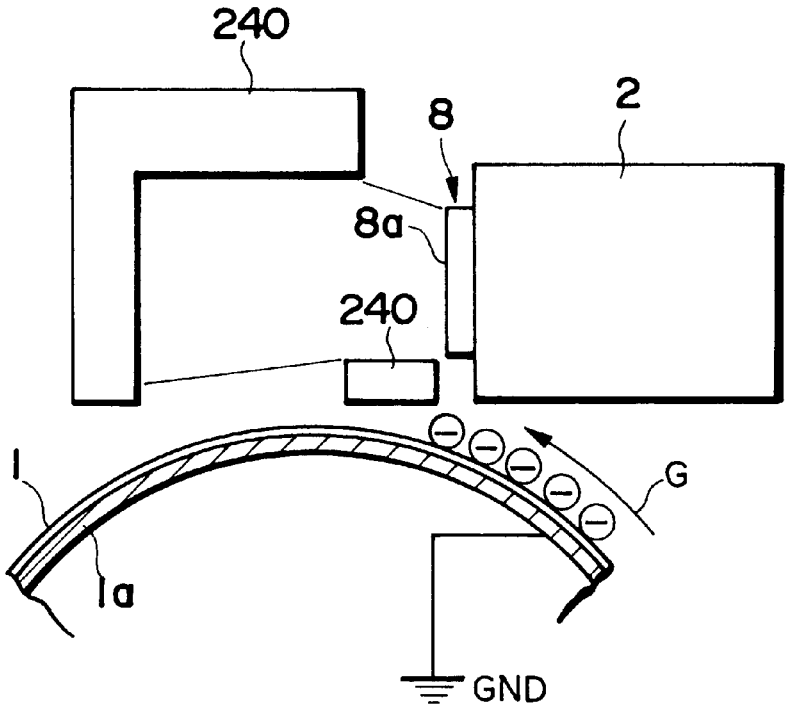
FIG. 75 is a schematic view showing the arrangement of the 13th embodiment (Embodiment 2-13) of the electrostatic discharger according to the present invention.
Figure 76:
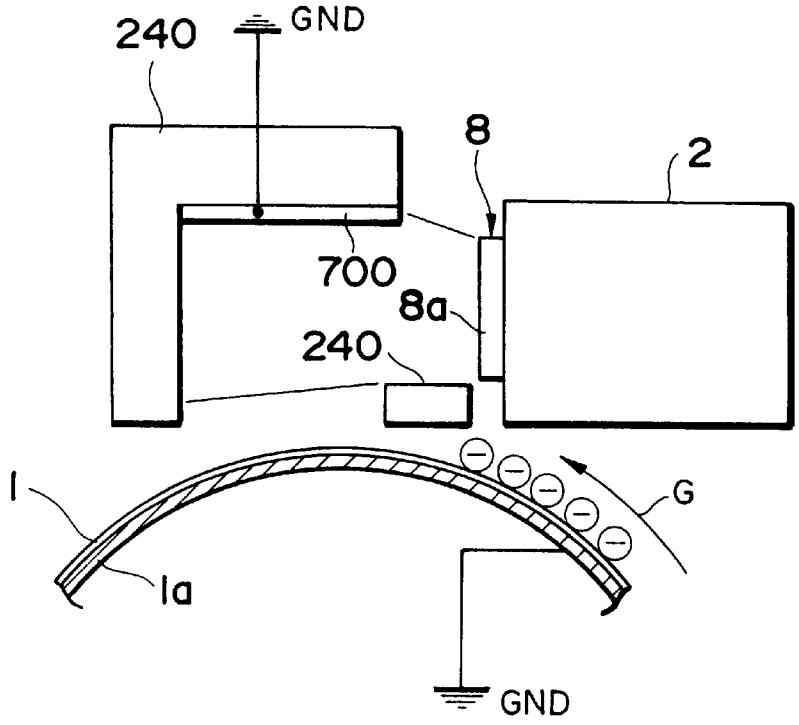
FIG. 76 is a schematic view showing the arrangement of the 14th embodiment (Embodiment 2-14) of the electrostatic discharger according to the present invention.

In view of this problem, the discharging performance of a charging removing apparatus in which the electromagnetic wave irradiation device 2 is arranged to irradiate X-rays in a direction substantially parallel to the photoconductor 1 as in the arrangement (the 13th embodiment) shown in FIG. 75, so as to prevent X-rays from being directly irradiated onto the photoconductor 1, was also evaluated. Note that FIG. 75 shows the arrangement of the 13th embodiment of the electrostatic discharger according to the present invention. In the 13th embodiment, in order to prevent X-rays from being irradiated onto a portion other than the portion to be charge-removed, an L-shaped electromagnetic wave shield member 240 is arranged at a position about 30 (mm) from the electromagnetic wave irradiation end 8. The electromagnetic wave shield member 240 is a 10-mm thick vinyl chloride plate. Since the irradiation angle of the X-ray source 2 used in this embodiment is 110°, X-rays are still directly incident on the photoconductor 1 by merely arranging the X-ray source 2 to irradiate X-rays in the direction parallel to the photoconductor 1. In order to solve this problem, another electromagnetic wave shield member 240 is also arranged beneath the electromagnetic wave irradiation end 8.

With this arrangement, the present inventors confirmed that a good charge removing result was obtained and the photoconductor 1 did not suffer any deterioration, when charge removal was performed while rotating the OPC photoconductor charged to −600 (V) at a linear velocity of 200 (mm/s).

Experiment 7

Figure 77:
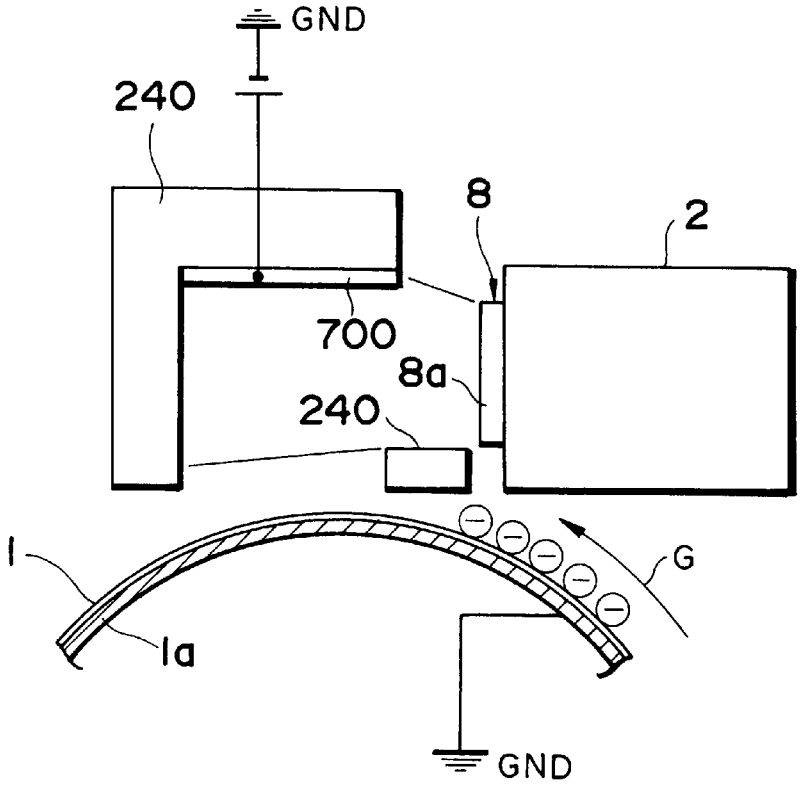
FIG. 77 is a schematic view showing the arrangement of a modification (the arrangement prepared for experiments) of the discharger (the 14th embodiment) shown in FIG. 76.
Figure 78:
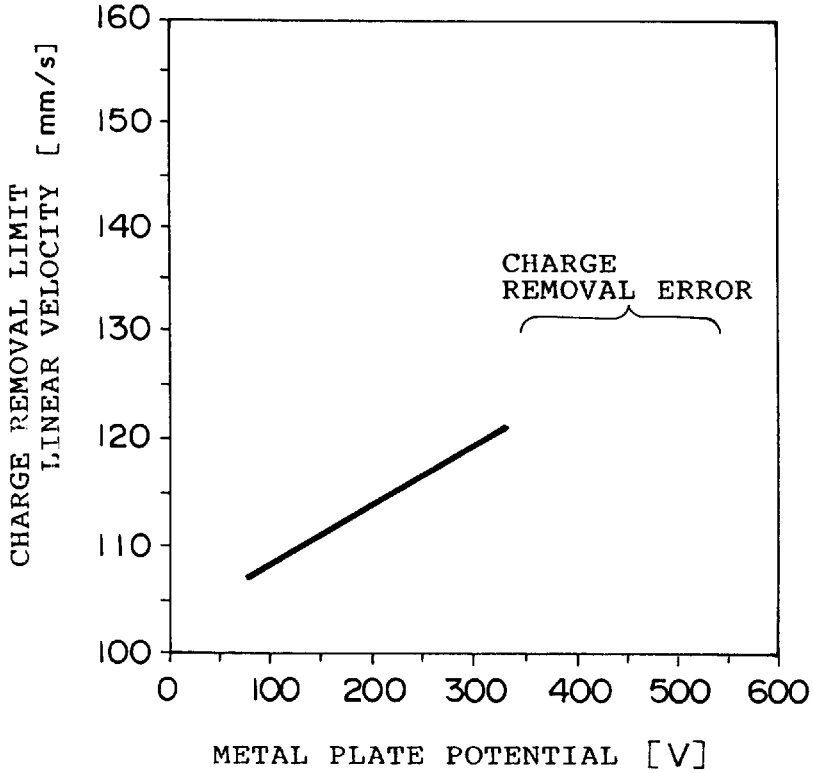
FIG. 78 is a graph showing the measurement results of the discharging performance (charge removal limit linear velocity) when the voltage (V) to be applied to an electrode is changed in the arrangement shown in FIG. 77.

This experiment was conducted for the discharger with the arrangement shown in FIG. 75. As the electromagnetic wave irradiation device 2, a soft X-ray source was prepared, and charge removal was performed while rotating an OPC photoconductor charged to −600 (V) at a linear velocity of 80 (mm/s). As a result, a residual potential of about 200 (V) was detected. In this experiment, a vinyl chloride plate was used as the electromagnetic wave shield members 240 as in Experiment 6 above. On the other hand, in the arrangement (the 14th embodiment) shown in FIG. 76, in which an electrode 700 at the ground potential was arranged on one electromagnetic wave shield member 240, when evaluation was made under the same conditions, the residual potential decreased to −10 (V) or less. Furthermore, changes in discharging performance were examined while changing the potential of the electrode 700 to which a DC voltage power supply was connected, as shown in FIG. 77 (the arrangement is the same as that in FIG. 76). FIG. 78 is a graph showing the examination results. In the graph shown in FIG. 78, the charge removal limit linear velocity means the limit linear velocity of the photoconductor 1 at which charges can be removed from the photoconductor 1 charged to −600 (V) to a residual potential of −10 (V) or less. As this value is larger, higher-speed charge removal is assured, and higher performance is expected to be obtained. In the discharger shown in FIG. 77, the discharging performance improved as the applied bias to the electrode (metal plate) 700 was increased, as shown in FIG. 78. However, when the applied bias had exceeded 350 (V), the photoconductor 1 was charged positive. Although there is an upper limit, high-speed charge removal can be realized by applying a predetermined voltage to the electrode 700.

Experiment 8

Figure 79:
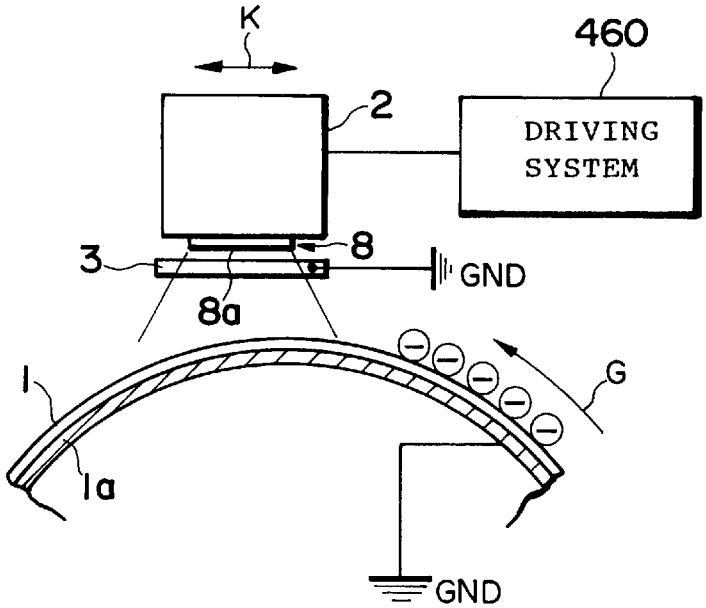
FIG. 79 is a schematic view showing the arrangement of the 15th embodiment (Embodiment 2-15) of the electrostatic discharger according to the present invention.

This experiment was conducted for a discharger with the arrangement (the 15th embodiment) shown in FIG. 79. A soft X-ray source as the electromagnetic wave irradiation device 2 arranged above the photoconductor 1 is about 25 (mm) from the photoconductor 1. A Be plate serving as the electrode 700 having a size of 50 (cm)×50 (cm) and a thickness of 0.2 (mm) is arranged about 2 (mm) beneath an electromagnetic wave irradiation hole 3. Furthermore, the Be plate has the ground potential.

The maximum value of the charge amount (charge potential) on the photoconductor 1 that could be removed to −10 (V) or less while the photoconductor 1 was rotated at a linear velocity of 40 (mm/s) was checked, and was found to be about −750 (V). Subsequently, when a driving system 460 reciprocally moved the electromagnetic wave irradiation device 2 at an amplitude of about 5 (mm) and a frequency of about 2 (Hz) in the direction of a double-headed arrow K in FIG. 79 in synchronism with the rotation of the photoconductor 1, the maximum charge amount of the photoconductor 1 that could be removed increased to −900 (V), and the discharging performance could be improved. In this experiment, the electromagnetic wave irradiation device was reciprocally moved by the system of accelerating the rotation of the rotation shaft of the photoconductor 1 using gears and converting the rotation into reciprocal motion via a cam-crank mechanism. Alternatively, the electromagnetic wave irradiation device 2 may be driven independently of the rotation of the photoconductor 1.

Experiment 9

Figure 80:
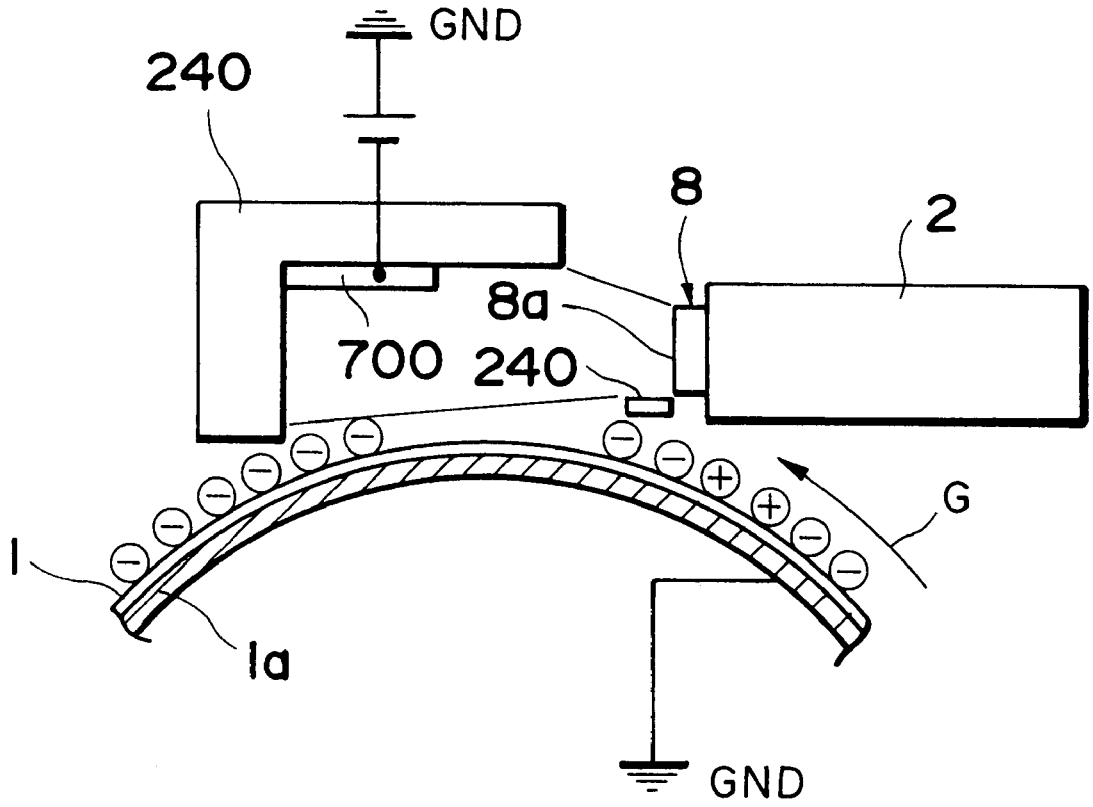
FIG. 80 is a schematic view showing the arrangement of the 16th embodiment (Embodiment 2-16) of the electrostatic discharger according to the present invention.

FIG. 80 shows the arrangement of the 16th embodiment of the electrostatic discharger according to the present invention. The discharger of the 16th embodiment also has a function of a charging apparatus. In the discharger of the 16th embodiment, as shown in FIG. 80, an X-ray source as the electromagnetic wave irradiation device 2 is arranged above the photoconductor 1, so that X-rays are irradiated in a direction substantially parallel to the photoconductor 1. The X-ray source irradiates X-rays having a wavelength of about $10^{-11}$ (m). A vinyl chloride electromagnetic wave shield plate 240 is arranged on the photoconductor side of the electromagnetic wave irradiation end 8 of the X-ray source. The plate 240 prevents X-rays from being directly irradiated onto the photoconductor 1. Also, another 10-mm thick, L-shaped electromagnetic wave shield member 240 comprising vinyl chloride is arranged at a position about 50 (mm) from the electromagnetic wave irradiation end 8. The surface, facing the photoconductor 1, of the L-shaped electromagnetic wave shield member 240 is separated by about 35 (mm) from the photoconductor 1, and a 25-mm wide electrode 700 is arranged on the downstream side, in the moving direction of the photoconductor, of this surface. Note that an arrow G in FIG. 80 indicates the moving direction of the photoconductor 1, and the electrode 700 is applied with −3 (kV). After latent images of +300 (V) and −300 (V) were formed on the photoconductor 1 on the upstream side of the electromagnetic wave irradiation device 2, the photoconductor 1 was rotated at a linear velocity of 100 (mm/s), and the charge potential was measured on the downstream side of the electromagnetic wave irradiation device 2. As a result, the photoconductor 1 was uniformly charged to −650 (V). Upon evaluating charging nonuniformity by developing the photoconductor 1, no charging nonuniformity was observed at all, and uniform charging was confirmed.

Experiment 10

An example in which the electrostatic discharger according to the present invention is applied to a transfer·separation apparatus of an electrophotography image forming apparatus will be explained below with reference to FIG. 74. In this embodiment, a soft X-ray source serving as the electromagnetic wave irradiation device 2 is arranged at a position about 15 (mm) below the photoconductor 1. The X-ray source irradiates soft X-rays toward the photoconductor 1. A Be plate serving as the electrode 700 having a thickness of 100 (μm) and a width of 30 (mm) is arranged at a position about 5 (mm) above the electromagnetic wave irradiation end 8 to extend from a position nearly the center of the electromagnetic wave irradiation end 8 to the paper feed side (region J2) of a recording paper sheet 11 in a direction substantially parallel to the electromagnetic wave irradiation end 8. Note that the Be plate as the electrode 700 is applied with a voltage of −3 (kV). Furthermore, a toner image was formed on the photoconductor using positively charged toner, and the photoconductor 1 was rotated at a linear velocity of 400 (mm/s). At the same time, a recording paper sheet 11 was fed to the nip below the photoconductor from a paper feeder (not shown), and the toner image was transferred onto the paper sheet. As a result, 90% or more of the toner image on the photoconductor 1 could be transferred to the recording paper sheet 11. Also, the separation performance was good, and even a thin paper sheet as well as an OHP sheet and high-quality paper sheet was never wound around the photoconductor 1.

As described above in the first to 16th embodiments (Embodiments 2-1 to 2-16) of the electrostatic discharger according to the present invention, since the electrostatic discharger according to the present invention performs charge removal by ions produced by irradiating an electromagnetic wave onto the member to be charge-removed or to the space in the vicinity of the member to be charge-removed, non-contact charge removal of the member to be charge-removed can be attained independently of the charging potential without processing any ozone.

Also, according to the electrostatic discharger of the present invention, when the electromagnetic wave irradiation device is arranged parallel to the member to be charge-removed, and irradiates an electromagnetic wave in a direction substantially parallel to the member to be charge-removed, the member to be charge-removed can be prevented from deteriorating upon direct irradiation of an electromagnetic wave.

Furthermore, according to the electrostatic discharger of the present invention, when the position of the electromagnetic wave irradiation end of the electromagnetic wave irradiation device is changed so that the electromagnetic wave irradiation region periodically moves along the moving direction of the member to be charge-removed, the charge removing efficiency can be improved. In this arrangement, when an electrode with a constant potential is arranged on the electromagnetic wave irradiation region or at a position facing the member to be charge-removed to sandwich the electromagnetic wave irradiation region therebetween, an effective electric field for charge removal can be formed, and the charge removing efficiency can be further improved.

Moreover, according to the electrostatic discharger of the present invention, since the arrangement that produces an electric field on a portion of the electromagnetic wave irradiation region can be simultaneously realized, the member to be charge-removed can be charged using the electric field, and non-contact, ozone-less charge removing and charging functions can be realized by a single apparatus. Accordingly, the electrostatic discharger of the present invention can be applied to a discharging and charging apparatus or a transfer·separation apparatus of an image forming apparatus. When the electromagnetic wave shield member is arranged on the member to be charge-removed side of the electromagnetic wave irradiation end, direct irradiation of an electromagnetic wave onto the member to be charge-removed can be prevented by a simple arrangement.

In addition, according to the electrostatic discharger of the present invention, since the electromagnetic wave shield member is arranged at a position facing the member to be charge-removed or the electromagnetic wave irradiation device to sandwich the electromagnetic wave irradiation region therebetween, an electromagnetic wave can be prevented from leaking outside the apparatus, and the safety of the apparatus can be improved. Also, when the electrode arranged on the electromagnetic wave irradiation region is set at a potential having a polarity opposite to that of the charge potential of the member to be charge-removed, an electric field for charge removal can be strengthened, and the charge removal speed can be increased.

What is claimed is:

1. An electrostatic charger for charging a major surface of a movable member to be charged to a predetermined potential, comprising:

an electromagnetic wave irradiation device having an electromagnetic wave output end face for outputting an electromagnetic wave of a predetermined wavelength; and an electric field forming system for producing an electric field having a predetermined strength in a space between the member to be charged and said electromagnetic wave irradiation device, said system having a first electrode device provided to face the major surface of the member to be charged, and an intermediate electrode device provided between the member to be charged and said first electrode device, said intermediate electrode device being separated by a predetermined distance from said first electrode device, wherein said first electrode device includes one of: a part of said electromagnetic wave irradiation device; and an electrode electrically separated from said electromagnetic wave irradiation device.

2. An electrostatic charger according to claim 1, wherein said electric field forming system includes a second electrode device provided at a position facing said electromagnetic wave irradiation device to sandwich the member to be charged therebetween.

3. An electrostatic charger according to claim 1, wherein said intermediate electrode device includes at least one electrode pair for generating a predetermined potential difference between the electromagnetic wave irradiation device side and the member to be charged side thereof.

4. An electrostatic charger according to claim 1, wherein said intermediate electrode device includes at least one of a metal mesh having a predetermined aperture ratio and a conductive plate having a plurality of through holes extending from said electromagnetic wave irradiation device toward the member to be charged.

5. An electrostatic charger according to claim 1, wherein said intermediate electrode device includes a conductive plate having a plurality of through holes extending from said electromagnetic wave irradiation device toward the member to be charged, said intermediate electrode device mainly containing a material selected from the group comprising beryllium (Be), magnesium (Mg), calcium (Ca), strontium (Sr), barium (Ba), aluminum (Al), carbon, a carbon film, and compounds or alloys thereof.

6. An electrostatic charger according to claim 1, wherein said intermediate electrode device includes an insulating film having a surface coated with a metal film.

7. An electrostatic charger according to claim 1, wherein said intermediate electrode device has a surface facing said electromagnetic wave irradiation device, said surface having a larger area than said electromagnetic wave output end face of said electromagnetic wave irradiation device.

8. An electrostatic charger according to claim 7, wherein said intermediate electrode device has a portion extending along at least one of a moving direction of the member to be charged and a direction opposite to the moving direction, with reference to a region facing said electromagnetic wave output end face of said electromagnetic wave irradiation device.

9. An electrostatic charger according to claim 1, further comprising:

a limiting member provided at at least one of a position between said electromagnetic wave irradiation device and said intermediate electrode device and a position between said intermediate electrode device and the member to be charged, said limiting member limiting an electromagnetic wave irradiation region where an electromagnetic wave from said electromagnetic wave irradiation device reaches.

10. An electrostatic charger according to claim 1, wherein said intermediate electrode device has a surface facing the member to be charged, said surface having a predetermined curvature to be substantially parallel to the major surface of the member to be charged.

11. An electrostatic charger according to claim 1, wherein said first electrode device includes said electromagnetic wave irradiation device.

12. An electrostatic charger according to claim 1, wherein said first electrode device includes an electrode, said electrode being attached to said electromagnetic wave irradiation device and being electrically isolated from said electromagnetic wave irradiation device.

13. An electrostatic charger for charging a major surface of a movable member to be charged to a predetermined potential Vs, comprising:

an electromagnetic wave irradiation device having an electromagnetic wave output end face for outputting an electromagnetic wave of a predetermined wavelength; and an electric field forming system having a first electrode device provided to face the major surface of the member to be charged, and a second electrode device provided at a position facing said first electrode device to sandwich the member to be charged therebetween, said electric field forming system generating a potential difference smaller than an insulating breakdown voltage of air in a gap width h in a space between said first and second electrode devices when h is the distance between said first electrode device and the member to be charged;

wherein said first electrode device includes one of: a part of said electromagnetic wave irradiation device; and an electrode electrically separated from said electromagnetic wave irradiation device.

14. An electrostatic charger according to claim 13, wherein said electric field forming system applies, to said second electrode device, a voltage with a polarity opposite to a polarity of the charge potential Vs and having an absolute value larger than an absolute value of the charge potential Vs, and applies 0 V to the major surface of the member to be charged.

15. An electrostatic charger according to claim 13, wherein said electric field forming system applies, to said second electrode device, a voltage having a characteristic opposite to a characteristic of the charge potential Vs, and applies 0 V to the major surface of the member to be charged.

16. An electrostatic charger according to claim 13, wherein said electric field forming system applies 0 V to said second electrode device, and applies, to said first electrode device, a voltage having the same characteristic as a characteristic of the charge potential Vs and having an absolute value larger than an absolute value of the charge potential Vs.

17. An electrostatic charger according to claim 13, wherein said first electrode device includes the electromagnetic wave irradiation device.

18. An electrostatic charger according to claim 13, wherein said first electrode device includes an electrode attached to said electromagnetic wave irradiation device, said first electrode device being electrically isolated from said electromagnetic wave irradiation device.

19. An electrostatic charger according to claim 18, wherein said first electrode device has an appropriate width L along a moving direction of the member to be charged.

20. An electrostatic charger according to claim 18, wherein said first electrode device is provided to become a distance between said first electrode device and the member to be charged narrow along a moving direction of the member to be charged.

21. An electrostatic charger according to claim 18, wherein said first electrode device has a surface with a predetermined curvature so as to become a distance between said first electrode device and the member to be charged narrow along a moving direction of the member to be charged.

22. An electrostatic charger for charging a major surface of a movable member to be charged to a predetermined potential, comprising:

an electromagnetic wave irradiation device having an electromagnetic wave output end face for outputting an electromagnetic wave of a predetermined wavelength;

an electric field forming system for producing an electric field with a predetermined strength in a space between the member to be charged and said electromagnetic wave irradiation device, said electric field forming system having a first electrode device provided so as to face the major surface of the member to be charged and electrically separated from said electromagnetic wave irradiation device, and a second electrode device provided so as to sandwich the member to be charged with said first electrode device; and an electromagnetic wave shield member provided to face said electromagnetic wave output end face of said electromagnetic wave irradiation device;

wherein said electromagnetic wave irradiation device is arranged such that said electromagnetic wave output end face is tilted by a predetermined angle greater than 0° with respect to the major surface of the member to be charred and that the electromagnetic wave from said electromagnetic wave irradiation device is output into a space defined between said first electrode device and the major surface of the member to be charged.

23. An electrostatic charger according to claim 22, wherein said electromagnetic wave shield member comprises an insulating material.

24. An electrostatic charger according to claim 22, wherein said electromagnetic wave shield member comprises a conductor.

25. An electrostatic charger according to claim 24, wherein an insulating member is attached to an end portion, on the member to be charged side, of said electromagnetic wave shield member.

26. An electrostatic charger according to claim 22, wherein said first electrode device has a first portion facing a surface to be charged of the member to be charged; and a second portion facing said electromagnetic wave output end face of said electromagnetic wave irradiation device, said second portion serving as said electromagnetic wave shield member.

27. An electrostatic charger according to claim 26, wherein an insulating member is attached to an end portion, on the member to be charged, of said second portion of said electromagnetic wave shield member.

28. An electrostatic charger according to claim 22, wherein said electrostatic charger apparatus satisfies:

$$H>2\times L\cdot\tan(\theta/2)+D$$

where θ is the irradiation angle of electromagnetic wave output from said electromagnetic wave irradiation device, L is the distance from said electromagnetic wave irradiation-device to said electromagnetic wave shield member, H is the height, in a direction perpendicular to the major surface of the member to be charged, of said electromagnetic wave shield member, and D is the aperture width, in the direction perpendicular to the major surface of the member to be charged, of said electromagnetic wave output end face of said electromagnetic wave irradiation device.

29. An electrostatic discharger for removing a charge from a major surface, on which an electrostatic latent image is formed, of a movable member to be charge-removed, comprising:

an electromagnetic wave irradiation device having an electromagnetic wave output end face for outputting an electromagnetic wave of a predetermined wavelength, said electromagnetic wave irradiation device provided in a space facing the major surface on which the electrostatic latent image is formed;

wherein said electromagnetic wave irradiation device is arranged such that a direction perpendicular to said electromagnetic wave output end face is tilted by a predetermined angle greater than 0° with respect to a direction perpendicular to the major surface of the member to be charge-removed.

30. An electrostatic discharger according to claim 29, further comprising an electromagnetic wave shield member provided in a position facing both said electromagnetic wave output end face and said major surface on which an electrostatic latent image is formed.

31. An electrostatic discharger according to claim 29, further comprising an electric field forming system for producing an electric field having a predetermined strength between said electromagnetic wave irradiation device and said electromagnetic wave shield member.

32. An electrostatic discharger according to claim 31, wherein said electric field forming system has electrode devices arranged so as to sandwich the member to be charge-removed, wherein said electrode devices sandwich an electromagnetic wave irradiation region, where the electromagnetic wave from said electromagnetic wave irradiation device reaches, therebetween.

33. An electrostatic discharger for removing a charge from a major surface, on which an electrostatic latent image is formed, of a movable member to be charge-removed, comprising:

an electromagnetic wave irradiation device having an electromagnetic wave output end face for outputting an electromagnetic wave of a predetermined wavelength; and an electric field forming system for producing an electric field having a predetermined strength in a space between the member to be charge-removed and said electromagnetic wave irradiation device, said system having at least a main electrode device provided to face the major surface of the member to be charge-removed, and an intermediate electrode device provided between the member to be charge-removed and said main electrode device, said intermediate electrode device being separated by a predetermined distance from said main electrode device.

34. An electrostatic discharger for removing a charge from a major surface, on which an electrostatic latent image is formed, of a movable member to be charge-removed, comprising:

an electromagnetic wave irradiation device having an electromagnetic wave output end face for outputting an electromagnetic wave of a predetermined wavelength;

a first driving system for moving the member to be charge-removed in a predetermined direction; and a second driving system for moving said electromagnetic wave irradiation device in the predetermined direction of movement of the member to be charge-removed.

* * * * *